US010272583B2

(12) United States Patent
Oiwa et al.

(10) Patent No.: US 10,272,583 B2
(45) Date of Patent: Apr. 30, 2019

(54) SLITTER, SHEET CUTTING DEVICE, AND SHEET PROCESSING APPARATUS

(71) Applicant: Duplo Seiko Corporation, Kinokawa-shi, Wakayama (JP)

(72) Inventors: Hideki Oiwa, Kinokawa (JP); Masayasu Matsumoto, Kinokawa (JP); Taichi Yamaguchi, Kinokawa (JP)

(73) Assignee: DUPLO SEIKO CORPORATION, Kinokawa-Shi, Wakayama (JP)

( * ) Notice: Subject to any disclaimer, the term of this patent is extended or adjusted under 35 U.S.C. 154(b) by 0 days.

(21) Appl. No.: 15/697,855

(22) Filed: Sep. 7, 2017

(65) Prior Publication Data

US 2018/0079097 A1 Mar. 22, 2018

(30) Foreign Application Priority Data

Sep. 21, 2016 (JP) ..... 2016-184607

(51) Int. Cl.

| | |
|---|---|
| ***B26D 1/24*** | (2006.01) |
| ***B26D 7/26*** | (2006.01) |
| *B26D 1/16* | (2006.01) |
| *B26D 1/18* | (2006.01) |

(52) U.S. Cl.

CPC ..... *B26D 1/245* (2013.01); *B26D 7/2621* (2013.01); *B26D 7/2635* (2013.01); *B26D 1/165* (2013.01); *B26D 1/185* (2013.01)

(58) Field of Classification Search

CPC ..... B26D 1/245; B26D 7/2635; B26D 7/2621
See application file for complete search history.

(56) References Cited

U.S. PATENT DOCUMENTS

| | | | | |
|---|---|---|---|---|
| 1,141,465 A * | 6/1915 | Kehler | B26D 1/245 | 83/492 |
| 4,077,291 A * | 3/1978 | Obenshain | B26D 7/2635 | 83/499 |
| 5,761,980 A * | 6/1998 | Ima | B26D 1/225 | 83/425.4 |

(Continued)

FOREIGN PATENT DOCUMENTS

| | | |
|---|---|---|
| JP | 2005-239308 A | 9/2005 |
| JP | 2012-76163 A | 4/2012 |

OTHER PUBLICATIONS

Extended European Search Report dated Feb. 23, 2018, issued by the European Patent Office in corresponding European Application No. 17189471.0-1016. (6 pages).

*Primary Examiner* — Sean M Michalski
(74) *Attorney, Agent, or Firm* — Buchanan Ingersoll & Rooney PC

(57) ABSTRACT

A slitter comprising: an upper rotary blade; a lower rotary blade; an upper housing for holding the upper rotary blade; and a lower housing for holding the lower rotary blade, the slitter being constructed such that the both rotary blades revolve in a manner that a tip on a cutting surface side of the upper rotary blade and a tip on a cutting surface side of the lower rotary blade are rubbed together so that a sheet passing through between the both rotary blades is cut, wherein the upper rotary blade is cantilevered on the cutting surface side by a cantilevered supporting part and the lower rotary blade is cantilevered on a non-cutting surface side by a cantilevered supporting part.

20 Claims, 53 Drawing Sheets

(56) References Cited

U.S. PATENT DOCUMENTS 6,071,222 A * 6/2000 Schneider ..... B26D 1/245 493/355
6,155,152 A * 12/2000 Bilstein ..... B26D 1/245 83/397
6,155,154 A * 12/2000 Hsu ..... B26D 7/2621 403/322.4
6,258,410 B1 * 7/2001 Annoura ..... B26D 1/0006 427/289
6,721,060 B1 * 4/2004 Kawamura ..... B26D 1/245 358/1.3
7,134,372 B2 * 11/2006 Flaherty ..... B23D 35/004 83/425.4
7,290,339 B1 * 11/2007 Schmelzer ..... B26B 27/005 30/2
7,975,582 B1 * 7/2011 Coon ..... B23D 19/04 30/265
7,980,174 B2 * 7/2011 Alt-Steiner ..... B26D 7/2621 101/224
9,120,284 B2 * 9/2015 Capoia ..... B26D 7/2635
2002/0022562 A1 * 2/2002 Waldeck ..... B26D 7/2635 493/463
2002/0152866 A1 * 10/2002 Bilstein ..... B26D 5/04 83/433
2005/0061121 A1 * 3/2005 Lauderbaugh ..... B26D 7/2635 83/13
2005/0217447 A1 * 10/2005 Hollandsworth .... B26D 7/2635 83/499
2006/0185487 A1 * 8/2006 Li ..... B26D 1/245 83/498
2007/0056419 A1 * 3/2007 Tippmann, Sr. ..... B26D 7/2635 83/531
2007/0062355 A1 * 3/2007 Supe-Dienes ..... B26D 7/2635 83/499
2018/0178480 A1 * 6/2018 Capoia ..... B26D 1/225
2018/0186024 A1 * 7/2018 Schmidt ..... B26D 7/2635

* cited by examiner

SLITTER, SHEET CUTTING DEVICE, AND SHEET PROCESSING APPARATUS

BACKGROUND OF THE INVENTION

Field of the Invention

The present invention relates to a slitter for cutting a sheet as well as a sheet cutting device and a sheet processing apparatus employing this slitter.

Background Art

Patent Document 1 discloses a slitter constructed such that two lower blades are in contact with an upper blade from both sides in the width direction. According to this, cutting is performed on both sides of the upper blade.

Patent Document 2 discloses a slitter constructed such that an upper rotary blade held by an upper housing and a lower rotary blade held by a lower housing are rubbed together so that cutting is performed. In this slitter, each of the upper housing and the lower housing individually has a size protruding toward both sides of the rotary blade by a predetermined dimension.

PRIOR ART REFERENCES

Patent Documents

[Patent Document 1] JP 2005-239308 A
[Patent Document 2] JP 2012-76163 A

SUMMARY OF THE INVENTION

Problems to be Solved by the Invention

In the slitter of Patent Document 1, the width dimension of a sheet piece generated by cutting is determined by the width dimension of the upper blade. Thus, the width of the sheet piece cannot be set up freely. Further, in the slitter of Patent Document 2, even when the two slitters are desired to be brought into close contact with each other in order that the cutting positions of the two slitters may be made close to each other, the protruding portions of the housings intervene so that the two slitters cannot be brought closer than a predetermined distance. Thus, the width dimension of the sheet piece generated by cutting has been difficult to be made small.

An object of the present invention is to provide a slitter in which the width dimension of a sheet piece generated by cutting can be made small and can be set up freely and, further, to provide a sheet cutting device and a sheet processing apparatus employing this slitter.

Means for Solving the Problem

The slitter of a first aspect of the present invention is characterized by a slitter comprising: an upper rotary blade; a lower rotary blade; an upper housing for holding the upper rotary blade; and a lower housing for holding the lower rotary blade, the slitter being constructed such that the both rotary blades revolve in a manner that a tip on a cutting surface side of the upper rotary blade and a tip on a cutting surface side of the lower rotary blade are rubbed together so that a sheet passing through between the both rotary blades is cut, wherein one rotary blade selected from the upper rotary blade and the lower rotary blade is cantilevered on the cutting surface side of the one rotary blade by a first cantilevered supporting part.

The sheet cutting device of a second aspect of the present invention is characterized by a sheet cutting device for performing a plurality of cutting processes at once onto a sheet under conveyance, wherein a plurality of slitters according to the first aspect are provided, and wherein all slitters are provided such as to cut the sheet along a direction of conveyance of the sheet.

The sheet processing apparatus of a third aspect of the present invention is characterized by a sheet processing apparatus for processing a sheet in the course of conveyance of the sheet, wherein a plurality of slitters according to the first aspect are aligned in a width direction, and wherein all slitters are provided such as to cut the sheet along a direction of conveyance of the sheet.

The sheet processing apparatus of a fourth aspect of the present invention is characterized by a sheet processing apparatus for processing a sheet in the course of conveyance of the sheet, including at least a sheet cutting device according to the second aspect.

Effect of the Invention

According to the slitter of the first aspect of the present invention, the width dimension of a sheet piece generated by cutting can be made remarkably small and can be set up freely.

According to the sheet cutting device of the second aspect of the present invention, cutting processing can be performed such as to generate sheet pieces whose width dimensions are remarkably small.

According to the sheet processing apparatus of the third or the fourth aspect of the present invention, the sheet can be further processed before and/or after the cutting processing.

DETAILED DESCRIPTION

<Slitter>

[First Embodiment]

Figure 1:
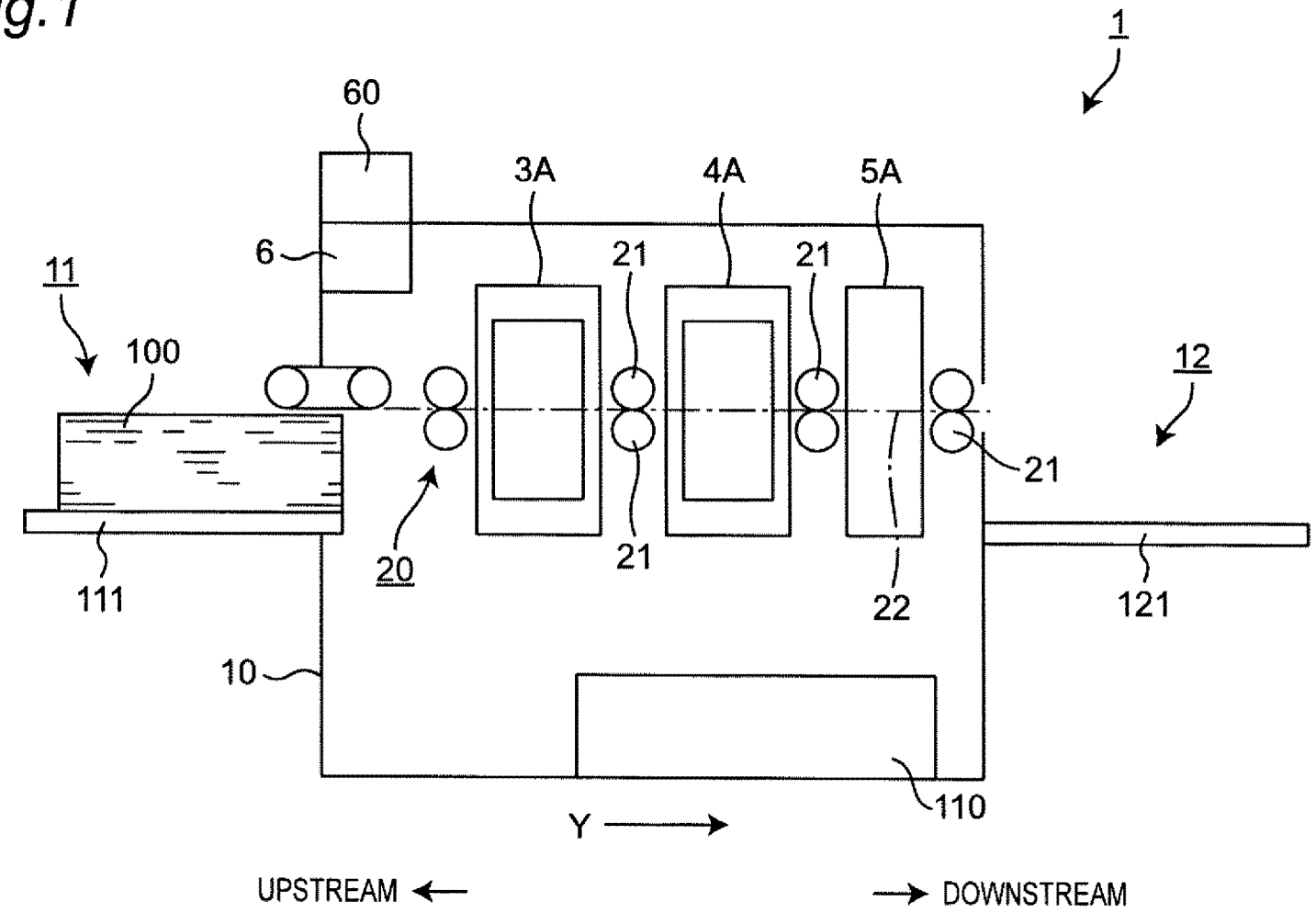
FIG. 1 is a longitudinal-section schematic view showing a sheet cutting device and a sheet processing apparatus employing a slitter of a first embodiment.

FIG. 1 is a longitudinal-section schematic view showing a sheet cutting device and a sheet processing apparatus employing a slitter of the present embodiment. The sheet processing apparatus 1 includes a paper feeding part 11 provided with a paper feed tray 111 and a paper ejection part 12 provided with a paper ejection tray 121 each provided at each end of an apparatus body 10. A conveyance path 22 from the paper feeding part 11 to the paper ejection part 12 is constructed by a conveyance part 20 composed of a large number of pairs of rollers 21. The conveyance part 20 conveys a sheet 100 one by one in an arrow Y direction from the paper feeding part 11 toward the paper ejection part 12. In the conveyance direction indicated by the arrow Y, the paper feeding part 11 side is referred to as the "upstream" and the paper ejection part 12 side is referred to as the "downstream". Then, in the conveyance path 22, in the order from the paper feeding part 11 side, a conveyance correction part, an information read part, a rejection part, and the like (not shown) are provided and then processing parts 3A, 4A, and 5A are provided. Here, the processing part 3A is a sheet cutting part for performing only the processing of cutting the sheet along the conveyance direction Y at arbitrary positions in the width direction. The processing part 4A is, for example, a crease processing part for performing crease processing on the sheet along the conveyance direction Y at arbitrary positions in the width direction. The processing part 5A is, for example, a transverse sheet cutting part for cutting the sheet along the width direction of the sheet. Here, the "width direction" indicates a direction X perpendicular to the conveyance direction Y. Further, when the downstream is viewed from the upstream, the rightward in the width direction is referred to as the "right side" (or simply the "right") and the leftward in the width direction is referred to as the "left side" (or simply the "left"). Here, the processing parts 4A and 5A may be processing parts for performing processing of other arbitrary types. Further, the sheet cutting part may be provided in at least one of the processing parts 4A and 5A. In this case, the processing part 3A may be a processing part for performing processing of another arbitrary type. Further, the processing parts in an arbitrary number greater than or equal to two may be provided.

Further, in the sheet processing apparatus 1, a control part 6 for controlling the operation of the entire apparatus is provided in the inside of the apparatus body 10. The control part 6 is implemented by a CPU, a ROM, a RAM, or the like. An operation panel 60 is connected to the control part 6. Further, in the sheet processing apparatus 1, a trash box 110 for accommodating shreds (also including scraps) generated by the processing on the sheet is provided in the bottom of the apparatus body 10.

Figure 2:
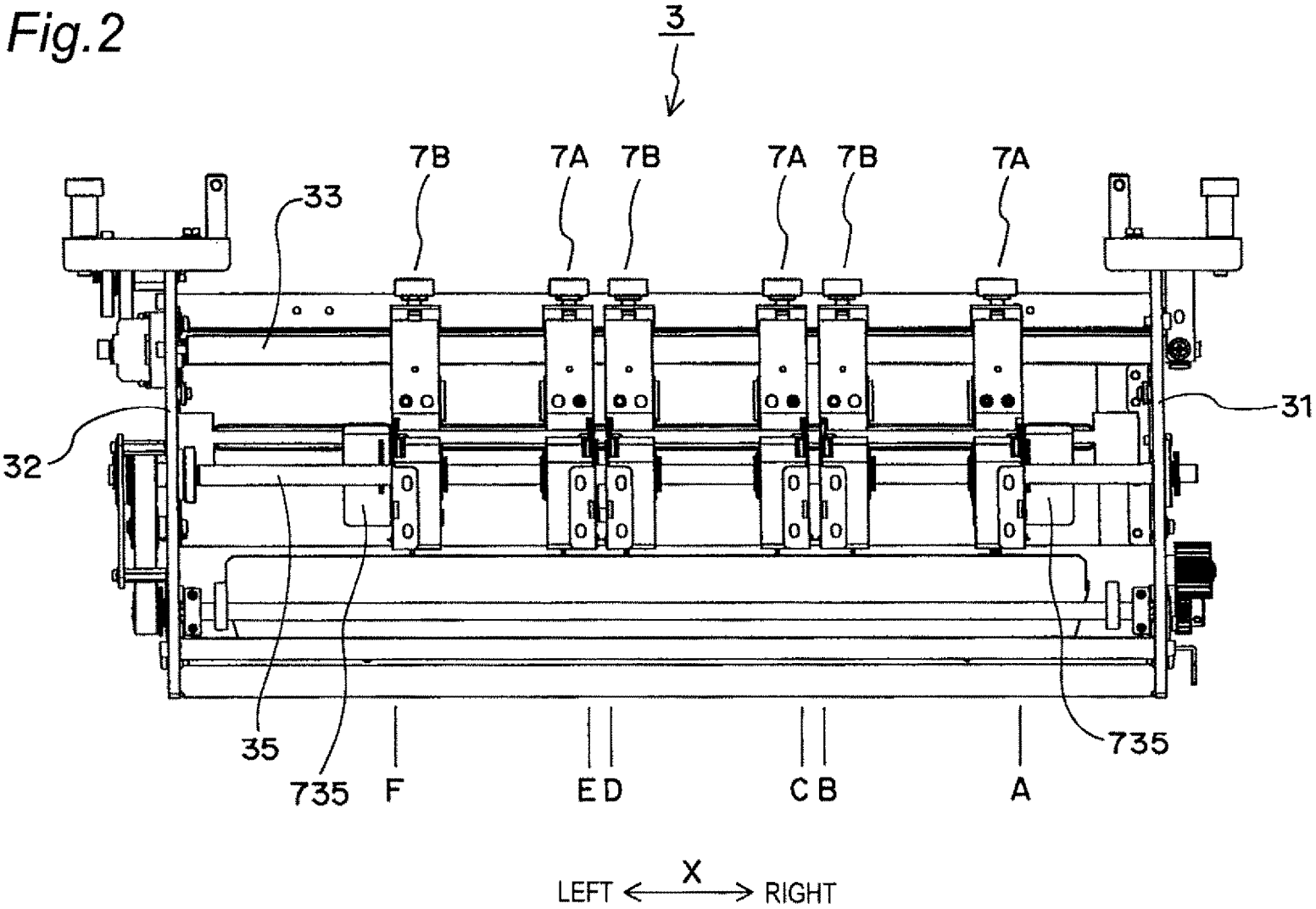
FIG. 2 is a diagram of a sheet cutting device of FIG. 1 viewed from the upstream.

FIG. 2 is a diagram of a sheet cutting device 3 provided in the processing part 3A viewed from the upstream in the conveyance direction. The sheet cutting device 3 includes six slitters aligned in the width direction. The slitters are divided into two kinds consisting of a right type slitter 7A and a left type slitter 7B. The only difference between the right type slitter 7A and the left type slitter 7B is that their structures are right-left symmetric to each other. Here, the number of slitters provided in the sheet cutting device 3 is not limited to six and may be an arbitrary number greater than or equal to one. In the present embodiment, the allowable number is ten at maximum.

(Detailed Configuration)

Figure 3:
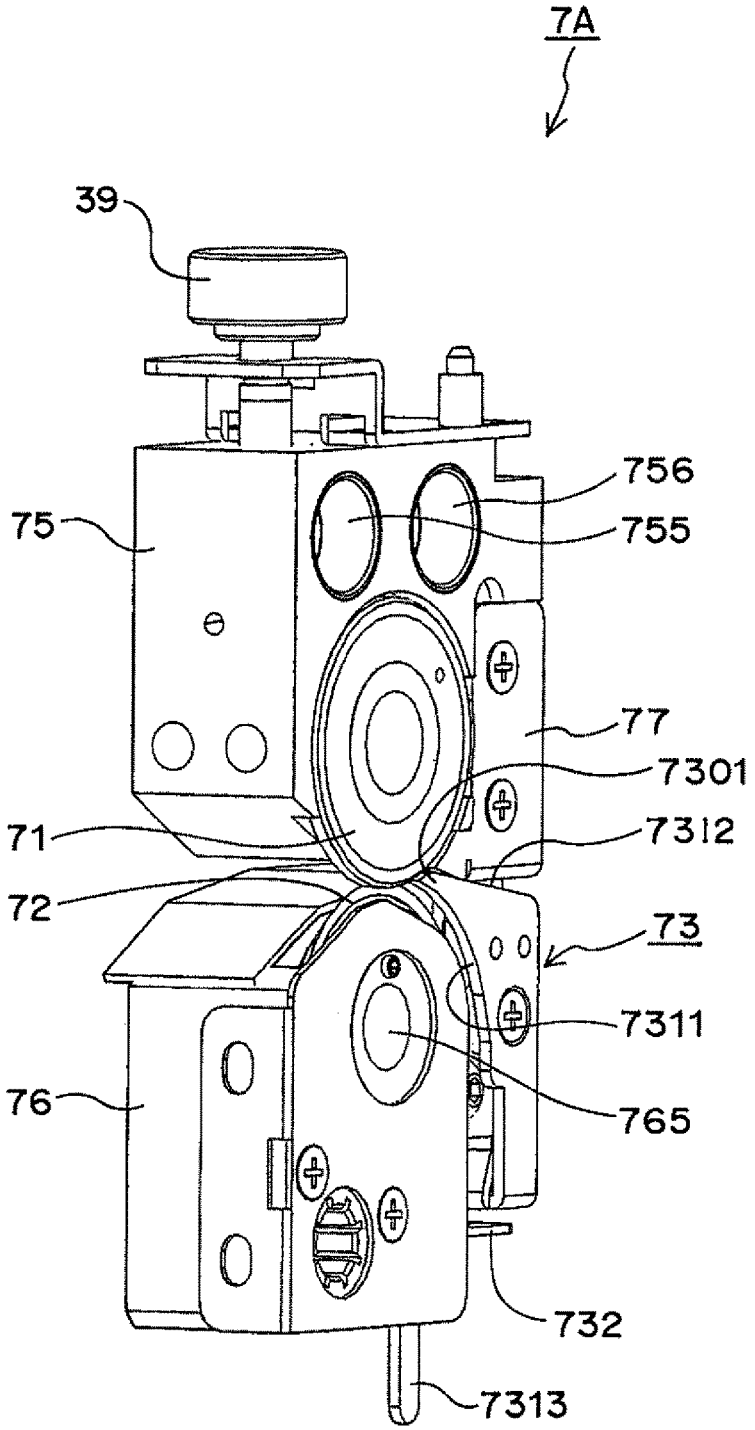
FIG. 3 is a perspective view of a right type slitter of a first embodiment viewed from slightly above in the upstream.
Figure 4:
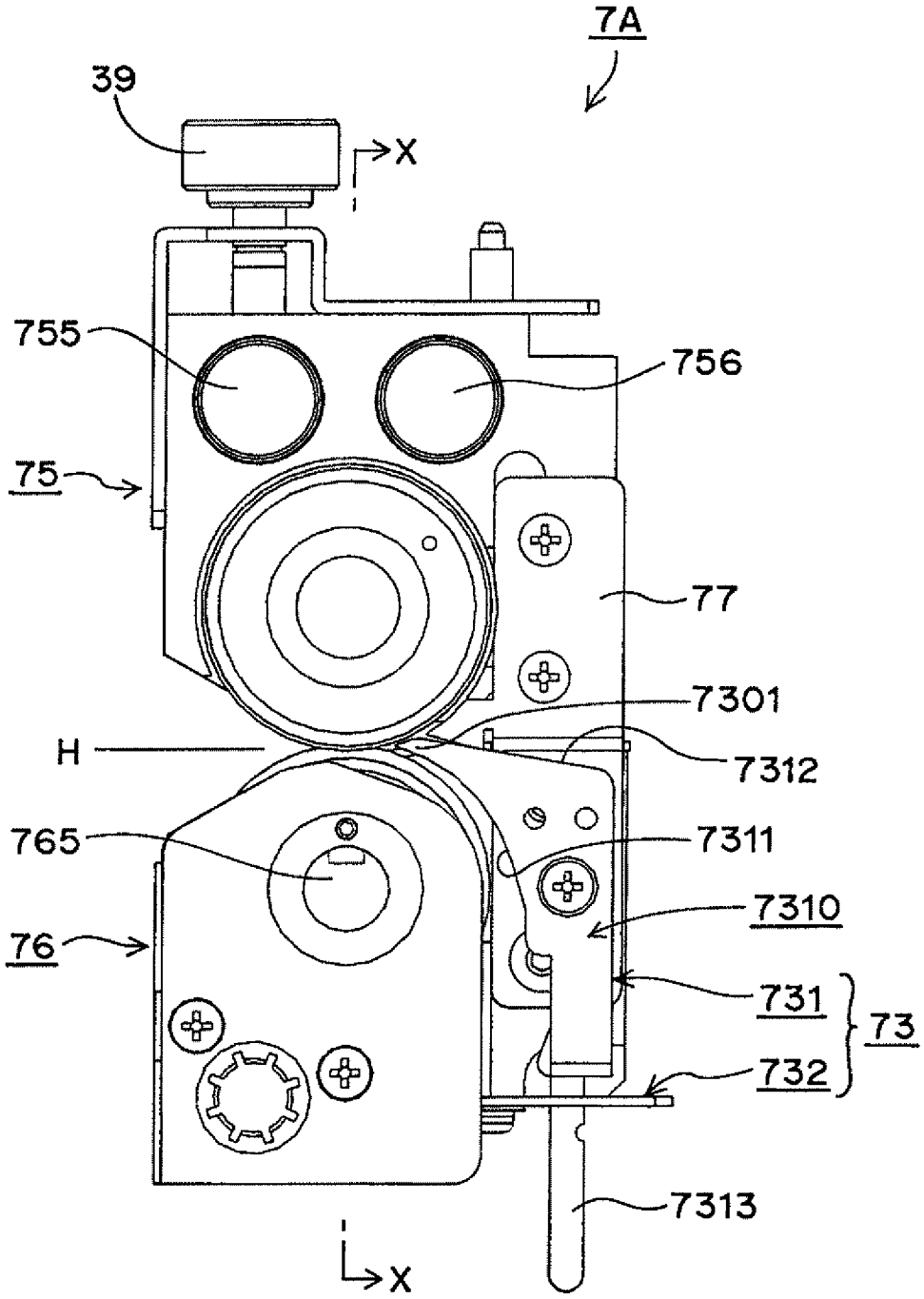
FIG. 4 is a right side view of a right type slitter of FIG. 3.
Figure 5:
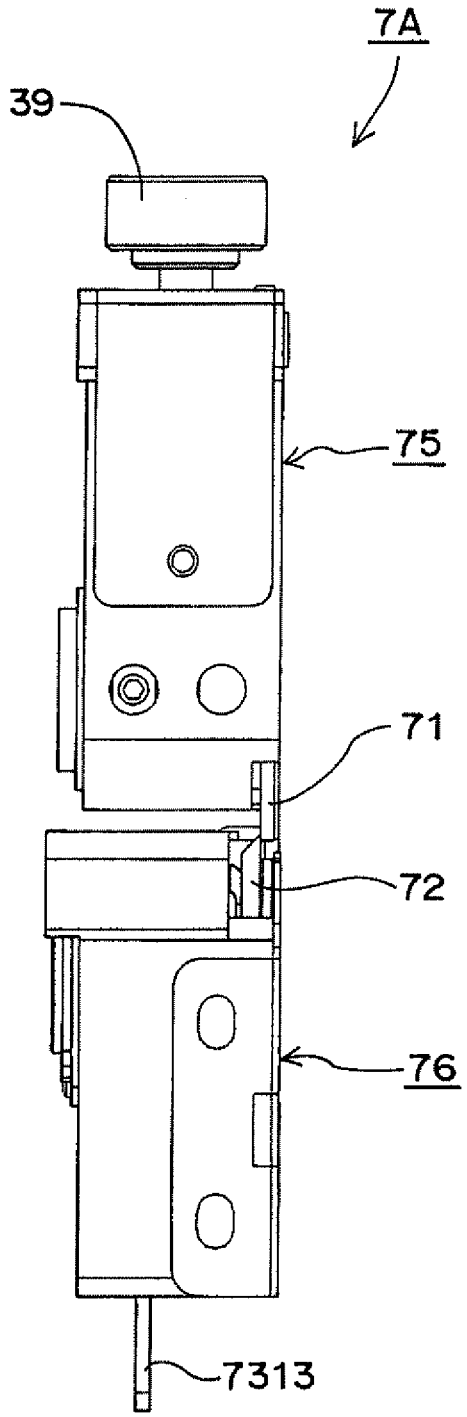
FIG. 5 is a front view of a right type slitter of FIG. 3 viewed from the upstream.
Figure 6:
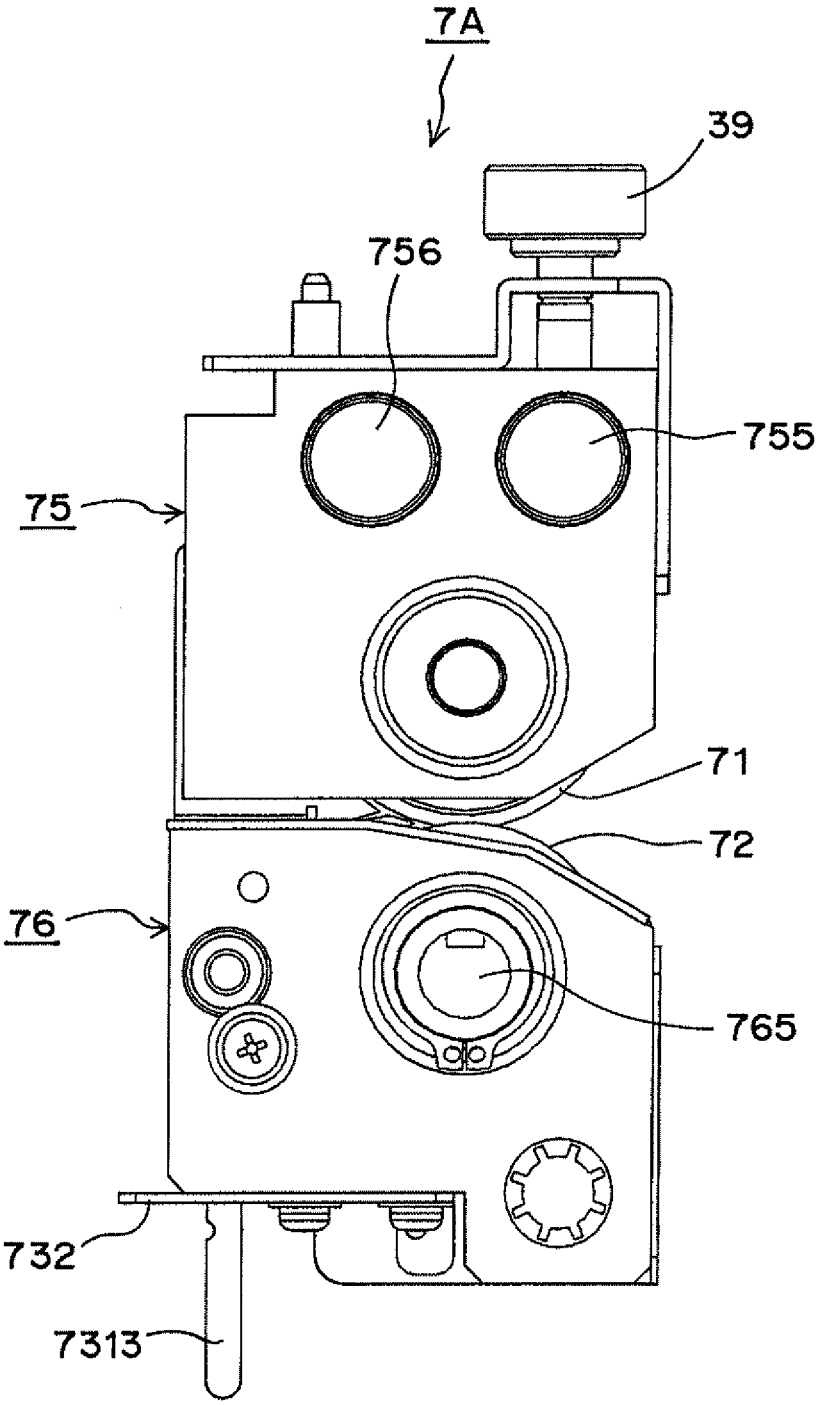
FIG. 6 is a left side view of a right type slitter of FIG. 3.
Figure 7:
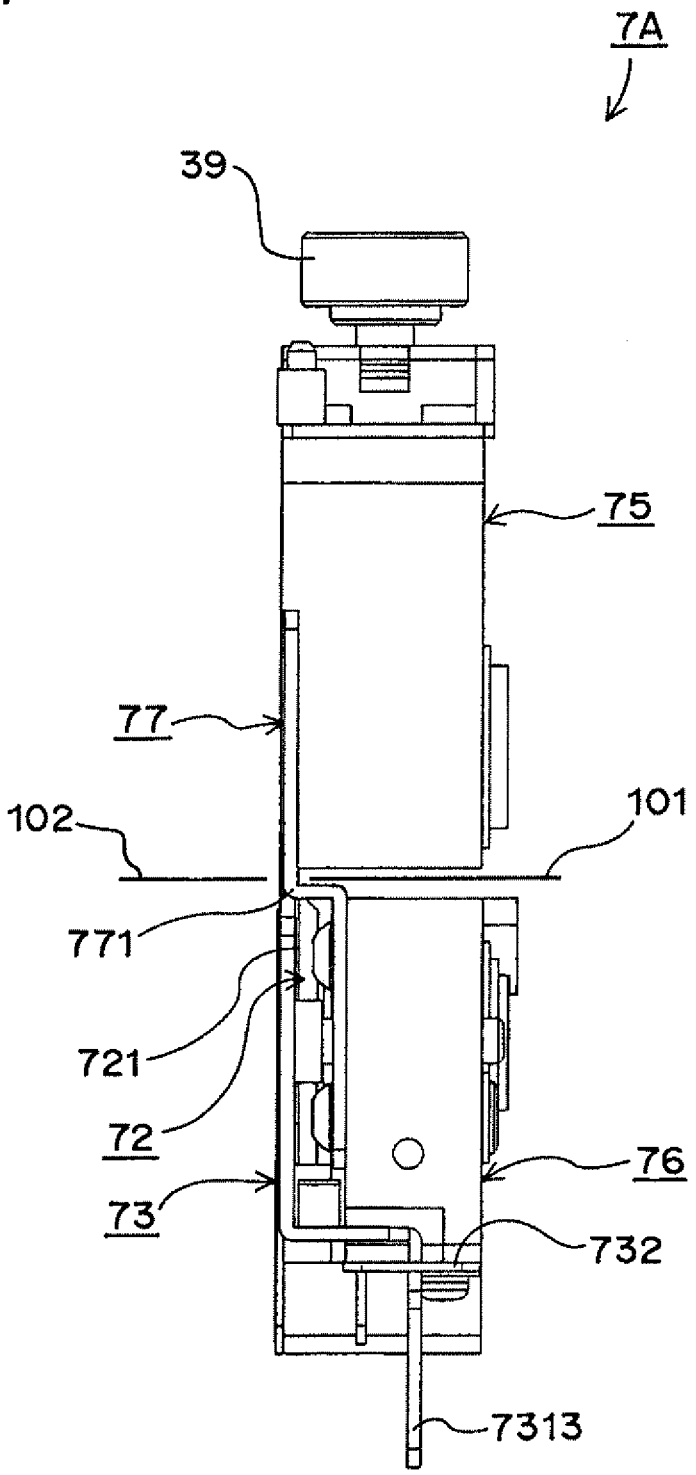
FIG. 7 is a rear view of a right type slitter of FIG. 3.
Figure 8:
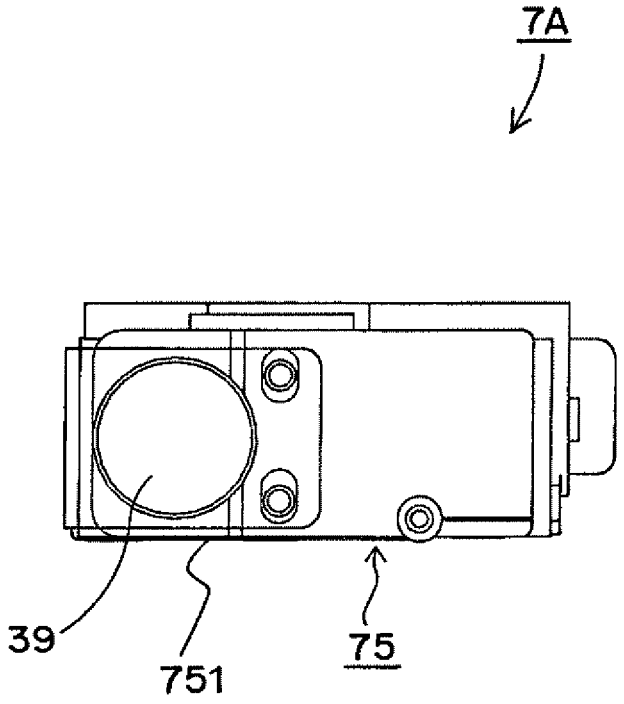
FIG. 8 is a top view of a right type slitter of FIG. 3.
Figure 9:
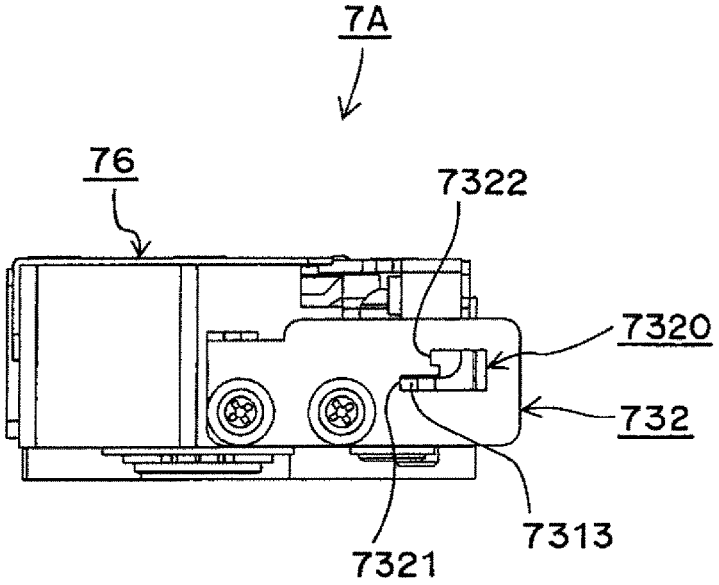
FIG. 9 is a bottom view of a right type slitter of FIG. 3.

FIG. 3 is a perspective view of the right type slitter 7A viewed from slightly above in the upstream. FIGS. 4 to 9 are six-view drawings of the right type slitter 7A. FIG. 4 is a right side view, FIG. 5 is a front view viewed from the upstream, FIG. 6 is a left side view, FIG. 7 is a rear view, FIG. 8 is a top view, and FIG. 9 is a bottom view. As shown in these figures, the right type slitter 7A includes an upper rotary blade 71, a lower rotary blade 72, a box-shaped upper housing 75, a box-shaped lower housing 76, a link plate 77 for linking both housings 75 and 76, and a scrap exclusion member 73.

Figure 10:
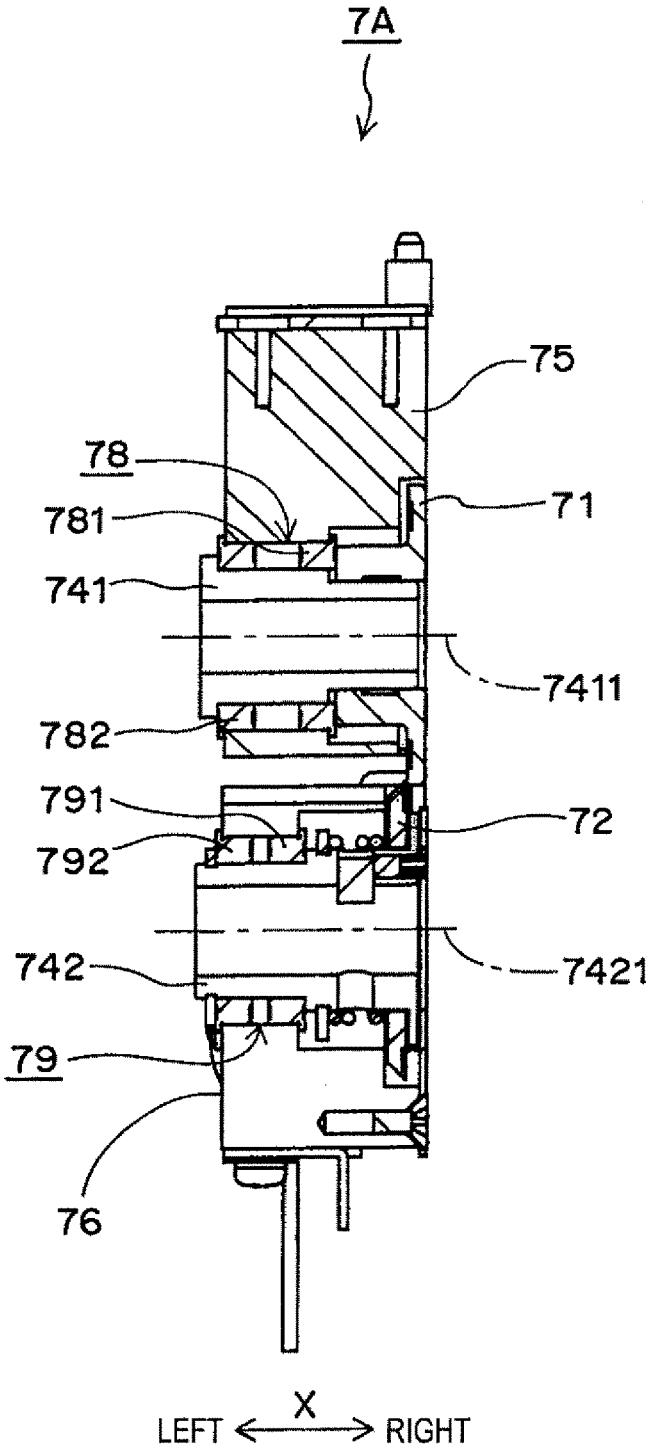
FIG. 10 is a sectional view taken in an arrow X-X direction in FIG. 4.
Figure 11:
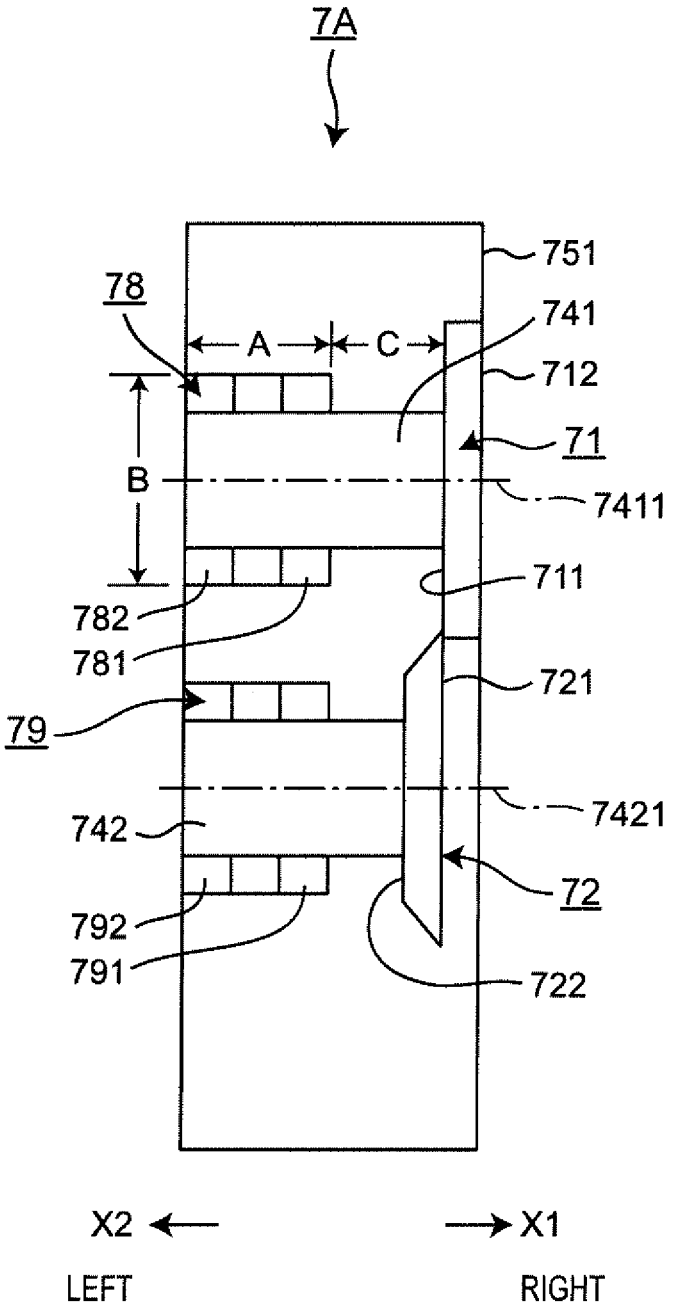
FIG. 11 is a schematic view of FIG. 10.

FIG. 10 is a sectional view taken in an arrow X-X direction in FIG. 4. The upper rotary blade 71 is located at the right end of the upper housing 75 and then cantilevered on a cutting surface 711 side of the upper rotary blade 71 by a cantilevered supporting part 78. The lower rotary blade 72 is located near the right end of the lower housing 76 and then cantilevered on a non-cutting surface 722 side of the lower rotary blade 72 by a cantilevered supporting part 79. Here, the lower rotary blade 72 is located on the left side relative to the upper rotary blade 71. FIG. 11 is a schematic view of FIG. 10. The upper rotary blade 71 is a flat blade. The right type slitter 7A is constructed such that the both rotary blades 71 and 72 revolve in a manner that the tip on the cutting surface 711 side of the upper rotary blade 71 and the tip on the cutting surface 721 side of the lower rotary blade 72 are rubbed together so that the sheet passing through between both rotary blades 71 and 72 is cut. Here, as shown in FIG. 7, two sheet pieces 101 and 102 generated by cutting are separated by a bent part 771 of the link plate 77 and then passed to the downstream. Here, the upper rotary blade 71 may be constructed from a rotary blade having a similar shape to the lower rotary blade 72.

In the cantilevered supporting part 78, a revolving shaft 741 for supporting the upper rotary blade 71 is supported in a manner not permitting swing relative to the shaft center 7411 by two bearings 781 and 782 arranged with an interval in between. This realizes the cantilevered supporting of the upper rotary blade 71. Further, in the cantilevered supporting part 79, a revolving shaft 742 for supporting the lower rotary blade 72 is supported in a manner not permitting swing relative to the shaft center 7421 by two bearings 791 and 792 arranged with an interval in between. This realizes the cantilevered supporting of the lower rotary blade 72.

Such cantilevered supporting is realized by satisfying conditions based on various parameters. For example, conditions regarded as generally preferable are that, as for the dimensions A, B, and C shown in FIG. 11, A/C is made large and further B is also made large. Here, "A" is the width dimension supported by the bearings, "B" is the outer diameter of the bearings, and "C" is the width dimension from the edge of the bearing to the cutting surface 711.

The upper housing 75 has a rectangular shape in plan view. Then, a first side surface 751 (FIG. 8) is oriented to a direction X1 toward the non-cutting surface 712 side of the upper rotary blade 71 (the rightward in the width direction). Here, a direction X2 indicates a direction toward the cutting surface 711 side of the upper rotary blade 71, that is, the leftward in the width direction. Then, the first side surface 751 and the non-cutting surface 712 of the upper rotary blade 71 constitute the same plane. That is, the first side surface 751 does not protrude beyond the non-cutting surface 712 in the direction X1 extending toward the non-cutting surface 712 side and, further, is located on the non-cutting surface 712 side relative to the cutting surface 711.

The scrap exclusion member 73 is provided on the cutting surface 721 side of the lower rotary blade 72 such as to exclude a sheet piece generated by cutting. The scrap exclusion member 73 includes a sheet guide 731 and an operating plate 732. The sheet guide 731 includes: a guide body 7310 provided with a curved surface part 7311 extending downward and with a flat upper surface part 7312; and a lever part 7313 extending downward from the guide body 7310. The curved surface part 7311 is directed to the upstream in the conveyance direction. The operating plate 732 is horizontally fixed under the lower housing 76 and is provided with a hole 7320 through which the lever part 7313 goes. As shown in FIG. 9, the hole 7320 includes a first groove 7321 and a second groove 7322 for fixing the lever part 7313. Here, the lever part 7313 is biased toward the first groove 7321 and the second groove 7322 by a spring (not shown).

Figure 12:
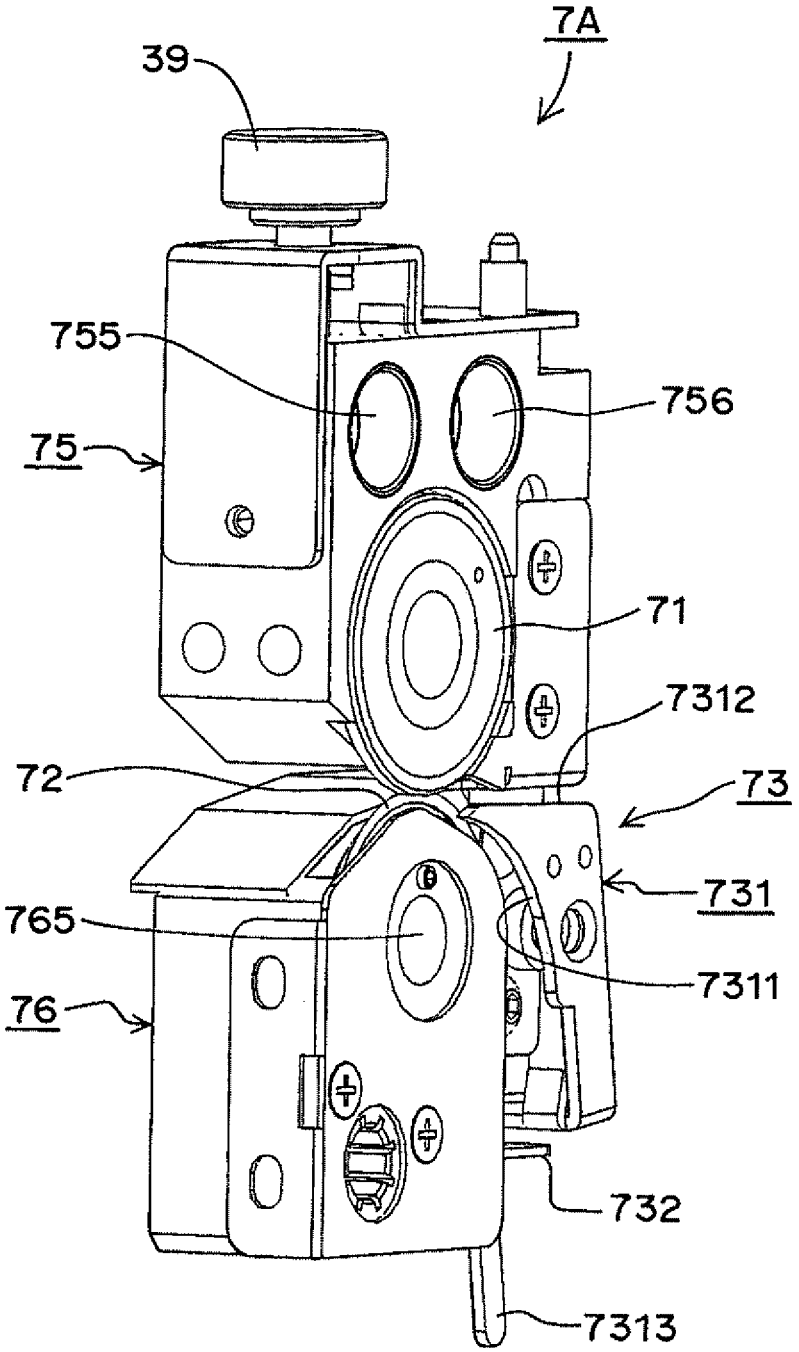
FIG. 12 is a perspective view of a right type slitter whose scrap exclusion member is in a retreat mode, viewed from slightly above in the upstream.
Figure 13:
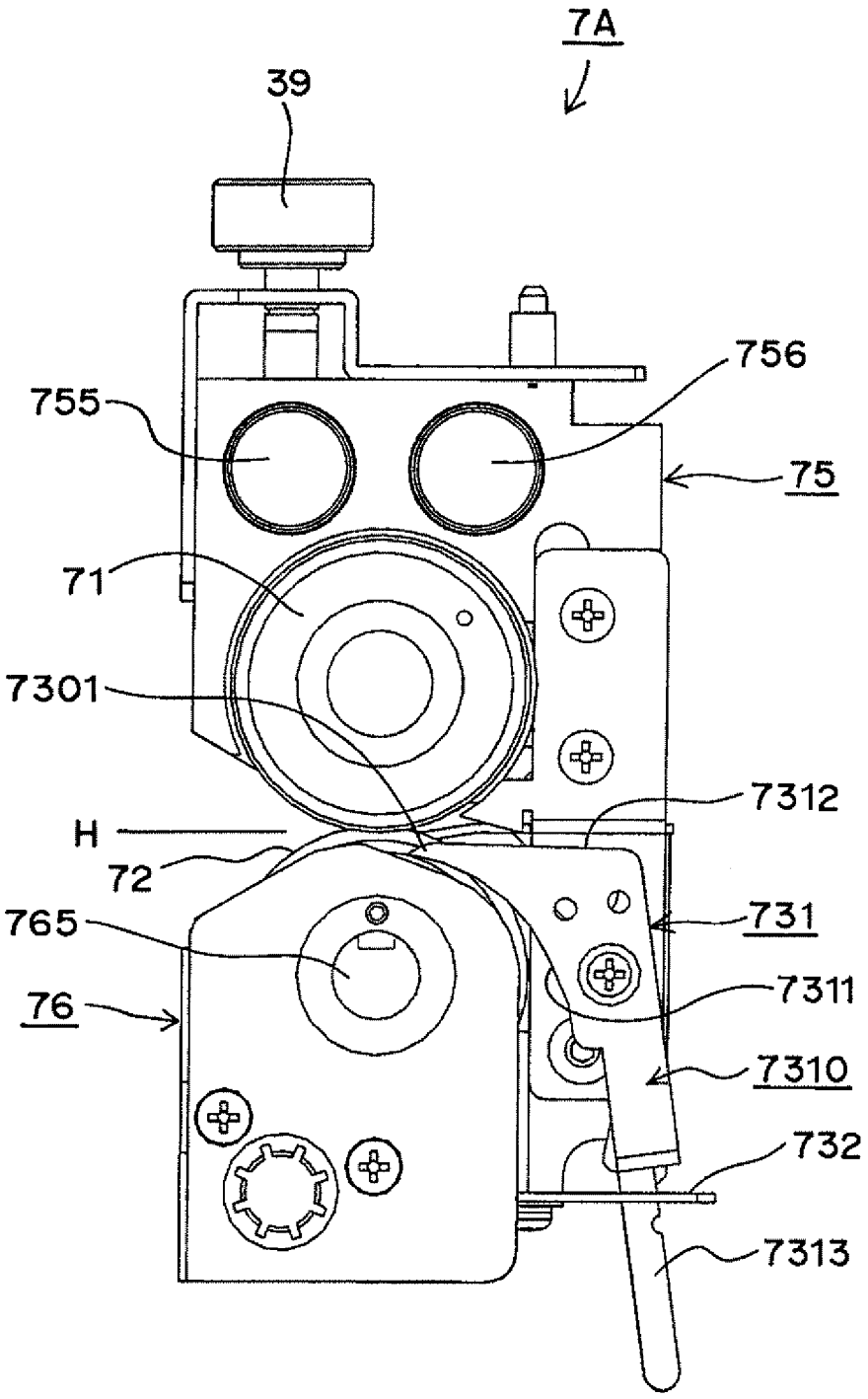
FIG. 13 is a right side view of a right type slitter of FIG. 12.
Figure 14:
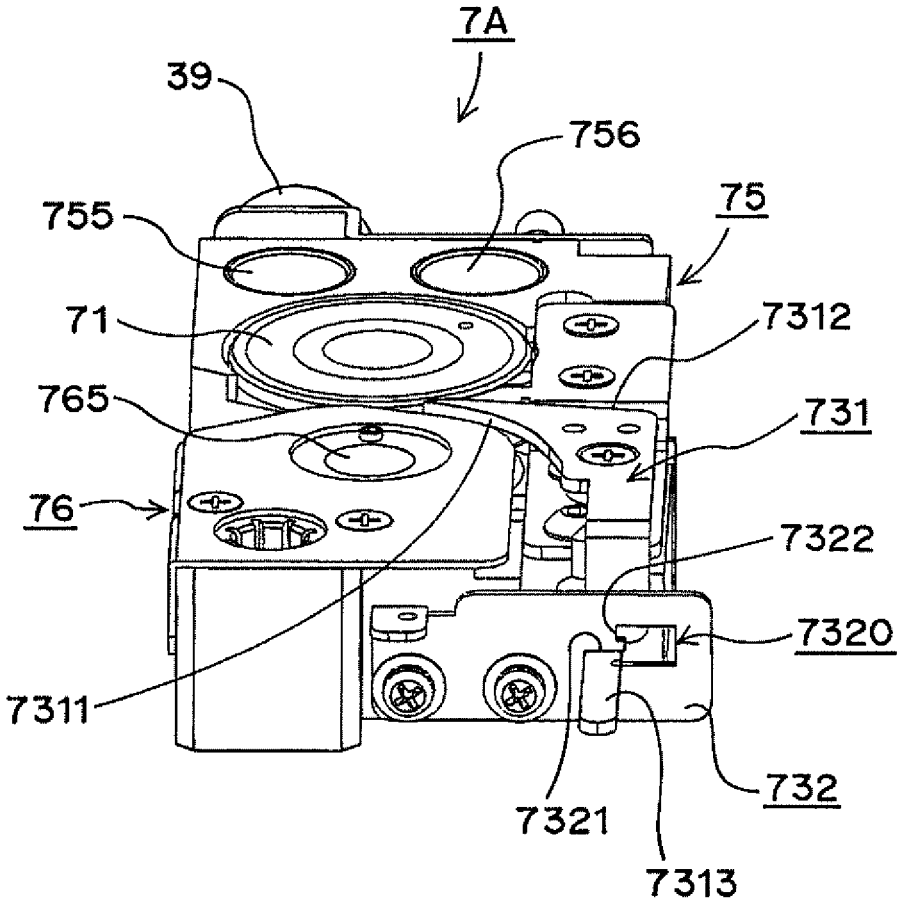
FIG. 14 is a perspective view of a right type slitter whose scrap exclusion member is in an exclusion mode, viewed from below.
Figure 15:
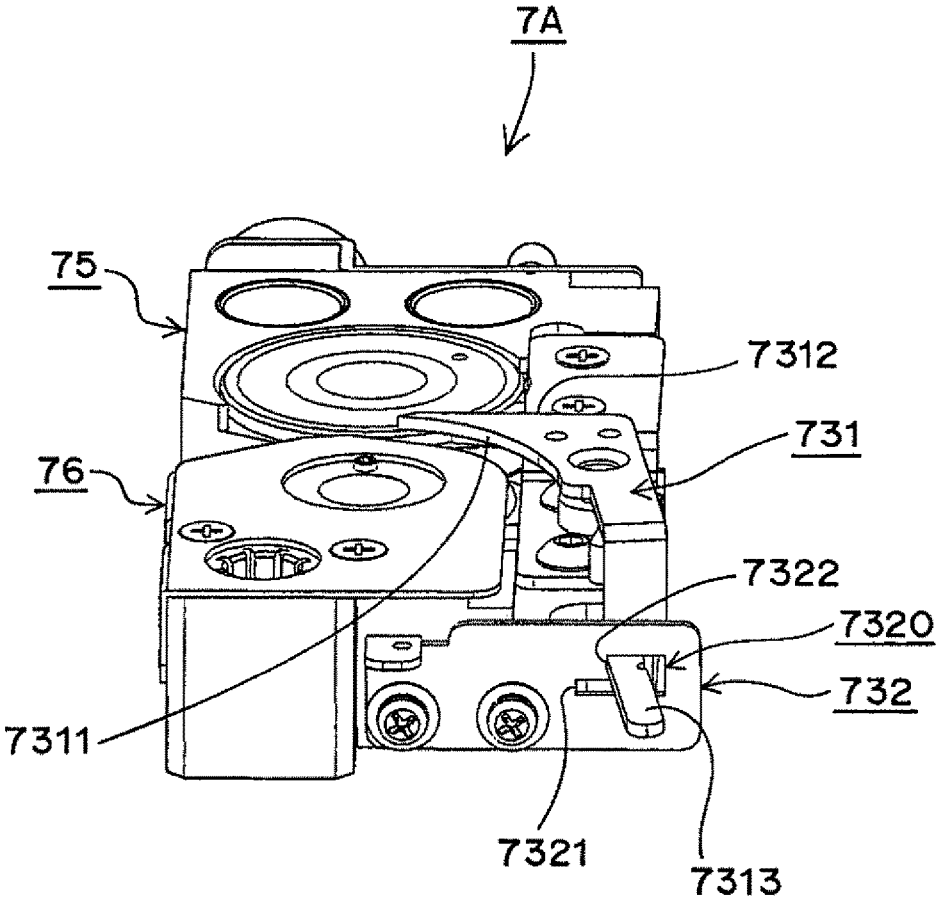
FIG. 15 is a perspective view of a right type slitter whose scrap exclusion member is in a retreat mode, viewed from below.
Figure 16:
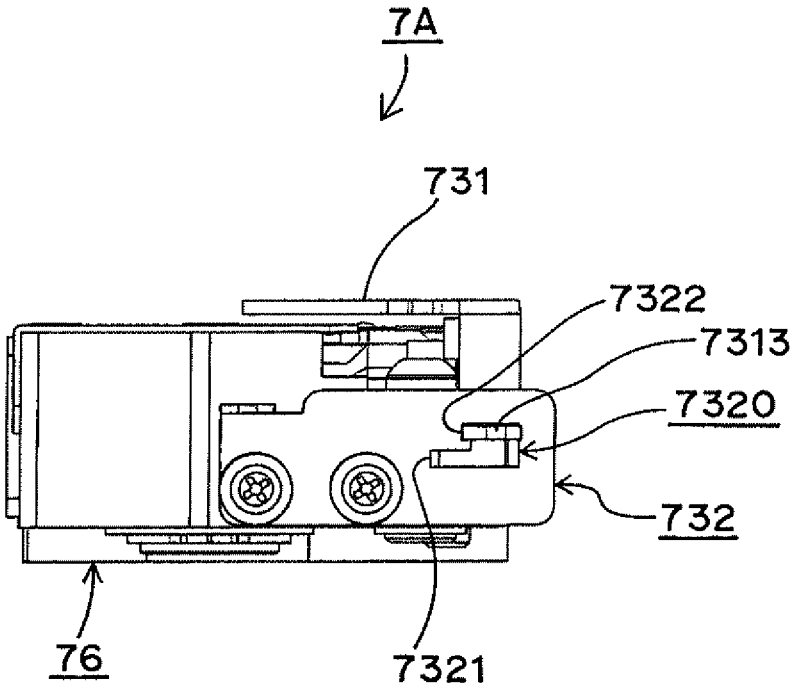
FIG. 16 is a bottom view of a right type slitter whose scrap exclusion member is in a retreat mode.

The sheet guide 731 can be displaced between an exclusion mode in which the sheet piece generated by cutting is excluded and a retreat mode in which the sheet piece generated by cutting is not excluded and is passed to the downstream in the conveyance direction. FIGS. 3 and 4 show the exclusion mode. FIGS. 12 and 13 show the retreat mode. FIG. 14 is a perspective view of the sheet guide 731 in the exclusion mode viewed from below. When the lever part 7313 has been fixed to the first groove 7321 as shown in FIGS. 9 and 14, the sheet guide 731 goes into the exclusion mode. In contrast, when the lever part 7313 has been fixed to the second groove 7322 as shown in FIGS. 15 and 16, the sheet guide 731 goes into the retreat mode.

In the exclusion mode, as shown in FIG. 4, an upper end 7301 of the curved surface part 7311 is located slightly above a cutting position H. Thus, the sheet piece generated by cutting is guided downward along the curved surface part 7311, that is, guided in the exclusion direction, and then excluded to the trash box 110. In the retreat mode, as shown in FIG. 13, the upper end 7301 of the curved surface part 7311 is located slightly below the cutting position H. Thus, the sheet piece generated by cutting is guided to the downstream of the conveyance direction (that is, in a non-exclusion direction) along the upper surface part 7312. The cutting position H is a height position where the upper rotary blade 71 and the lower rotary blade 72 are rubbed together so that cutting is performed. Here, in the exclusion mode, the sheet guide 731 is located within a width directional range of the upper rotary blade 71 (that is, between the cutting surface 711 and the non-cutting surface 712). In contrast, in the retreat mode, the sheet guide 731 is located on a slightly right side relative to the upper rotary blade 71 in the width direction.

The left type slitter 7B has a configuration right-left symmetric to the right type slitter 7A.

(Effect)

According to the right type slitter 7A and the left type slitter 7B having the above-mentioned configuration, the following effects can be obtained.

Figure 17:
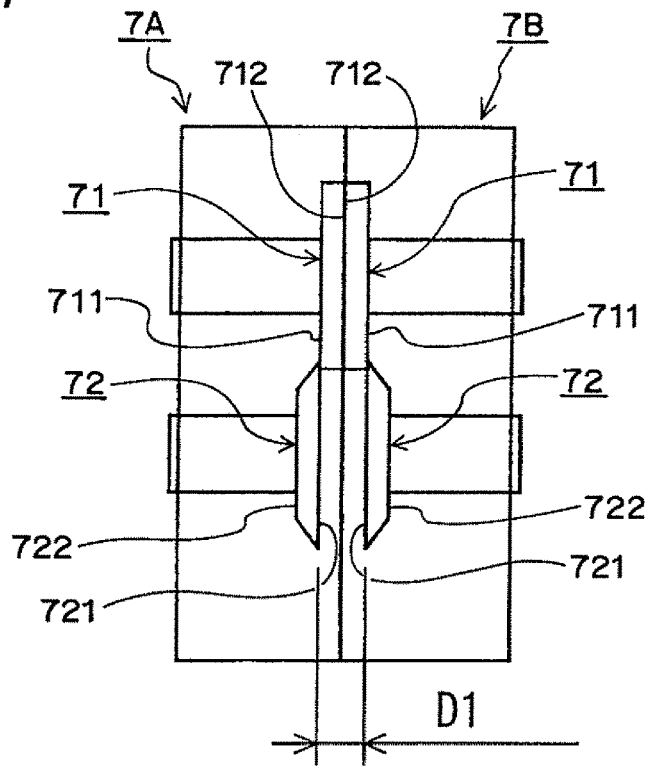
FIG. 17 is a schematic view showing an example of combination in which a right type slitter and a left type slitter are in close contact with each other.

(1) By virtue of the cantilevered supporting, in the right type slitter 7A, the upper rotary blade 71 is located at the right end of the upper housing 75 and the lower rotary blade 72 is located near the right end of the lower housing 76. Further, in the left type slitter 7B, the upper rotary blade 71 is located at the left end of the upper housing 75 and the lower rotary blade 72 is located near the left end of the lower housing 76. Thus, as shown in FIG. 17, both slitters 7A and 7B can be brought into close contact with each other in such a manner that the non-cutting surfaces 712 of the upper rotary blades 71 face to each other. In this case, the width dimension of the sheet piece obtained by cutting can be set to be a remarkably small dimension D1. Specifically, D1 is 5 mm.

Figure 18:
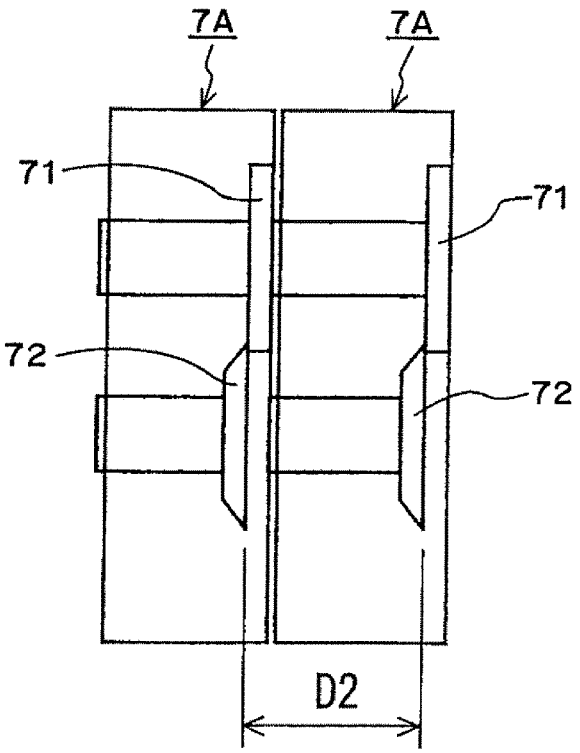
FIG. 18 is a schematic view showing an example of combination in which right type slitters are in close contact with each other.
Figure 19:
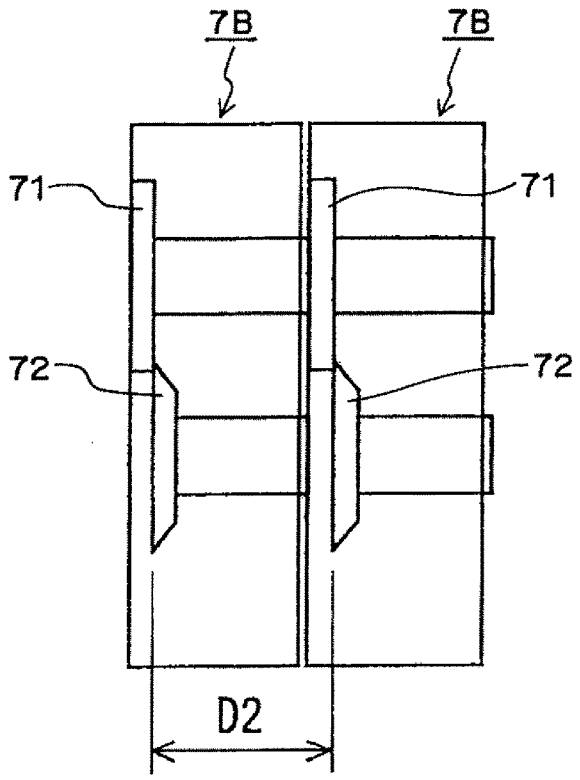
FIG. 19 is a schematic view showing an example of combination in which left type slitters are in close contact with each other.

Further, as shown in FIG. 18, the right type slitters 7A can be brought into close contact with each other. Further, as shown in FIG. 19, the left type slitters 7B can be brought into close contact with each other. Then, in this case, the width dimension of the sheet piece obtained by cutting can be set to be a dimension D2. Specifically, D2 is 25 mm.

Figure 20:
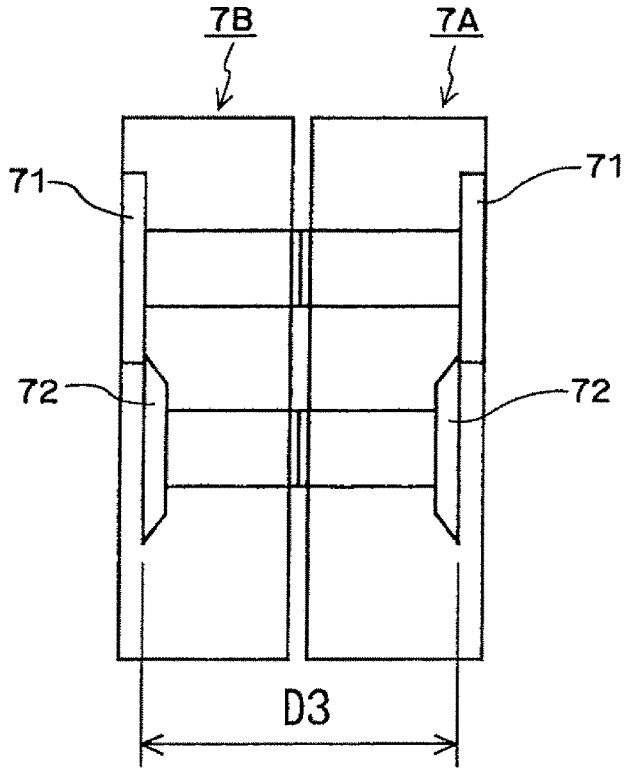
FIG. 20 is a schematic view showing another example of combination in which a right type slitter and a left type slitter are in close contact with each other.

Further, as shown in FIG. 20, both slitters 7A and 7B can be brought into close contact with each other in an orientation reverse to that of FIG. 17. In this case, the width dimension of the sheet piece obtained by cutting can be set to be a dimension D3. Specifically, D3 is 48 mm.

Further, according to the combination and arrangement of the slitters shown in FIGS. 17 to 20, when both slitters are made distant from each other, the width dimensions D1, D2, and D3 can be enlarged.

Thus, according to the right type slitter 7A and the left type slitter 7B having the above-mentioned configuration, the width dimension of the sheet piece generated by cutting can be made remarkably small and can be set up freely.

(2) The first side surface 751 of the upper housing 75 does not protrude beyond the non-cutting surface 712 in the direction X1 extending toward the non-cutting surface 712 side and, further, is located on the non-cutting surface 712 side relative to the cutting surface 711. Thus, the upper rotary blade 71 is not exposed to the outside of the upper housing 75 in the width direction. Accordingly, in the right type slitter 7A and the left type slitter 7B, a situation can be avoided that the operator gets hurt by the upper rotary blade 71.

(3) The sheet guide 731 of the scrap exclusion member 73 can be switched between the exclusion mode and the retreat mode. Thus, the right type slitter 7A and the left type slitter 7B can be used not only at a cutting processing position where exclusion of the sheet piece is necessary but also at a cutting processing position where exclusion of the sheet piece is unnecessary.

[Second Embodiment]

The slitter of the present embodiment is different from the first embodiment only in a point that the scrap exclusion member can be displaced between three modes.

Figure 21:
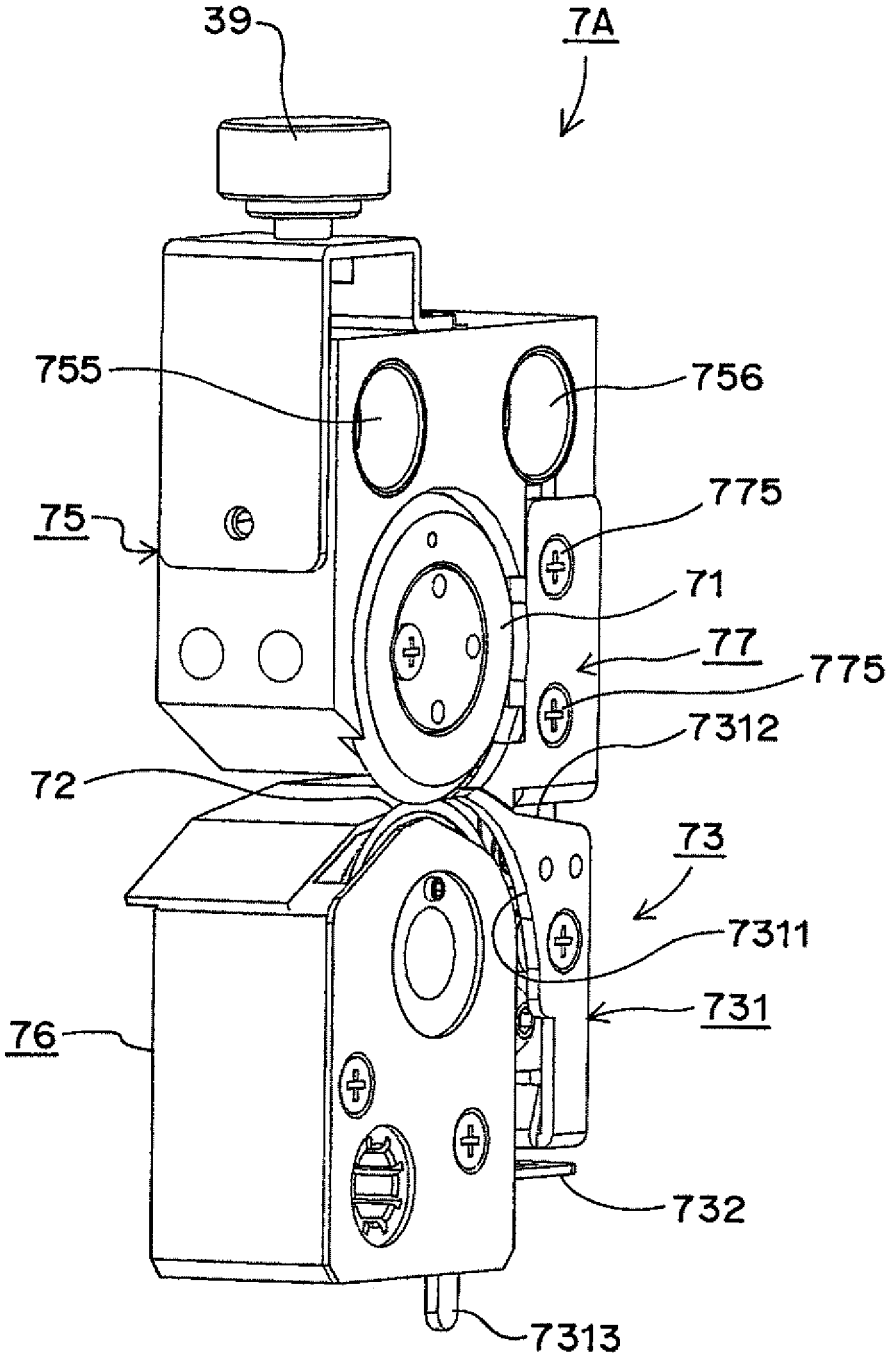
FIG. 21 is a perspective view of a right type slitter of a second embodiment viewed from slightly above in the upstream.
Figure 22:
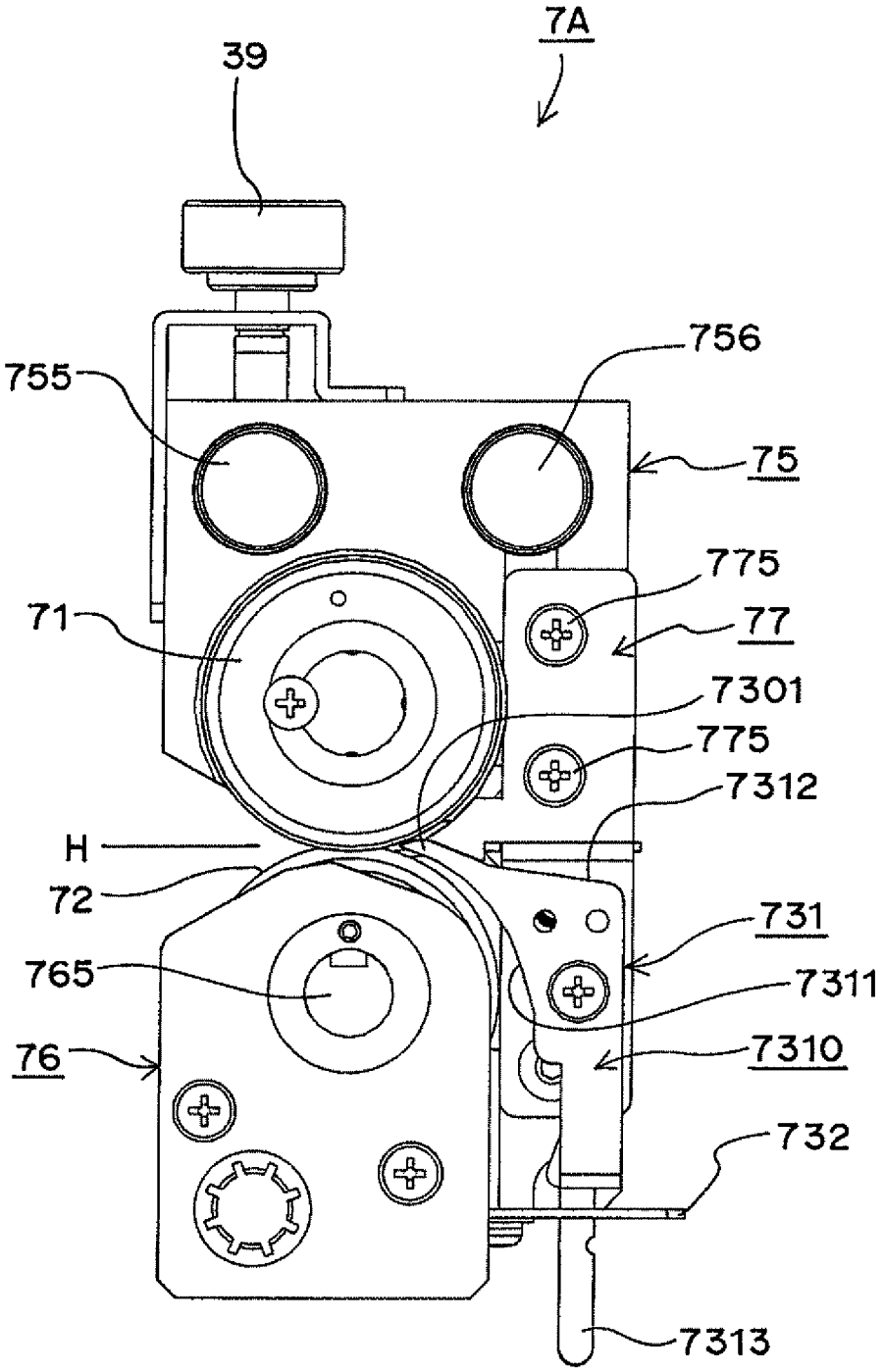
FIG. 22 is a right side perspective view of a right type slitter of FIG. 21.
Figure 23:
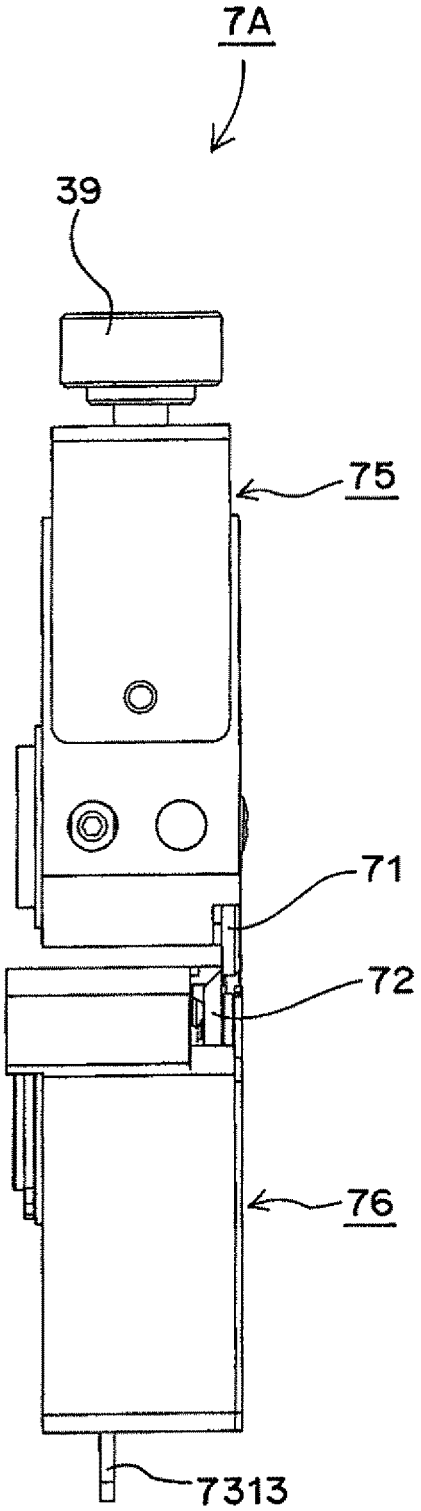
FIG. 23 is a front view of a right type slitter of FIG. 21 viewed from the upstream.
Figure 24:
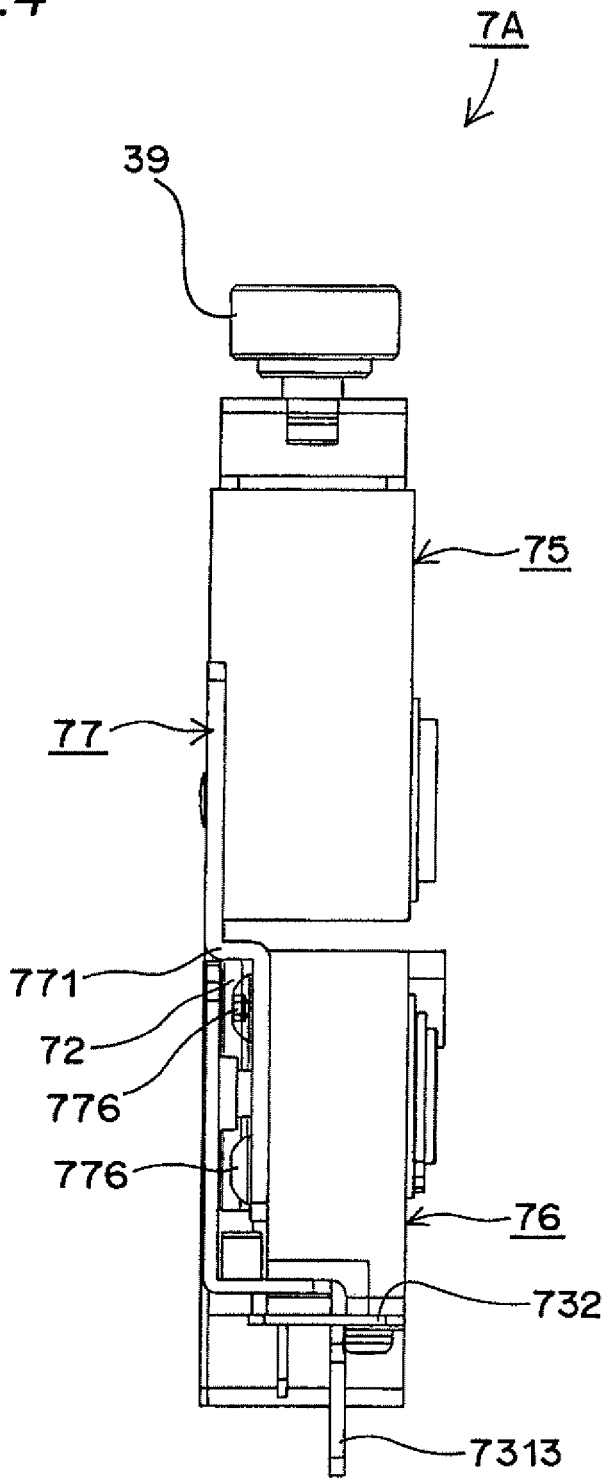
FIG. 24 is a rear view of a right type slitter of FIG. 21.
Figure 25:
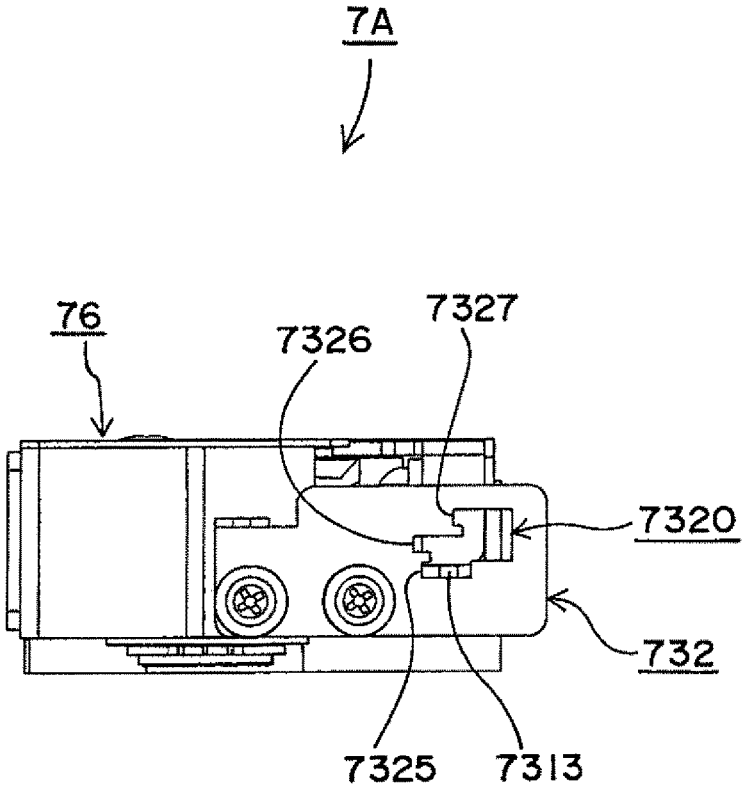
FIG. 25 is a bottom view of a right type slitter of FIG. 21.
Figure 26:
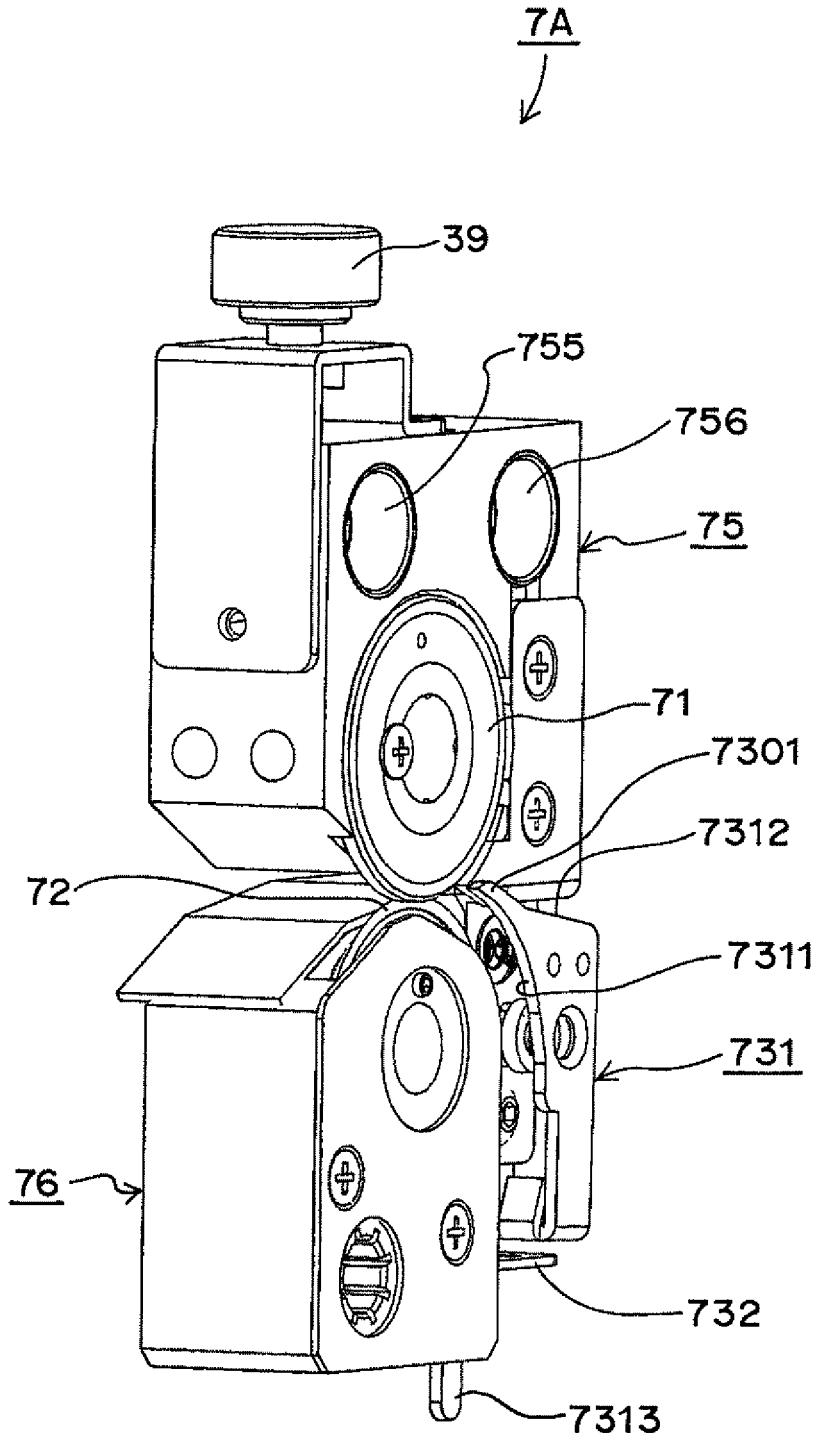
FIG. 26 is a perspective view of a right type slitter whose scrap exclusion member is in a second exclusion mode, viewed from slightly above in the upstream.

FIG. 21 is a perspective view of a right type slitter 7A of the present embodiment viewed from slightly above in the upstream. The right type slitter 7A is shown here. However, a left type slitter 7B is completely the same apart from a point that it is right-left symmetric to the right type slitter 7A. FIGS. 22 to 25 are four-view drawings of the right type slitter 7A. FIG. 22 is a right side perspective view, FIG. 23 is a front view viewed from the upstream, FIG. 24 is a rear view, and FIG. 25 is a bottom view. In the right type slitter 7A of the present embodiment, the sheet guide 731 can be displaced between a first exclusion mode shown in FIGS. 21 and 22, a second exclusion mode shown in FIGS. 26 and 27, and a retreat mode shown in FIGS. 28 and 29.

Figure 30:
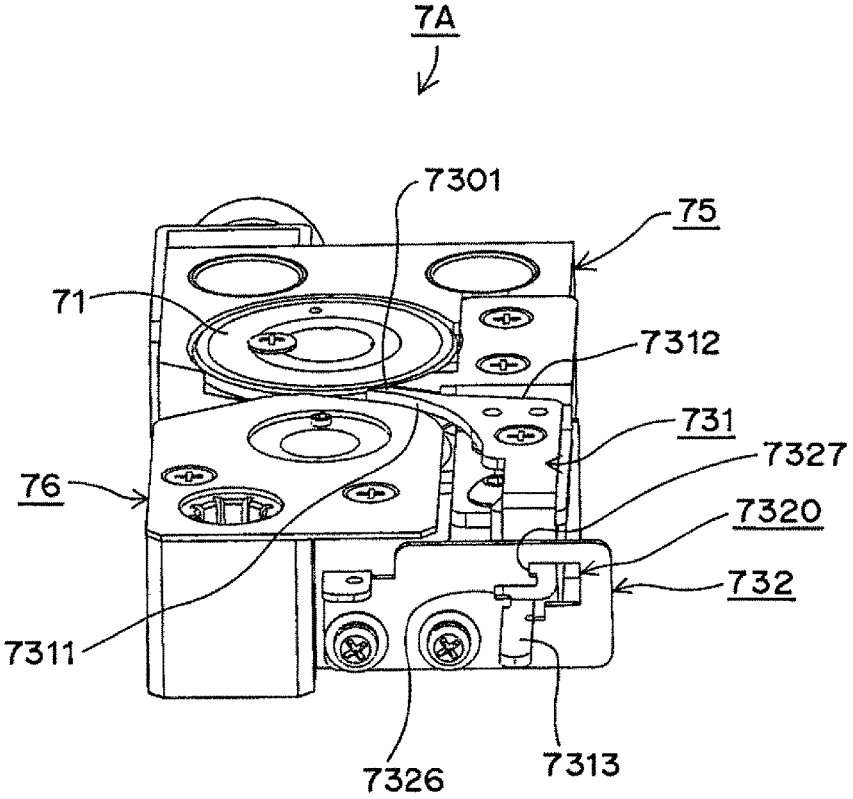
FIG. 30 is a perspective view of a right type slitter whose scrap exclusion member is in a first exclusion mode, viewed from below.
Figure 31:
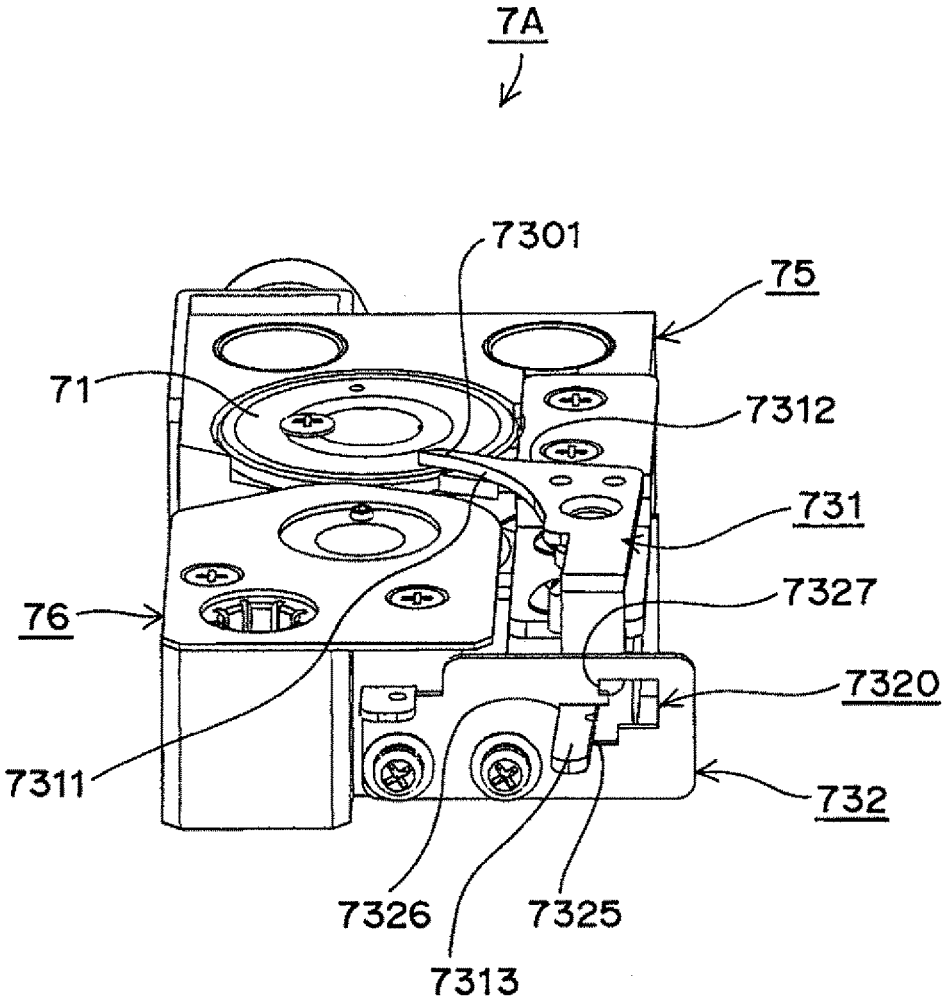
FIG. 31 is a perspective view of a right type slitter whose scrap exclusion member is in a second exclusion mode, viewed from below.
Figure 32:
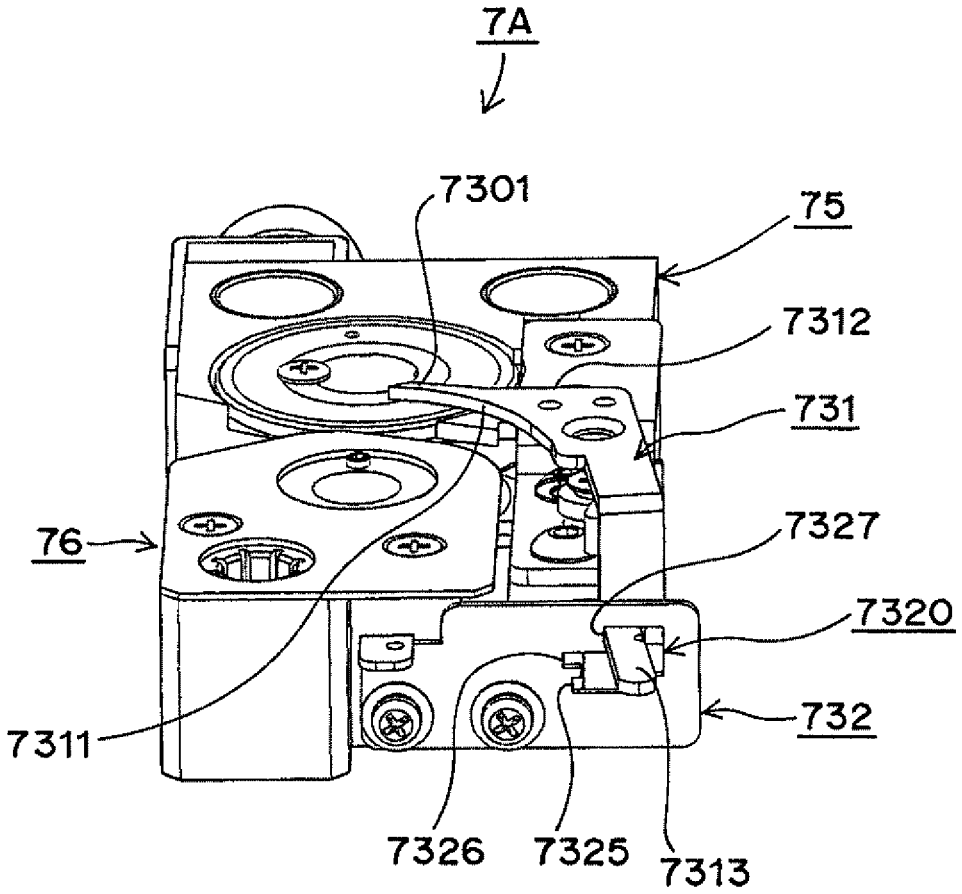
FIG. 32 is a perspective view of a right type slitter whose scrap exclusion member is in a retreat mode, viewed from below.

In the right type slitter 7A, as shown in FIG. 25, the hole 7320 of the operating plate 732 includes a first groove 7325, a second groove 7326, and a third groove 7327 for fixing the lever part 7313. Then, when the lever part 7313 has been fixed to the first groove 7325 as shown in FIG. 30, the sheet guide 731 goes into the first exclusion mode. Further, when the lever part 7313 has been fixed to the second groove 7326 as shown in FIG. 31, the sheet guide 731 goes into the second exclusion mode. Furthermore, when the lever part 7313 has been fixed to the third groove 7327 as shown in FIG. 32, the sheet guide 731 goes into the retreat mode. Here, the lever part 7313 is biased toward the first groove 7325, the second groove 7326, and the third groove 7327 by a spring (not shown).

Figure 27:
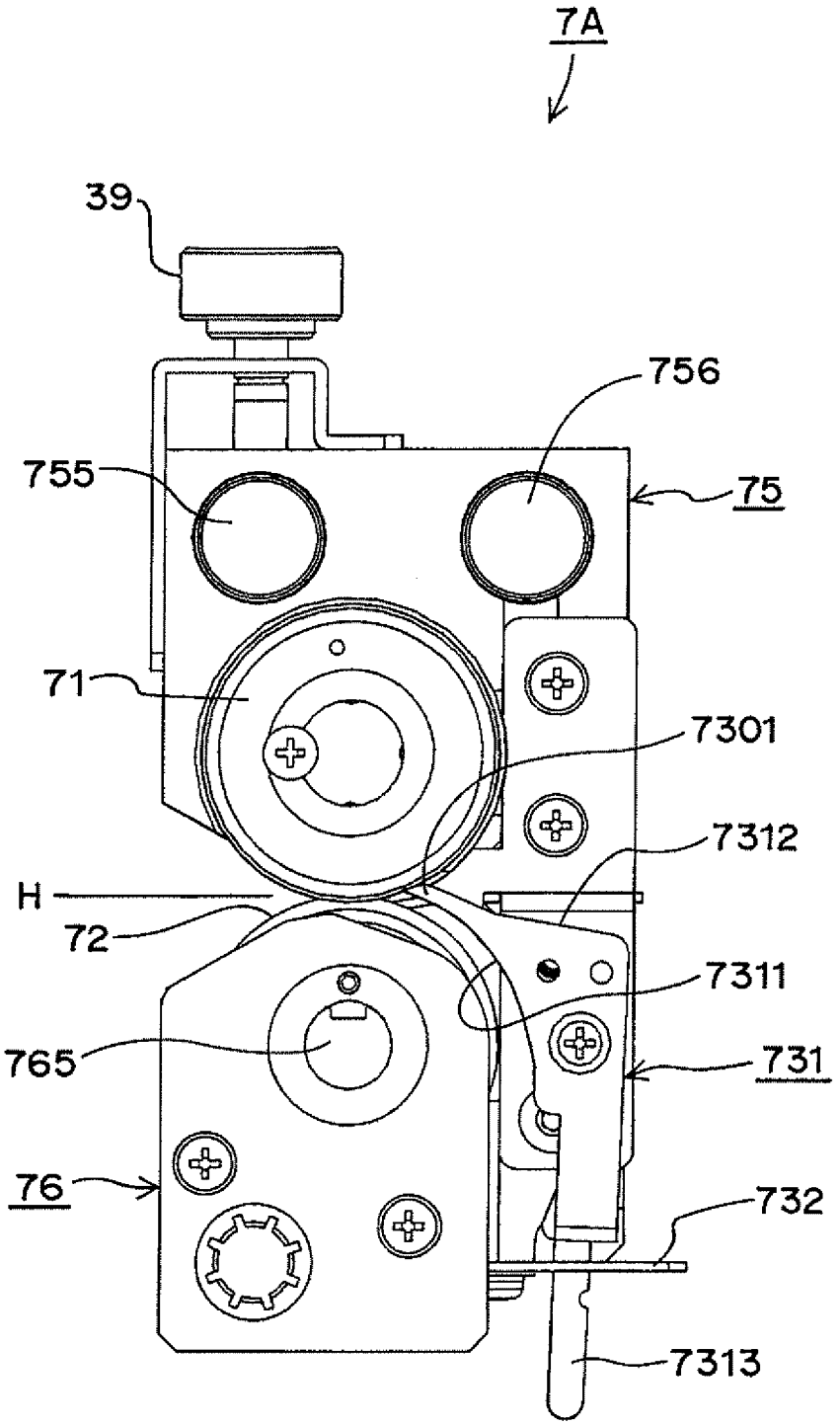
FIG. 27 is a right side view of a right type slitter whose scrap exclusion member is in a second exclusion mode.
Figure 28:
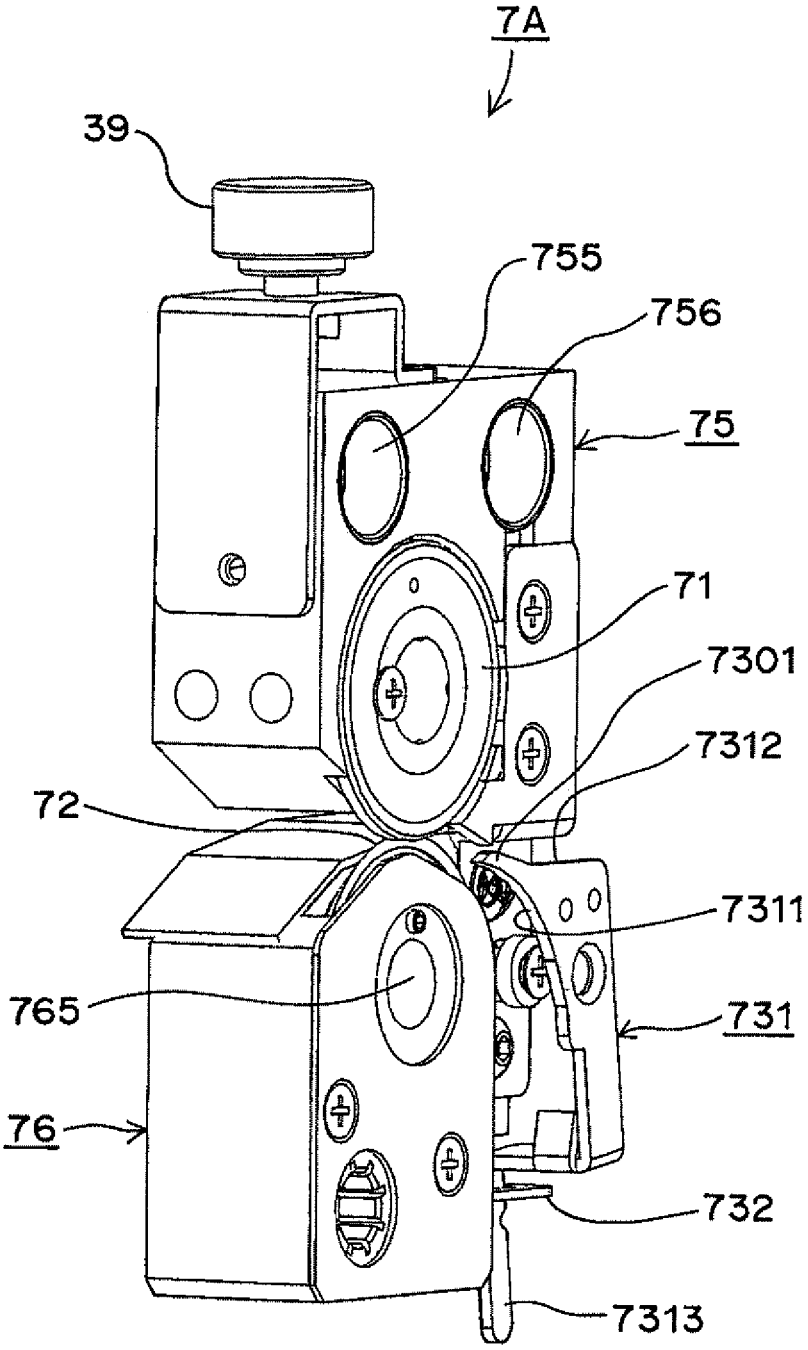
FIG. 28 is a perspective view of a right type slitter whose scrap exclusion member is in a retreat mode, viewed from slightly above in the upstream.
Figure 29:
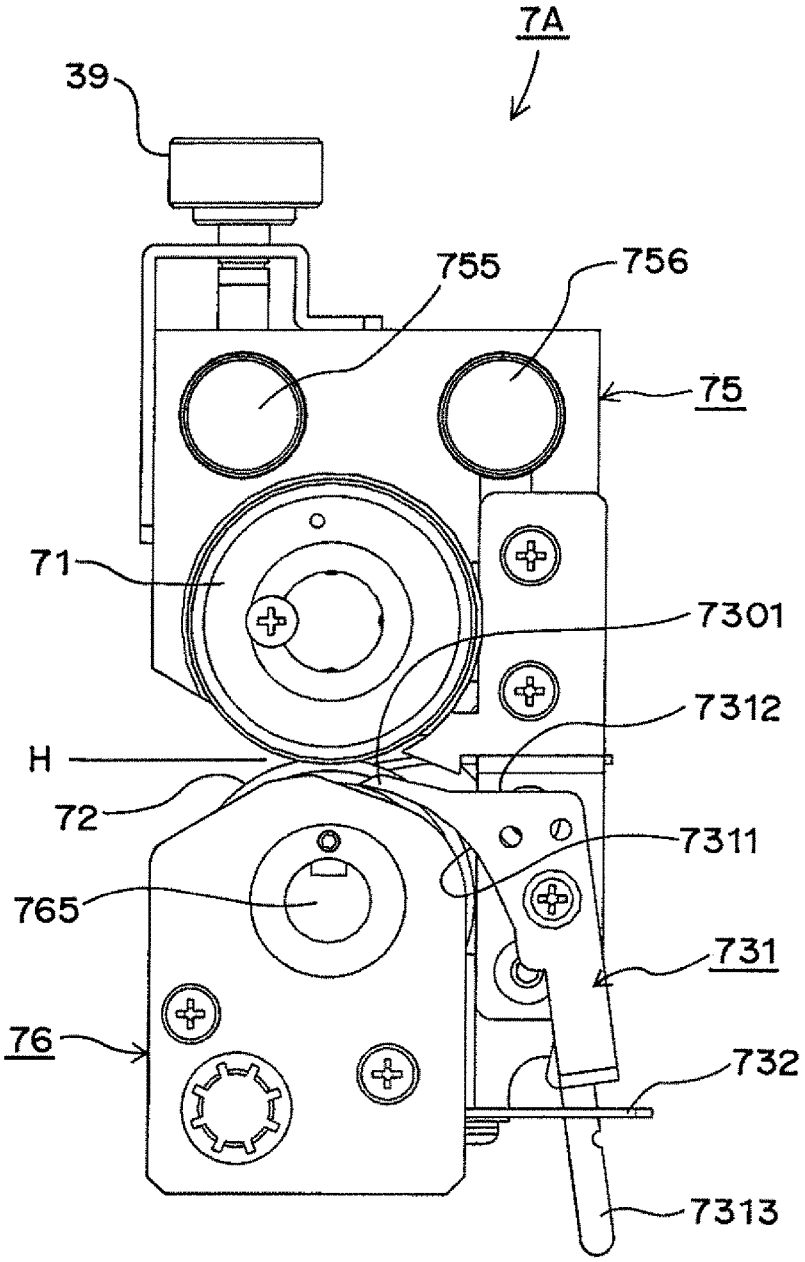
FIG. 29 is a right side view of a right type slitter whose scrap exclusion member is in a retreat mode.

In the first exclusion mode, as shown in FIG. 22, the upper end 7301 of the curved surface part 7311 is located slightly above a cutting position H. Thus, the sheet piece generated by cutting is guided downward along the curved surface part 7311, that is, guided in the exclusion direction, and then excluded to the trash box 110. Also in the second exclusion mode, as shown in FIG. 27, the upper end 7301 of the curved surface part 7311 is located slightly above the cutting position H. Thus, the sheet piece generated by cutting is guided downward along the curved surface part 7311, that is, guided in the exclusion direction, and then excluded to the trash box 110. Here, in the first exclusion mode, the sheet guide 731 is located within the width directional range of the upper rotary blade 71 (that is, between the cutting surface 711 and the non-cutting surface 712). In contrast, in the second exclusion mode, the sheet guide 731 is located on a slightly right side relative to the upper rotary blade 71 in the width direction. Thus, according to the first exclusion mode, a sheet piece having a small width dimension can reliably be excluded. Further, according to the second exclusion mode, a sheet piece having a large dimension can smoothly be excluded. In the retreat mode, as shown in FIG. 29, the upper end 7301 of the curved surface part 7311 is located slightly below the cutting position H. Thus, the sheet piece generated by cutting is guided to the downstream of the conveyance direction (that is, in a non-exclusion direction) along the upper surface part 7312. Here, in the retreat mode, the sheet guide 731 is located on a more right side in the width direction than in the case of the second exclusion mode.

The other points in the configuration of the right type slitter 7A of the present embodiment are the same as the right type slitter 7A of the first embodiment.

[Third Embodiment]

The slitter of the present embodiment is different from the slitter of the first or the second embodiment only in a point that a scrap exclusion assisting member is further provided.

Figure 33:
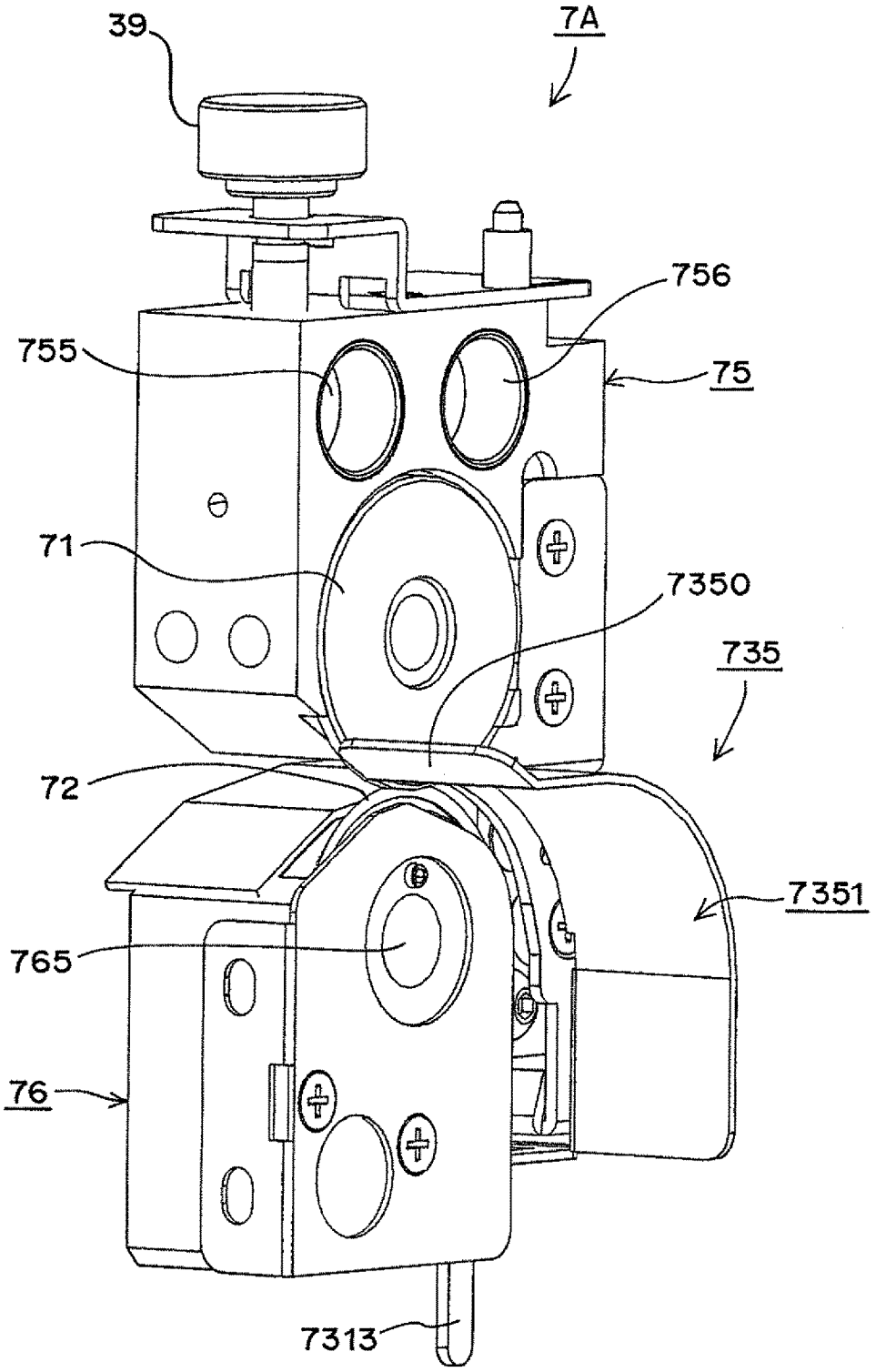
FIG. 33 is a perspective view of a right type slitter of a third embodiment viewed from slightly above in the upstream.
Figure 34:
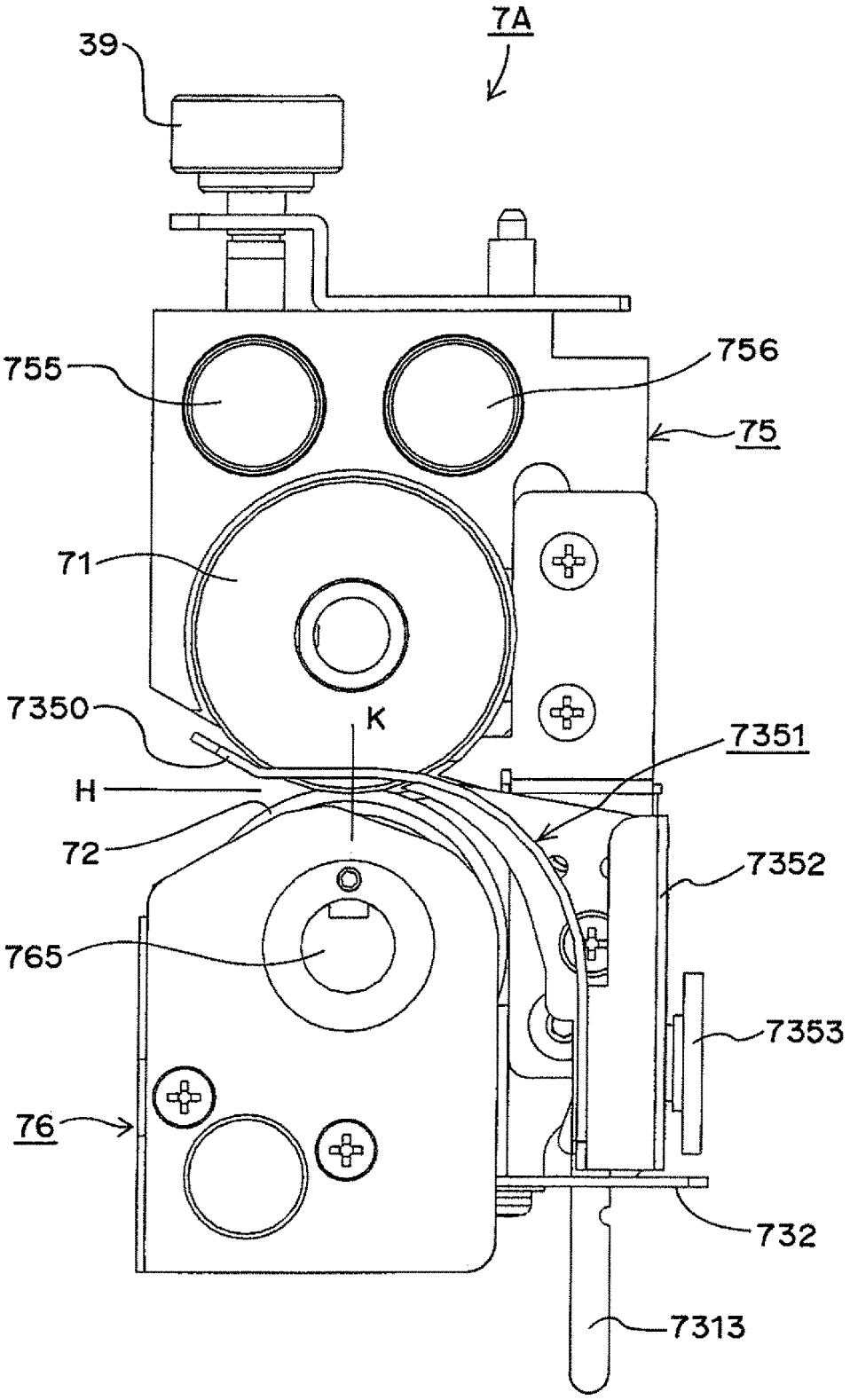
FIG. 34 is a right side view of a right type slitter of FIG. 33.
Figure 35:
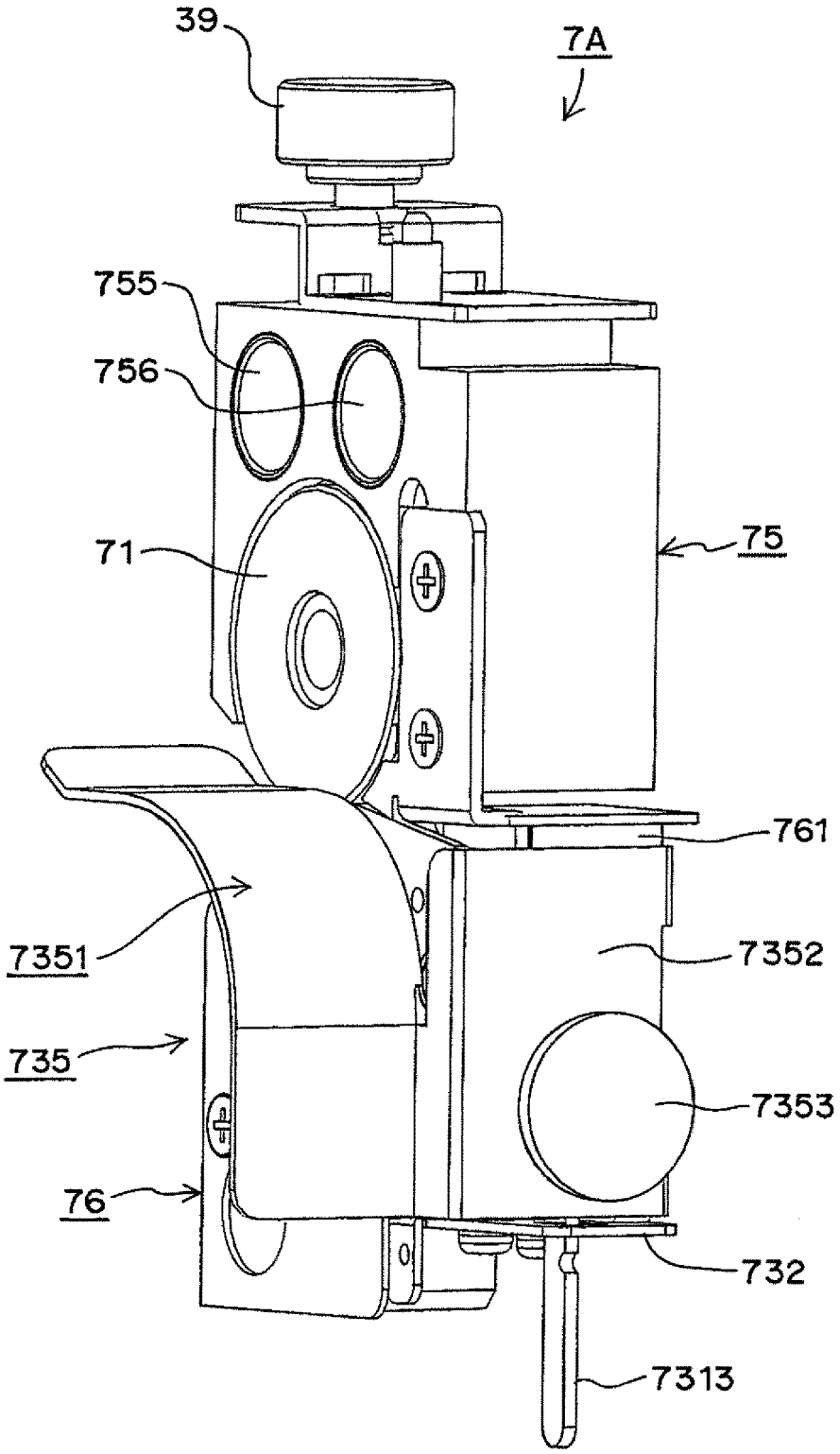
FIG. 35 is a perspective view of a right type slitter of FIG. 33 viewed from slightly above in the downstream.

FIG. 33 is a perspective view of a right type slitter 7A of the present embodiment viewed from slightly above in the upstream. The right type slitter 7A is shown here. However, a left type slitter 7B is completely the same apart from a point that it is right-left symmetric to the right type slitter 7A. FIG. 34 is a right side view of the right type slitter 7A. FIG. 35 is a perspective view of the right type slitter 7A viewed from slightly above in the downstream of the convenience direction. A scrap exclusion assisting member 735 includes a curved plate part 7351 and an attaching plate part 7352. The curved plate part 7351 is located on a right side in the width direction relative to the scrap exclusion member 73. As shown in FIG. 34, the curved plate part 7351 has a tip part 7350 provided in the upstream of a cutting position K and above the cutting position H. Then, from the position of the tip part 7350, the curved plate part 7351 extends to the downstream in the conveyance direction relative to the cutting position K in a state that the position higher than the cutting position H is maintained. Further, the curved plate part 7351 extends downward in a curved manner. The scrap exclusion assisting member 735 is attached to the right type slitter 7A in such a manner that the attaching plate part 7352 is fixed with a screw 7353 to a side surface 761 on the downstream side of the lower housing 76 of the right type slitter 7A. The screw 7353 can be released and hence the scrap exclusion assisting member 735 can freely be attached to and detached from the right type slitter 7A.

According to the right type slitter 7A having the above-mentioned configuration, a large sheet piece generated on the right side in the width direction by cutting can reliably be excluded downward as a scrap.

[Fourth Embodiment]

The slitter of the present embodiment is different from the slitter of the first to the third embodiment only in a point that the displacement of the sheet guide of the scrap exclusion member is performed not stepwise but linearly.

Figure 36:
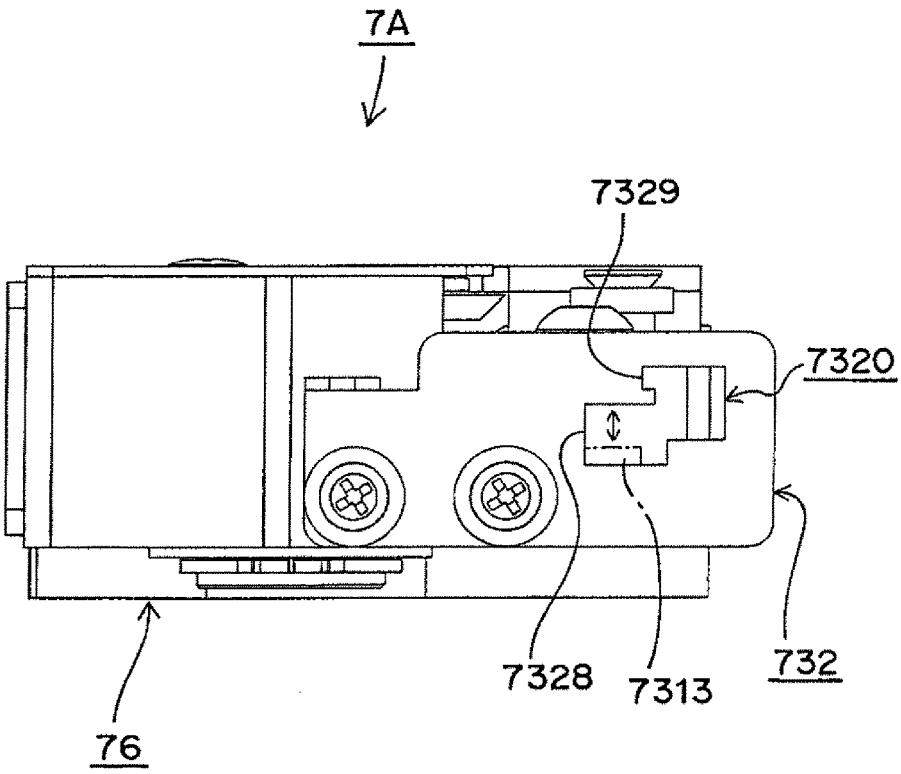
FIG. 36 is a bottom view of a right type slitter of a fourth embodiment.

FIG. 36 is a bottom view of a right type slitter 7A of the present embodiment. The right type slitter 7A is shown here. However, a left type slitter 7B is completely the same apart from a point that it is right-left symmetric to the right type slitter 7A. In the present embodiment, the hole 7320 of the operating plate 732 includes a first groove 7328 and a second groove 7329. When the lever part 7313 has been fixed to the first groove 7328, the sheet guide 731 goes into the exclusion mode. In contrast, when the lever part 7313 has been fixed to the second groove 7329, the sheet guide 731 goes into the retreat mode. Here, the lever part 7313 is biased toward the first groove 7328 and the second groove 7329 by a spring (not shown).

Then, in the present embodiment, the first groove 7328 is widened. Then, the lever part 7313 can be slid in the width direction within the first groove 7328 and can be fixed at an arbitrary position in the width direction within the first groove 7328. Thus, in the sheet guide 731, when the lever part 7313 is moved in the width direction within the first groove 7328, a linearly displaced exclusion mode can be achieved.

According to the right type slitter 7A of the present embodiment, the exclusion mode of the sheet guide 731 can be set at an arbitrary position between a position within the width directional range of the upper rotary blade 71 (that is, between the cutting surface 711 and the non-cutting surface 712) and a predetermined position on the right side in the width direction. Thus, not only a narrow sheet piece but also a somewhat wide sheet piece can smoothly be excluded as the scrap.

[Other Embodiments]

The following modified configurations may be employed.

(1) The cantilevered supporting of the rotary blade in the slitter may be employed only in the upper rotary blade 71 or the lower rotary blade 72. That is, the upper rotary blade 71 may be cantilevered by a cantilevered supporting part and the lower rotary blade 72 may be supported at both ends by an at-both-ends supporting part. Alternatively, the lower rotary blade 72 may be cantilevered by a cantilevered supporting part and the upper rotary blade 71 may be supported at both ends by an at-both-ends supporting part.

Further, in this case, it is preferable that the at-both-ends supporting part includes an inclination adjustment part for adjusting the inclination of the shaft center of the revolving shaft for supporting the rotary blade. For example, in the right type slitter 7A shown in FIG. 37, similarly to the first embodiment, the upper rotary blade 71 is cantilevered by the cantilevered supporting part 78. Then, the lower rotary blade 72 is located near the right end of the lower housing 76 and supported at both ends by an at-both-ends supporting part 80. The upper rotary blade 71 is driven and revolved and then the lower rotary blade 72 follows the revolution of the upper rotary blade 71. Then, the at-both-ends supporting part 80 includes an inclination adjustment part for adjusting the inclination of the shaft center 7421 of the revolving shaft 742 for supporting the lower rotary blade 72.

Specifically, the lower rotary blade 72 is supported on the revolving shaft 742 through two bearings 811 and 812 arranged with an interval in between. In the revolving shaft 742, a right end 7422 is held on a fixed plate 802 through a shaft bush 801 and a left end 7423 is held on a movable plate 803. The fixed plate 802 is constructed integrally with the right side surface of the lower housing 76 and the movable plate 803 is attached to the left side surface of the lower housing 76. By virtue of this, the lower rotary blade 72 is supported at both ends in the lower housing 76. Then, when the movable plate 803 is moved, the inclination of the shaft center 7421 of the revolving shaft 742 can be adjusted. That is, the movable plate 803 constitutes the inclination adjustment part.

Figure 37:
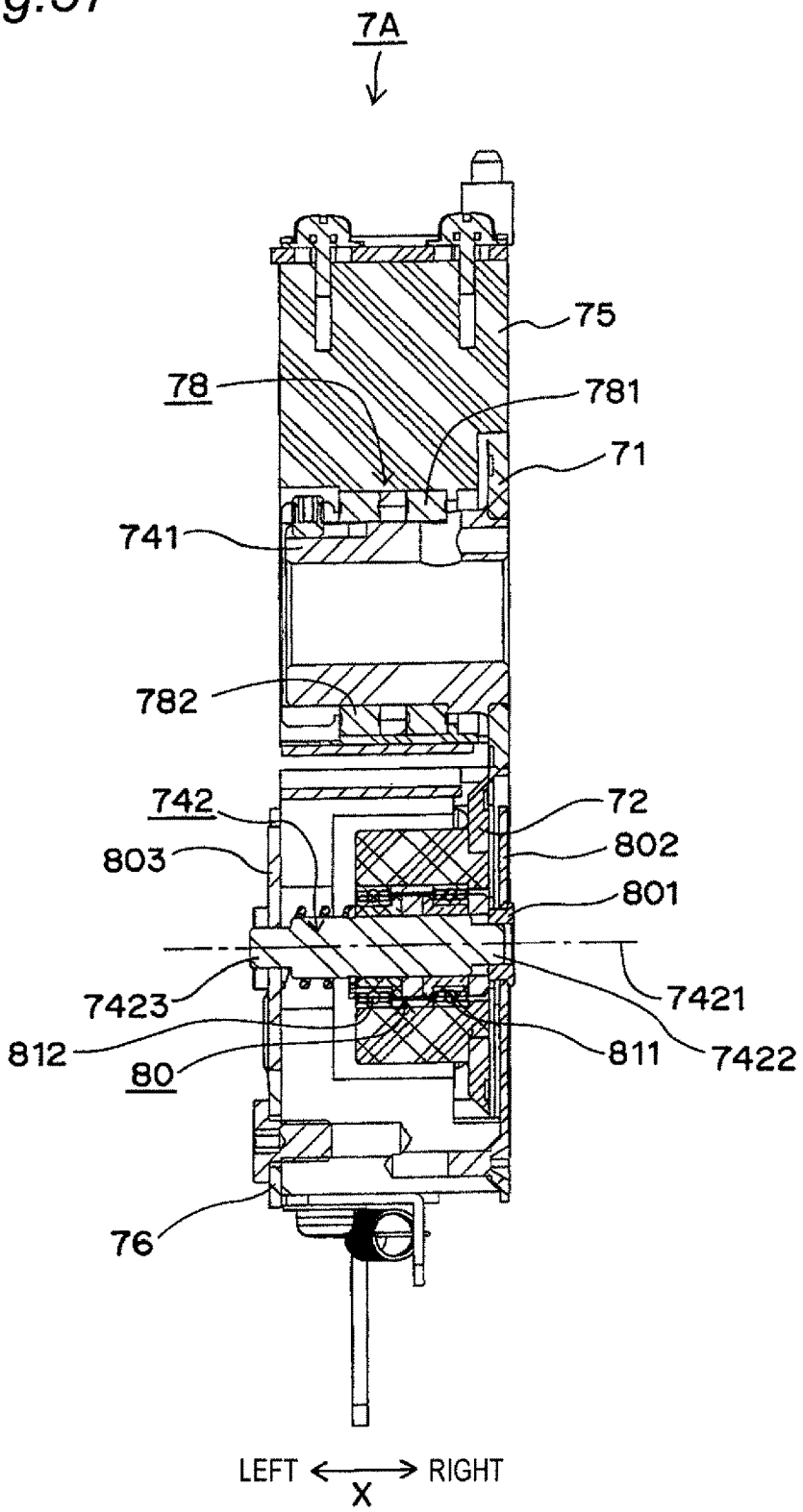
FIG. 37 is a sectional view of a right type slitter of another embodiment.
Figure 38:
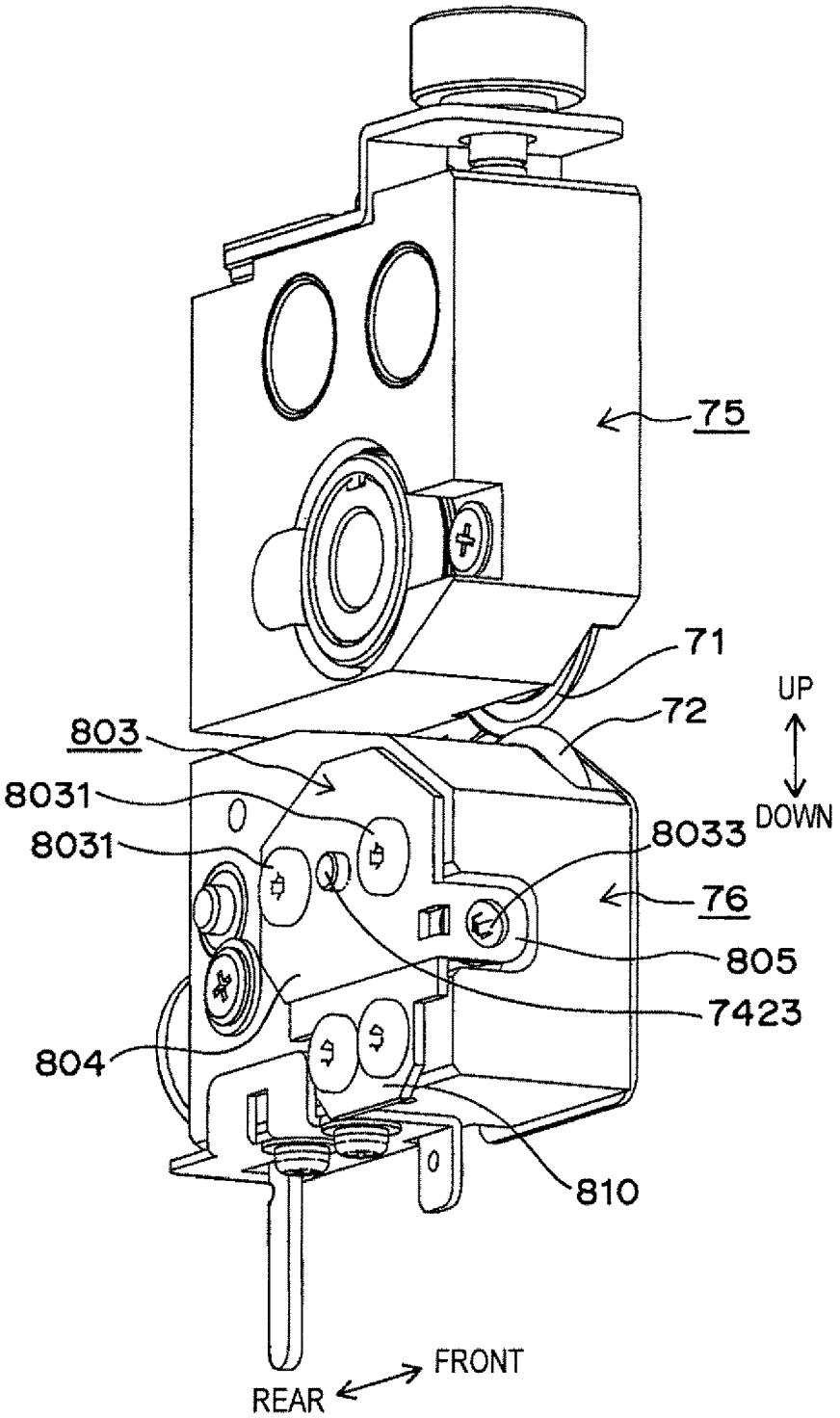
FIG. 38 is a perspective view of a right type slitter of FIG. 37.
Figure 39:
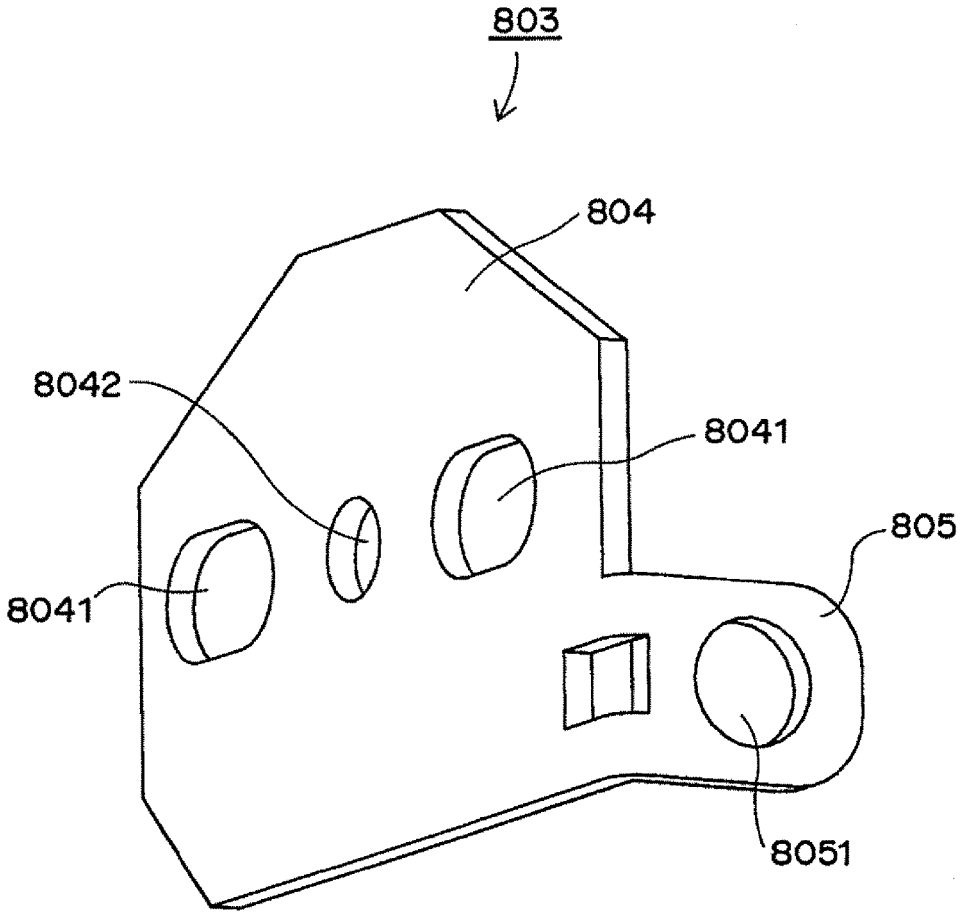
FIG. 39 is a perspective view of a movable plate of a right type slitter of FIG. 37.

FIG. 38 is a perspective view of the right type slitter 7A of FIG. 37. FIG. 39 is a perspective view of the movable plate 803. The movable plate 803 is constructed from a body 804 provided along the left side surface of the lower housing 76 and a protruding plate 805 provided in parallel to the front surface of the lower housing 76. The movable plate 803 is fixed to the lower housing 76 with two screws 8031. Each screw 8031 is inserted into the attaching hole 8041 of the body 804. Here, the attaching hole 8041 has a larger diameter in the frontward, rearward, upward, and downward directions than the rod (the shaft part) of the screw 8031. The left end 7423 of the revolving shaft 742 is fit into an attaching hole 8042 of the body 804.

Figure 40:
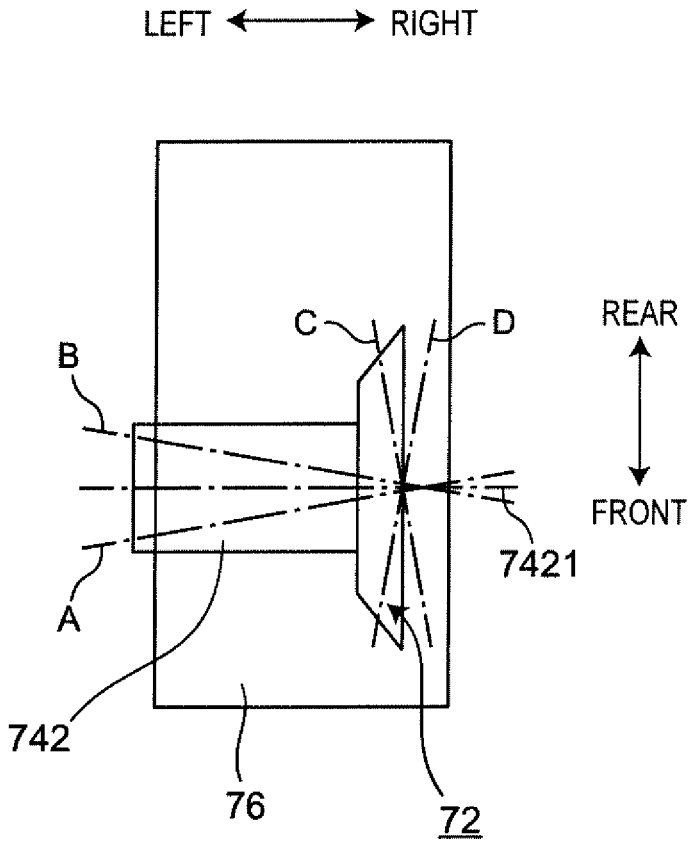
FIG. 40 is a schematic plan view of a lower housing of a right type slitter of FIG. 37.
Figure 41:
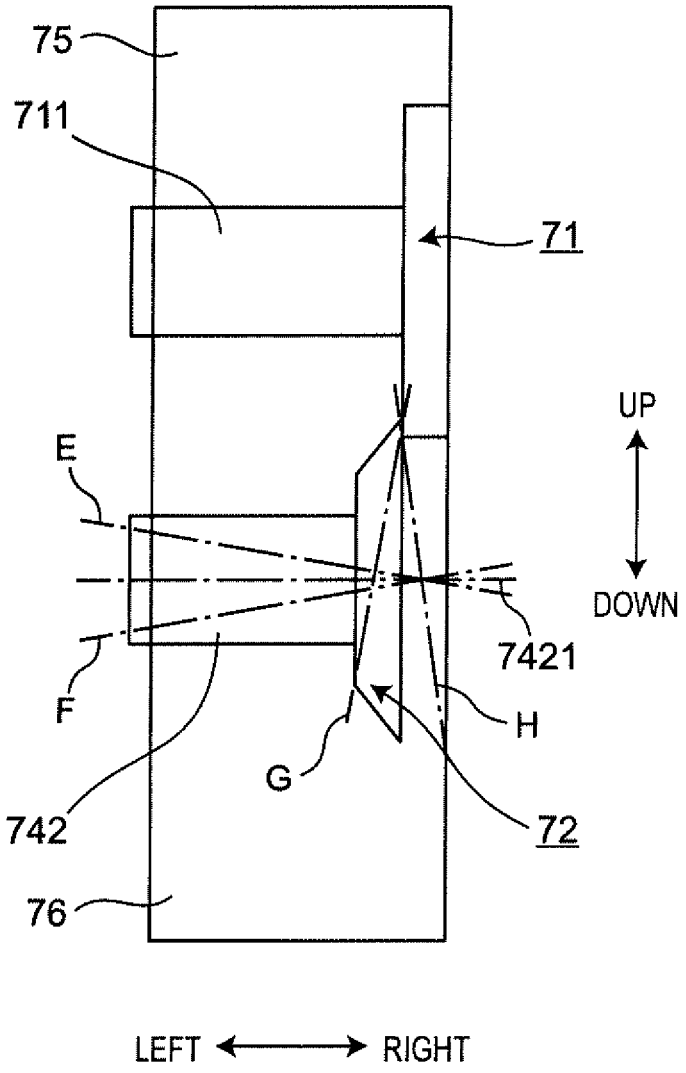
FIG. 41 is a schematic view of a right type slitter of FIG. 37 viewed from the upstream.

Then, inclination adjustment performed by moving the movable plate 803 is achieved as follows. Here, FIG. 40 is a schematic view of the lower housing 76 of the right type slitter 7A viewed from above. FIG. 41 is a schematic view of the right type slitter 7A viewed from the front side.

(i) When the screw 8031 is loosened and then the movable plate 803 is moved frontward and, after that, the screw 8031 is tightened so that the movable plate 803 is fixed, as shown in FIG. 40, the shaft center 7421 of the revolving shaft 742 is inclined as indicated by a dash-dotted line A and the lower rotary blade 72 is inclined as indicated by a dash-dotted line C. Alternatively, when the screw 8031 is loosened and then the movable plate 803 is moved rearward and, after that, the screw 8031 is tightened so that the movable plate 803 is fixed, as shown in FIG. 40, the shaft center 7421 of the revolving shaft 742 is inclined as indicated by a dash-dotted line B and the lower rotary blade 72 is inclined as indicated by a dash-dotted line D.

Here, when the movable plate 803 is to be moved in the frontward and rearward directions, since the movable plate 803 can be moved along a horizontal plate 810 whose upper end is horizontal, the movable plate 803 can stably be moved. Further, a screw screwed into the lower housing 76 is provided on the rear side of a hole 8051 of the protruding plate 805. Then, a head 8033 of the screw may be set at a desired movement position in the frontward and rearward directions and then the movable plate 803 may be moved such that the protruding plate 805 constitutes the same plane as the head 8033. By virtue of this, the movable plate 803 can accurately be moved.

(ii) When the screw 8031 is loosened and then the movable plate 803 is moved upward and, after that, the screw 8031 is tightened so that the movable plate 803 is fixed, as shown in FIG. 41, the shaft center 7421 of the revolving shaft 742 is inclined as indicated by a dash-dotted line E and the lower rotary blade 72 is inclined as indicated by a dash-dotted line G. Alternatively, when the screw 8031 is loosened and then the movable plate 803 is moved downward and, after that, the screw 8031 is tightened so that the movable plate 803 is fixed, as shown in FIG. 41, the shaft center 7421 of the revolving shaft 742 is inclined as indicated by a dash-dotted line F and the lower rotary blade 72 is inclined as indicated by a dash-dotted line H.

Here, the description given above has been made for the right type slitter 7A. However, the left type slitter 7B is completely the same apart from a point that it is right-left symmetric to the right type slitter 7A.

As described above, when the movable plate 803 is moved in the frontward, rearward, upward, and downward directions, the inclination of the lower rotary blade 72 can be changed variously so that the following effects can be obtained.

(a) The strength of abutment of the lower rotary blade 72 against the upper rotary blade 71 can be adjusted. Thus, a state of the rotary blades that permits satisfactory sheet cutting can be achieved.

(b) When the inclination of the lower rotary blade 72 in the frontward and rearward directions is adjusted as described above in (i), the durability of both rotary blades can be improved. In particular, when the adjustment is performed such that both rotary blades become in parallel to each other, the durability of both rotary blades can be improved further.

Figure 42:
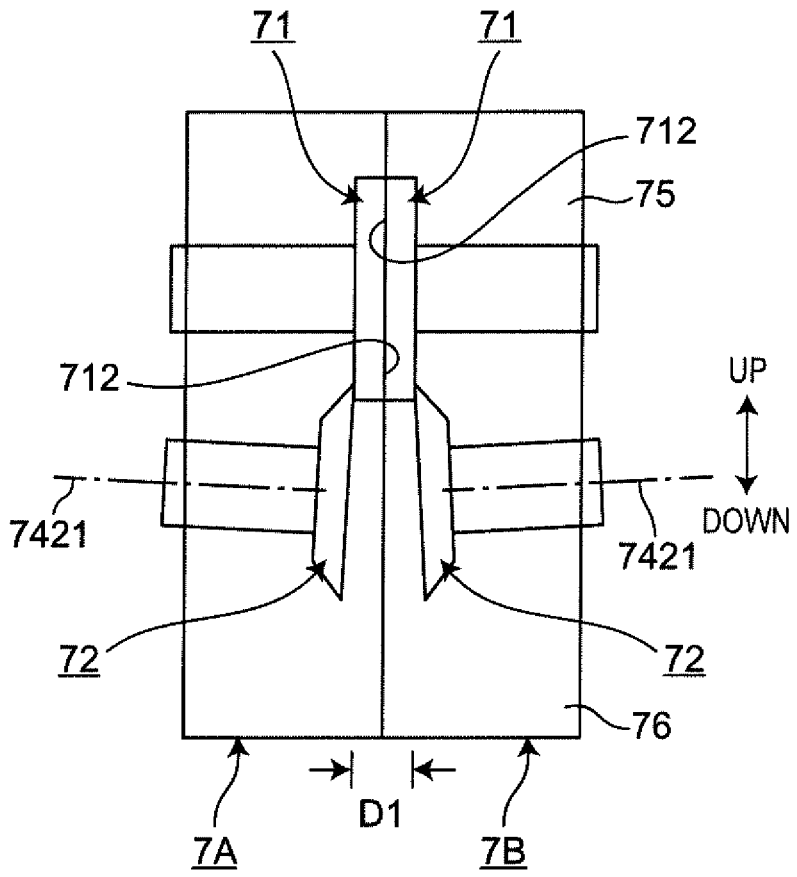
FIG. 42 is a schematic view showing an example of combination in which a right type slitter of FIG. 37 and a left type slitter having the same configuration are in close contact with each other.

(c) When the shaft center 7421 of the lower rotary blade 72 is inclined upward (as indicated by the dash-dotted line E) as described above in (ii), a slitter having an improved scrap exclusion property can be realized. That is, as shown in FIG. 42, when the right type slitter 7A and the left type slitter 7B in each of which the shaft center 7421 of the lower rotary blade 72 is inclined as indicated by the dash-dotted line E are arranged in close contact with each other such that the non-cutting surfaces 712 of the upper rotary blades 71 face to each other, since the lower rotary blades 72 of both slitters 7A and 7B are inclined such as to spread downward, the scrap generated between both slitters 7A and 7B is smoothly discharged downward.

(d) In the housings 75 and 76, inclination adjustment is performed on the lower rotary blade 72 located on the inner side in the width direction relative to the upper rotary blade 71. Thus, as shown in FIG. 42, when the right type slitter 7A and the left type slitter 7B are arranged in close contact with each other such that the non-cutting surfaces 712 of the upper rotary blades 71 face to each other, the inclined lower rotary blades 72 do not interfere with each other. Thus, a process that a sheet piece whose width dimension is as remarkably small as D1 (FIG. 17) is generated by cutting can be achieved without a problem. Here, in the housing, the "inner side in the width direction" indicates a side closer to the center of the housing and the "outer side in the width direction" indicates a side closer to the side surface of the housing.

Here, in the example of FIG. 37, the lower rotary blade 72 is supported at both ends. Instead, the upper rotary blade 71 may be supported at both ends. However, in this case, in each of the housings 75 and 76, the upper rotary blade 71 is arranged on the inner side in the width direction relative to the lower rotary blade 72. According to this arrangement configuration, when the right type slitter 7A and the left type slitter 7B are arranged in close contact with each other such that the non-cutting surfaces 722 of the lower rotary blades 72 face to each other, similarly to the embodiment given above, a sheet piece having a remarkably small width dimension can be generated by cutting.

Further, the above-mentioned inclination adjustment of the rotary blades is performed at a factory shipment stage such that a predetermined standard condition may be satisfied. Thus, in ordinary cases, subsequent adjustment is unnecessary. Nevertheless, in some cases, the cutting performance is degraded owing to the type of sheet or the wear condition of the rotary blades. In such cases, when necessary, a maintenance personnel or a user may adjust the inclinations of the rotary blades such that a satisfactory cutting performance may be obtained.

(2) The slitter may not necessarily include the scrap exclusion member.

(3) The revolving shaft 741 is not limited to a hollow member and may be a solid member as long as the upper rotary blade 71 can be supported in a freely revolvable manner. Alternatively, a member constructed as a suitable combination of these may be employed. A similar situation holds also for the revolving shaft 742.

Figure 43:
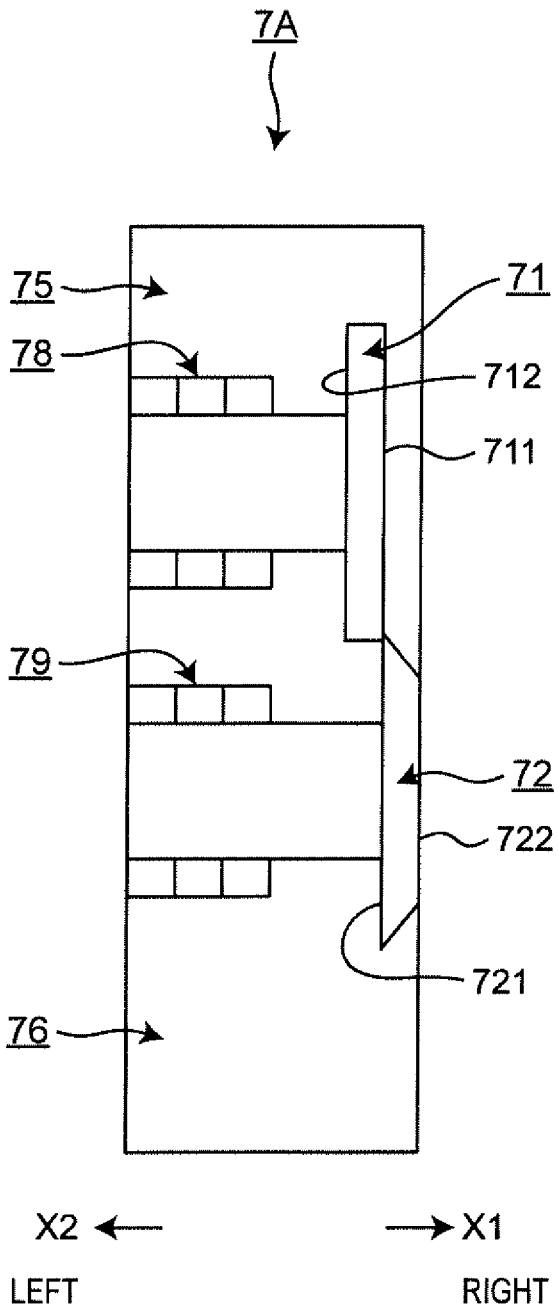
FIG. 43 is a schematic view of a right type slitter of another embodiment.

(4) As shown in FIG. 43, the right-left positional relation of the upper rotary blade 71 and the lower rotary blade 72 may be replaced. That is, in the right type slitter 7A, the upper rotary blade 71 is located near the right end of the upper housing 75 and then cantilevered on the non-cutting surface 712 side of the upper rotary blade 71 by the cantilevered supporting part 78. Further, the lower rotary blade 72 is located at the right end of the lower housing 76 and then cantilevered on the cutting surface 721 side of the lower rotary blade 72 by the cantilevered supporting part 79. The lower rotary blade 72 is located on the right side relative to the upper rotary blade 71. Further, when a scrap exclusion member (not shown) or a scrap exclusion assisting member (not shown) is provided, it may be provided on the cutting surface 711 side of the upper rotary blade 71 (that is, on the right side of the cutting surface 711). Here, the left type slitter 7B has a structure right-left symmetric to the right type slitter 7A.

Figure 44:
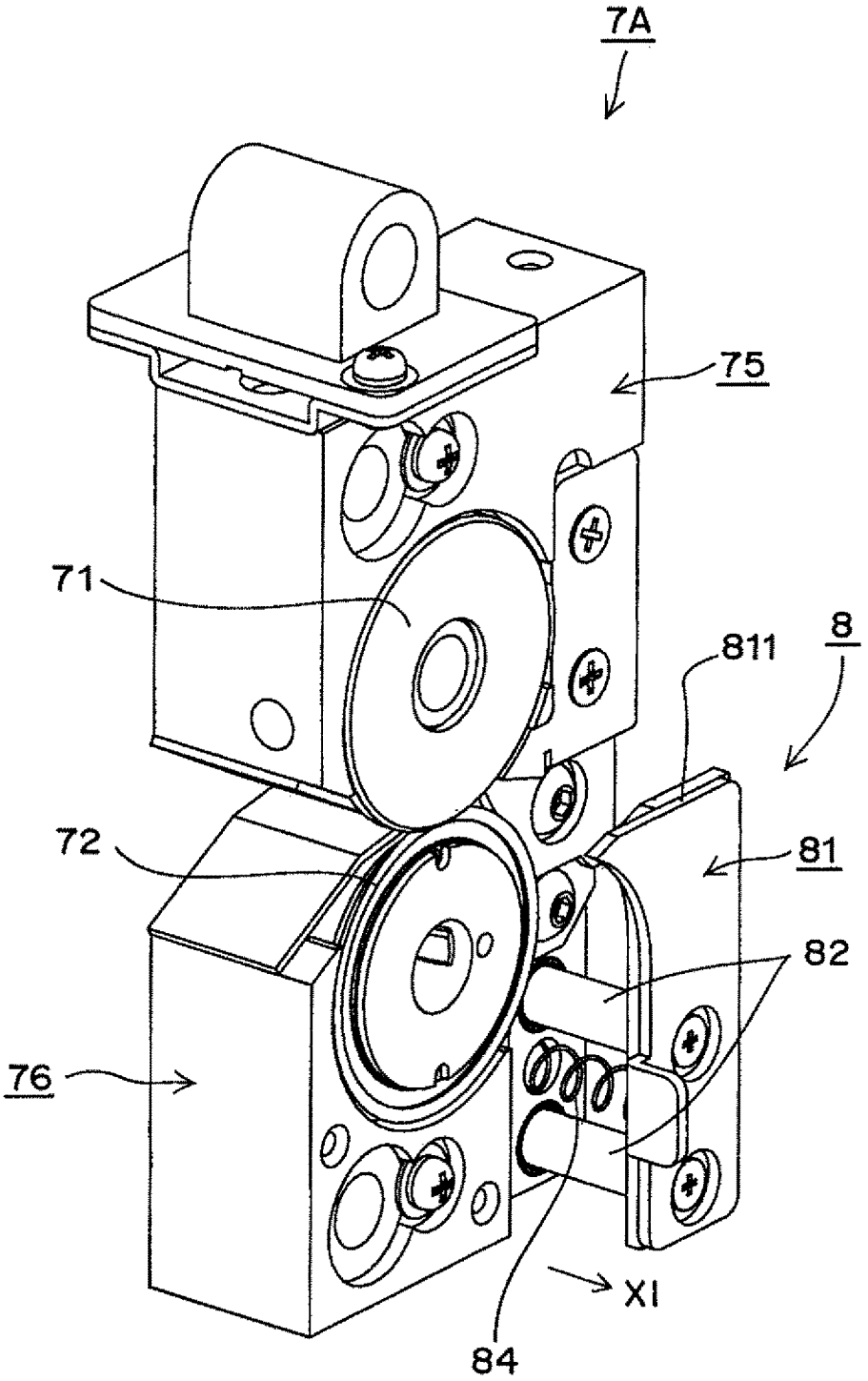
FIG. 44 is a perspective view of a right type slitter including a sheet conveyance assisting member.
Figure 45:
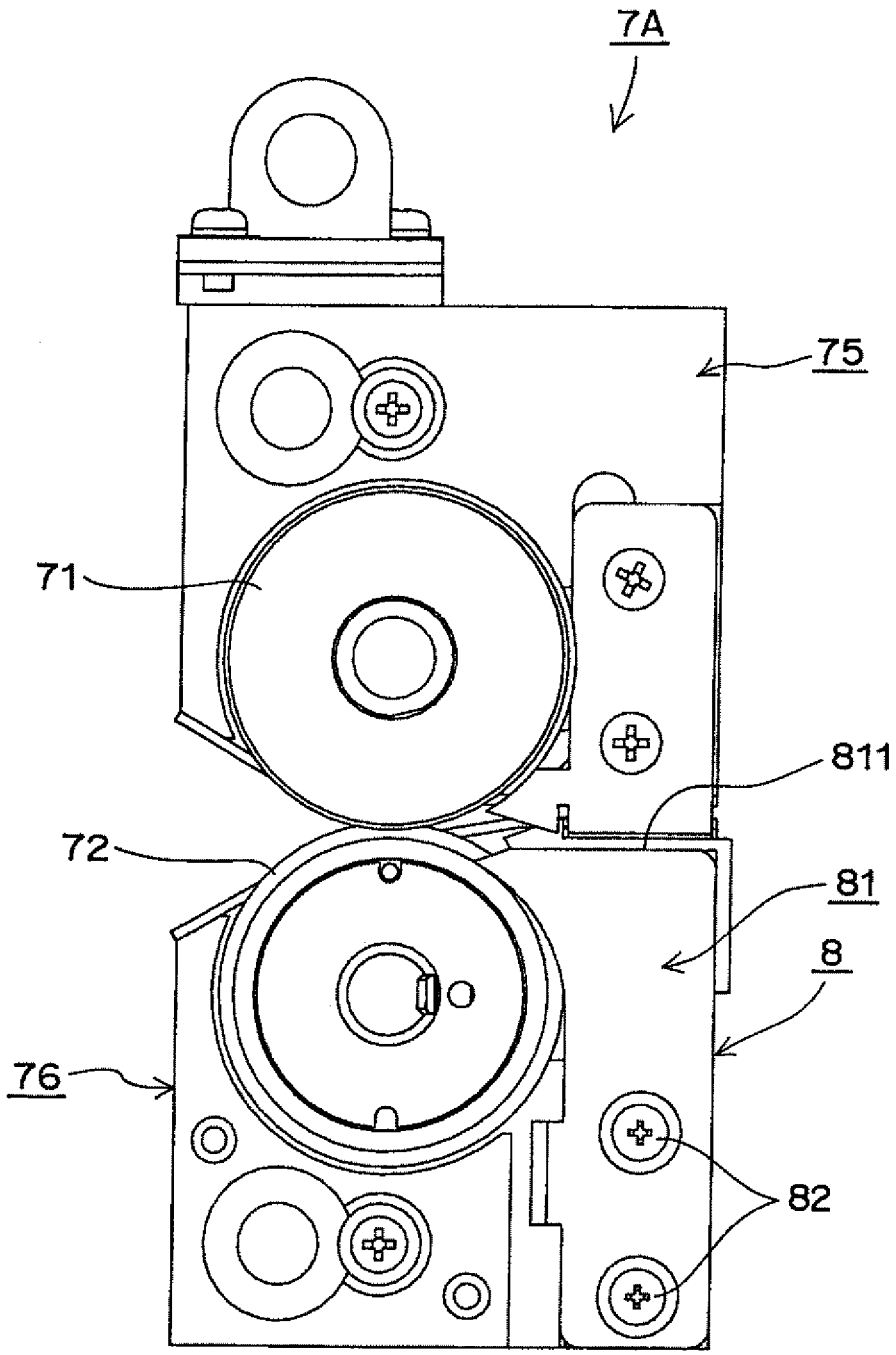
FIG. 45 is a right side view of a right type slitter of FIG. 44.

(5) The slitter may include a sheet conveyance assisting member for assisting the conveyance of the sheet piece generated by cutting to the downstream in the conveyance direction. FIG. 44 is a perspective view of a right type slitter 7A including a sheet conveyance assisting member 8. FIG. 45 is a right side view of the right type slitter 7A of FIG. 44. The right type slitter 7A is shown here. However, the left type slitter 7B also has completely the same basic structure apart from a point that it is right-left symmetric to the right type slitter 7A. The sheet conveyance assisting member 8 includes a conveyance assisting guide 81, two slide pins 82, and a spring 84. In the conveyance assisting guide 81, the upper edge is provided with a guide surface 811 for going into contact with the back face of the sheet piece and then guiding the sheet piece. The two slide pins 82 are provided in a manner of being slidable in the width direction relative to the lower housing 76. The conveyance assisting guide 81 is supported at the right end of the slide pins 82. By virtue of this, in association with the slide of the slide pins 82, the conveyance assisting guide 81 can move between a first conveyance assisting position where contact with the sheet piece occurs within the width directional range of the upper rotary blade 71 (that is, between the cutting surface 711 and the non-cutting surface 712) and a second conveyance assisting position where contact with the sheet piece occurs on the non-cutting surface 712 side relative to the non-cutting surface 712 of the upper rotary blade 71. The spring 84 is provided in the lower housing 76 such as to bias the conveyance assisting guide 81 to the direction X1 extending toward the non-cutting surface 712 side of the upper rotary blade 71.

In the right type slitter 7A having the above-mentioned configuration, when a right-side adjacent slitter is closely arranged, the conveyance assisting guide 81 abutting against the slitter is located at a position moved on the lower housing 76 side. In contrast, when the slitter is distantly arranged, the conveyance assisting guide 81 is located at a position moved in the direction X1.

According to the sheet conveyance assisting member 8 having the above-mentioned configuration, regardless of the position of the right-side adjacent slitter, the sheet piece can be conveyed to the downstream in the conveyance direction by the conveyance assisting guide 81. Thus, according to the right type slitter 7A having the above-mentioned configuration, cutting of the sheet and conveyance of the sheet piece can smoothly be performed.

Figure 46:
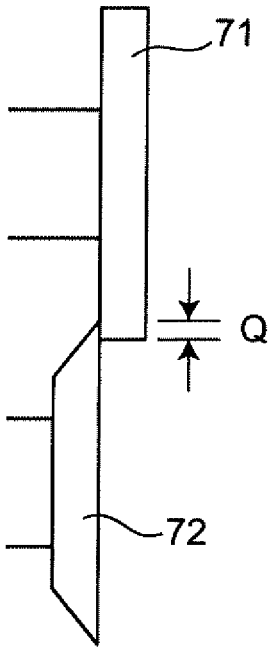
FIG. 46 is a diagram describing a lap amount.
Figure 47:
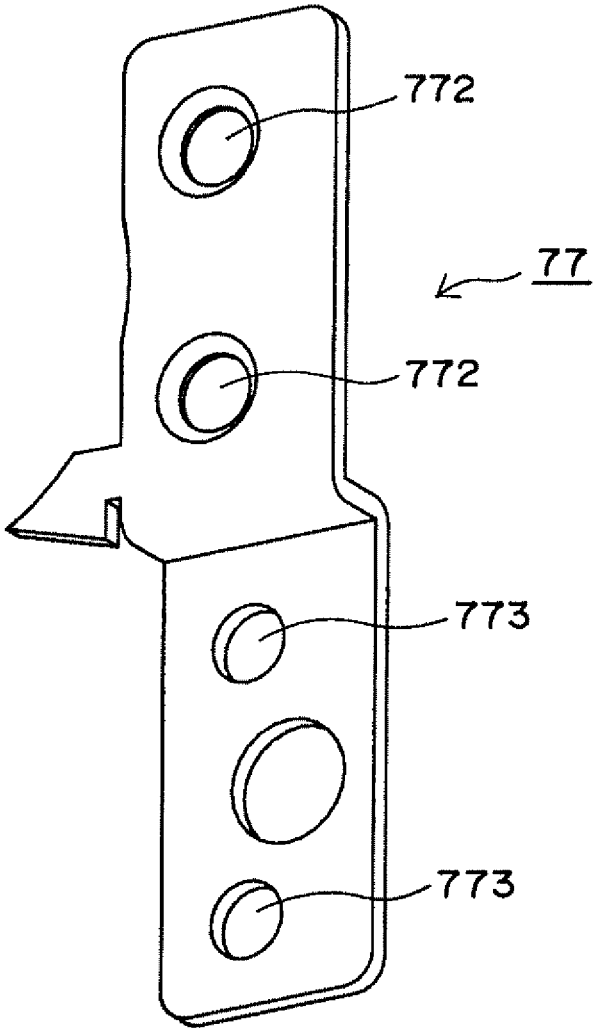
FIG. 47 is a perspective view showing an example of a link plate.

(6) The lap amount Q between the upper rotary blade 71 and the lower rotary blade 72 shown in FIG. 46 may be adjusted by using the link plate 77. The lap amount indicates the vertical dimension of the overlapping part between the blade edge of the upper rotary blade 71 and the blade edge of the lower rotary blade 72. FIG. 47 is a perspective view of the link plate 77. For example, the link plate 77 is provided as shown in FIGS. 21, 22, and 24. That is, in the link plate 77, the upper part has two attaching holes 772 and the lower part has two attaching holes 773. Then, the link plate 77 is fixed to the upper housing 75 with screws 775 inserted into the attaching holes 772 and then fixed to the lower housing 76 with screws 776 inserted into the attaching holes 773. Here, the attaching hole 773 has a larger diameter in the up and down directions than the rod (the shaft part) of the screw 776. Then, when the lap amount is to be adjusted, the screws 776 are loosened and then the lower housing 76 is moved up or down relative to the link plate 77 such that a desired lap amount is obtained and, after that, the screws 776 are tightened. As such, since the lap amount can be adjusted by virtue of the link plate 77, an optimal cutting state can appropriately be realized.

Here, the link plate 77 is constructed such that in a case that the upper rotary blade 71 performs revolution by following, the screws 775 for attaching to the upper housing 75 are loosened so that the lap amount can be adjusted and, in a case that the lower rotary blade 72 performs revolution by following, the screws 776 for attaching to the upper housing 76 are loosened so that the lap amount can be adjusted.

Further, the above-mentioned lap amount adjustment is performed at a factory shipment stage such that a predetermined standard condition may be satisfied. Thus, in ordinary cases, subsequent adjustment is unnecessary. Nevertheless, in some cases, the cutting performance is degraded owing to the type of sheet or the wear condition of the rotary blades. In such cases, when necessary, a maintenance personnel or a user may adjust the lap amounts such that a satisfactory cutting performance may be obtained.

<Sheet Cutting Device>

[First Embodiment]

FIG. 2 is a diagram of the sheet cutting device 3 viewed from the upstream. The sheet cutting device 3 is constructed in the form of a unit. That is, in the sheet cutting device 3, both side plates 31 and 32, two slide shafts 33 and 34 (FIG. 48), one drive shaft 35, and a plurality of slitters are integrated together. The two slide shafts 33 and 34 and the one drive shaft 35 are bridged between the both side plates 31 and 32. Then, each slitter is mounted along these shafts.

Here, in the present embodiment, three right type slitters 7A and three left type slitters 7B are provided as the slitters. Further, the slitters of the third embodiment are employed as the right type slitter 7A and the left type slitter 7B provided at both ends and the slitters of the first embodiment are employed as the other right type slitters 7A and left type slitters 7B.

Figure 48:
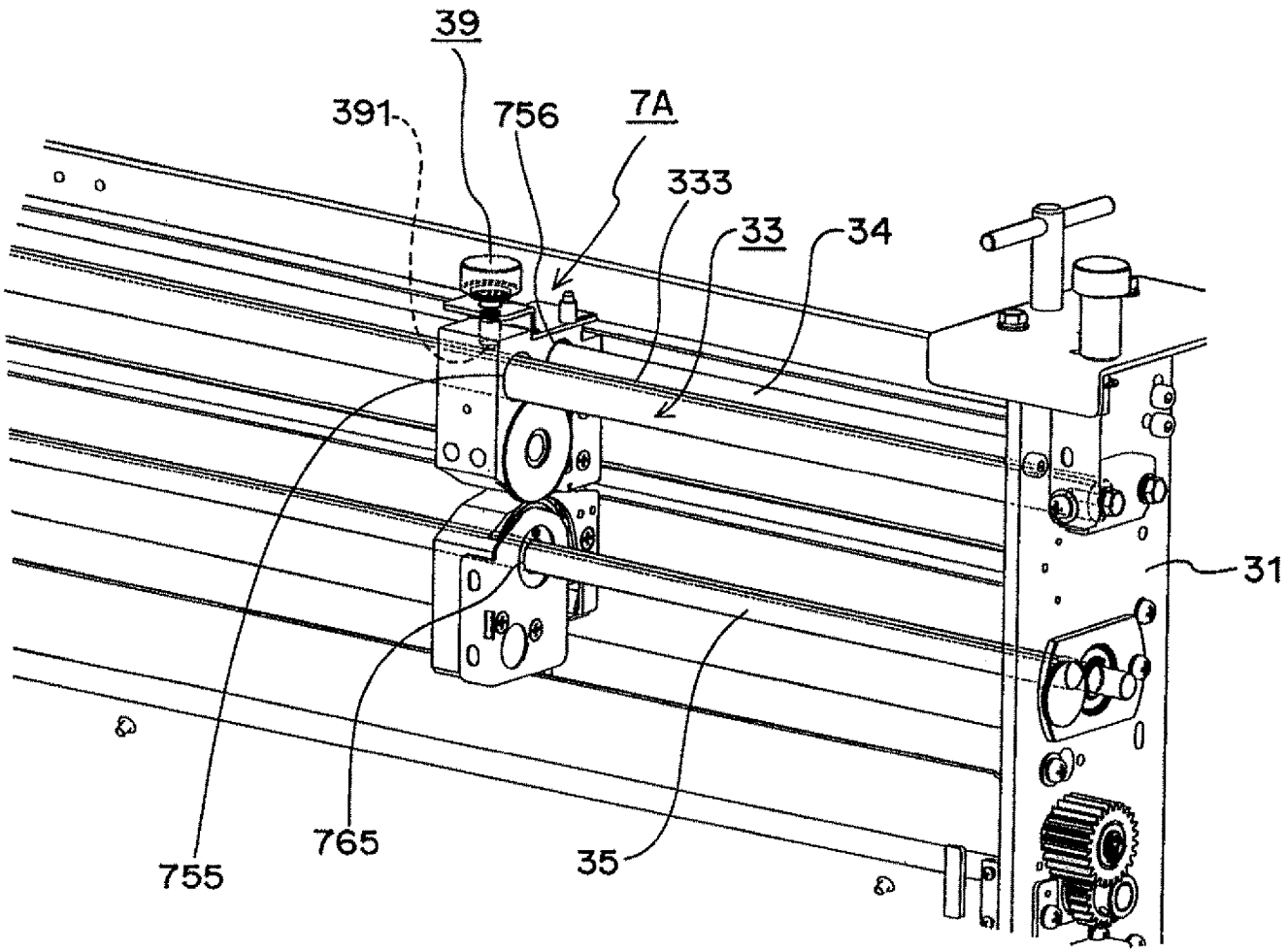
FIG. 48 is a perspective view showing a state that a right type slitter is mounted on a sheet cutting device, viewed from the upstream.

FIG. 48 is a perspective view showing a state that the right type slitter 7A is mounted on the sheet cutting device 3, viewed from the upstream. In an upper part of the upper housing 75 of the right type slitter 7A, two through holes 755 and 756 extending in the width direction are formed in parallel to each other at the same height position. Further, in the lower housing 76 of the right type slitter 7A, a through hole 765 extending through the lower rotary blade 72 in the width direction is formed. Then, the right type slitter 7A is mounted in such a manner that the two slide shafts 33 and 34 are inserted respectively into the two through holes 755 and 756 and the one drive shaft 35 is insert into the through hole 765. The left type slitter 7B is also mounted by a configuration similar to the right type slitter 7A.

Figure 49:
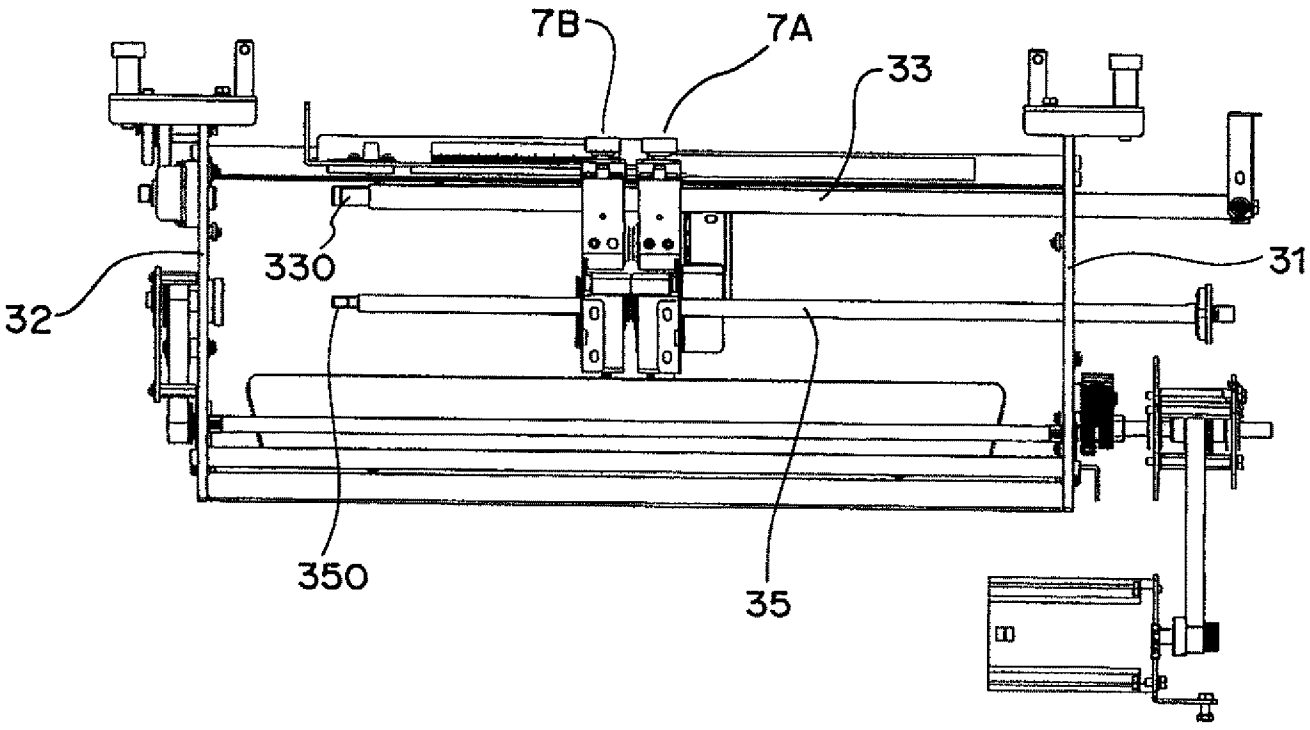
FIG. 49 is a diagram showing a situation that a right type slitter and a left type slitter are attached to or detached from a sheet cutting device, viewed from the upstream.

FIG. 49 is a diagram showing a situation that the right type slitter 7A and the left type slitter 7B are attached to or detached from the sheet cutting device 3, viewed from the upstream. The sheet cutting device 3 is constructed such that the two slide shafts 33 and 34 and the one drive shaft 35 can be separated from one side plate (the side plate 32, in this example) and then moved through the other side plate (the side plate 31, in this example). Thus, as shown in FIG. 49, when the two slide shafts 33 and 34 and the one drive shaft 35 are removed from the side plate 32 and then moved to the side plate 31 side, the right type slitter 7A and the left type slitter 7B can be mounted or extracted through the end parts 330 and 350 on the side plate 32 side of the shafts. That is, in the sheet cutting device 3, the right type slitter 7A and the left type slitter 7B are provided in a freely attachable and detachable manner.

Figure 50:
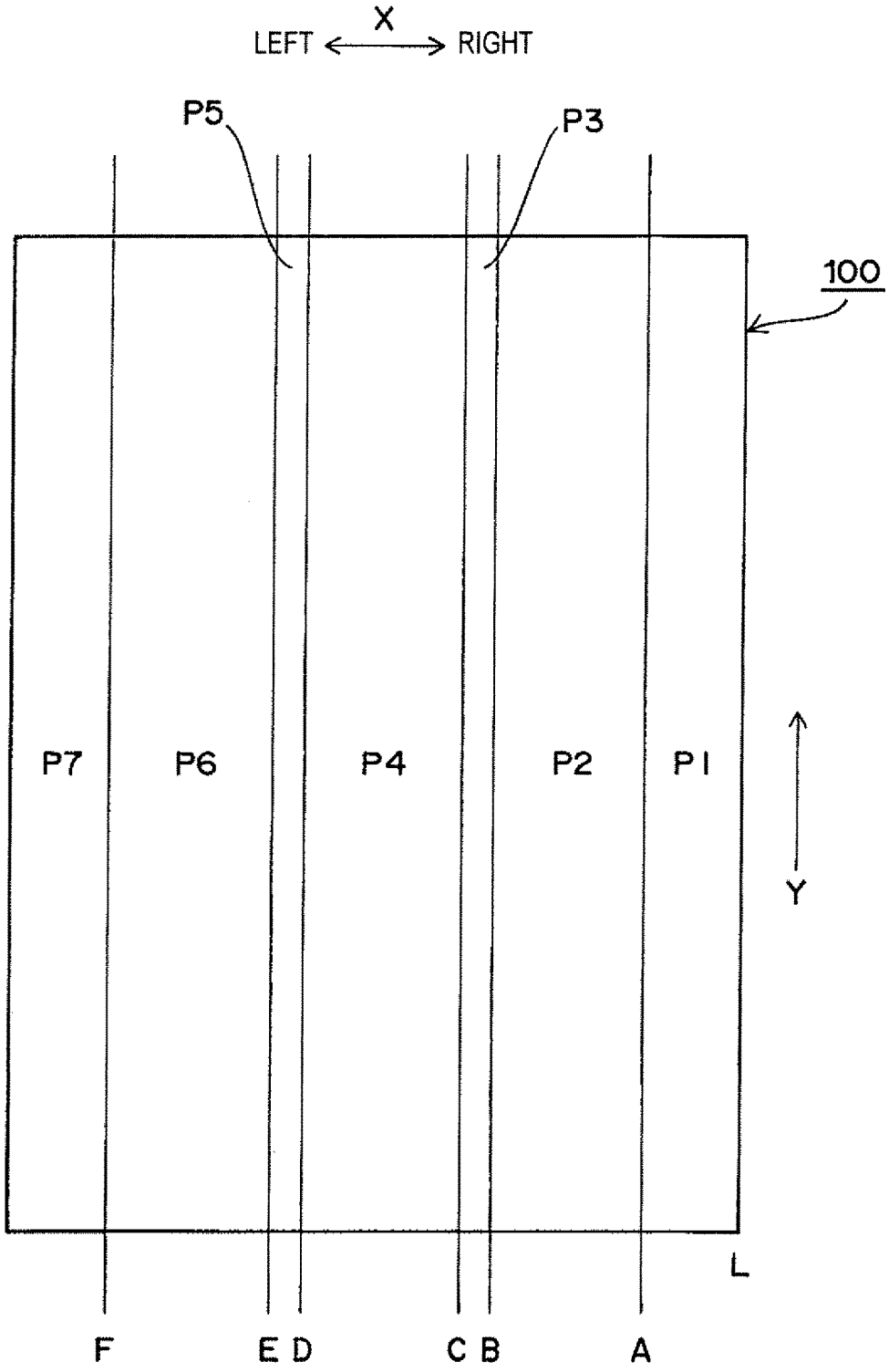
FIG. 50 is a diagram showing an example of processing contents performed by a sheet cutting device.

FIG. 50 shows an example of processing contents performed by the sheet cutting device 3. In this example, cutting processing alone is performed. In FIG. 50, the right end of the sheet 100 serves as a reference position L. Symbols A to F indicate a first to a sixth cutting processing position. These cutting processing positions can be set up by using a width dimension from the reference position L or, alternatively, may be set up by using a width dimension from the adjacent cutting processing position. Then, in this example, sheet pieces P1, P3, P5, and P7 among the sheet pieces P1 to P7 generated by cutting are excluded as scraps. Thus, in the sheet cutting device 3, slitters 7A, 7B, 7A, 7B, 7A, and 7B are arranged at the first to the sixth cutting processing position A to F in this order. That is, the sheet cutting device 3 includes both the right type slitters 7A and the left type slitters 7B. Further, the sheet cutting device 3 includes two combinations of the right type slitter 7A and the left type slitter 7B arranged in close contact with each other such that the non-cutting surfaces 712 of the upper rotary blades 71 shown in FIG. 17 face to each other. Thus, sheet pieces whose width dimension is as remarkably small as D1 (FIG. 17) can be generated by cutting. Further, the scrap exclusion members 73 of all slitters 7A and 7B are set in the exclusion mode. By virtue of this, according to the sheet cutting device 3, cutting processing can be performed at the first to the sixth cutting processing position A to F and then the sheet pieces P1, P3, P5, and P7 can be excluded as scraps.

In particular, in the sheet cutting device 3 of the present embodiment, as shown in FIG. 2, the right type slitter 7A of the third embodiment is arranged at the cutting processing position A on the rightmost side and the left type slitter 7B of the third embodiment is arranged at the cutting processing position F on the leftmost side. By virtue of this, the sheet pieces P1 and P7 generally having large width dimensions as margins can stably and smoothly be excluded.

In the sheet cutting device 3, as seen from FIG. 49, the right type slitter 7A and the left type slitter 7B can be moved in the width direction along the two slide shafts 33 and 34 and the one drive shaft 35 and are fixed to the slide shafts 33 at desired positions with screws 39. The upper part of the slide shaft 33 is provided with a V-groove 333 against which the tip 391 of the screw 39 is pressed.

The work of moving the right type slitters 7A and the left type slitters 7B in the width direction and the work of screw fixing can be performed by manual operation. In this case, the width directional positions of the slitters 7A and 7B can be determined on the basis of a scale provided in parallel to the slide shafts 33 and 34.

According to the sheet cutting device 3 having the above-mentioned configuration, cutting processing can be performed such as to generate sheet pieces whose width dimensions are remarkably small and then the generated sheet pieces can be excluded as scraps.

[Second Embodiment]

The sheet cutting device of the present embodiment is different from the sheet cutting device of the first embodiment in a point that the work of moving the right type slitters 7A and the left type slitters 7B in the width direction are performed by electric driving.

Figure 51:
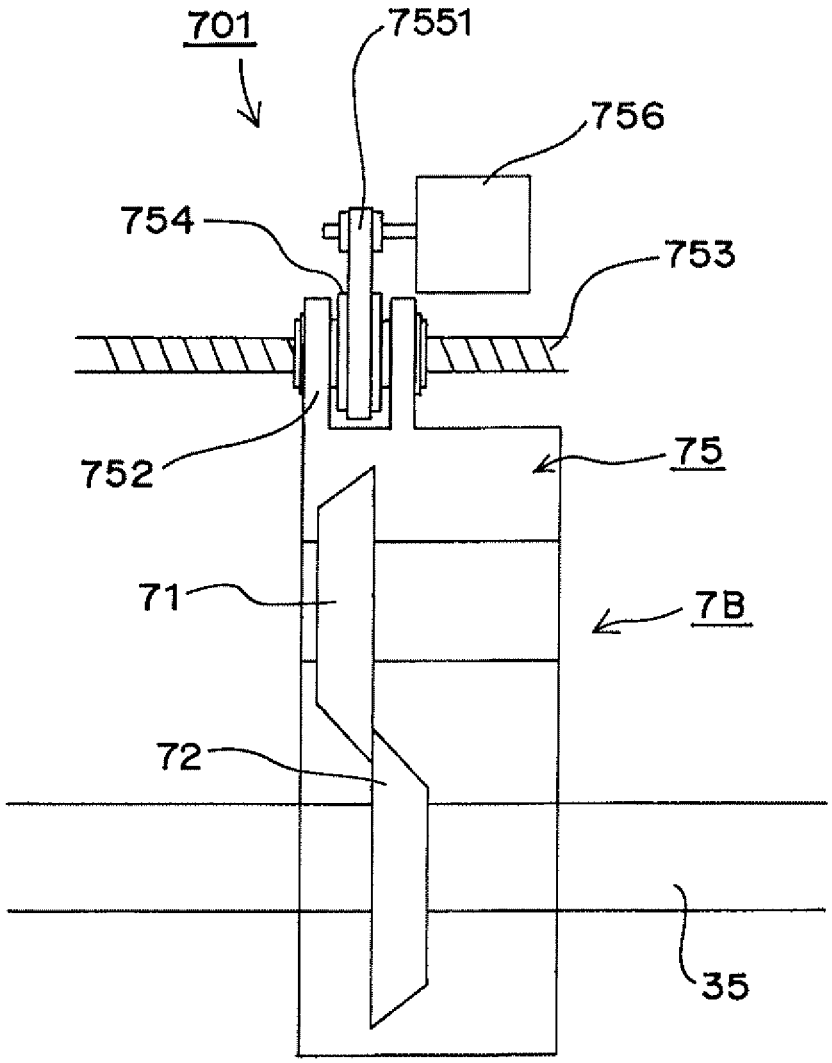
FIG. 51 is a diagram showing an example of an electric drive mechanism for a slitter of a sheet cutting device of a second embodiment.

FIG. 51 is a diagram showing an example of an electric drive mechanism for the slitter of the present embodiment. This electric drive mechanism 701 includes: a bifurcated protrusion 752 formed in an upper part of the upper housing 75; a screwed shaft 753 going through the bifurcated protrusion 752 in the width direction; a tube member 754 supported within the bifurcated protrusion 752 in a freely revolvable manner in a state of being screwed on the screwed shaft 753; and a motor 756 for causing, through an annular belt 7551, the tube member 754 to revolve. However, the electric drive mechanism 701 does not include the slide shafts 33 and 34 of the first embodiment.

In the electric drive mechanism 701 having the above-mentioned configuration, when the motor 756 operates, the tube member 754 is revolved through the annular belt 755. As a result, the tube member 754 together with the entire slitter is moved along the screwed shaft 753. Then, when the operation of the motor 756 stops, the revolution of the tube member 754 stops and hence the slitter stops at the position on the screwed shaft 753 where the tube member 754 has stopped.

Thus, according to the electric drive mechanism 701 having the above-mentioned configuration, the work of moving the slitters 7A and 7B in the width direction can automatically be performed.

[Third Embodiment]

The sheet cutting device of the present embodiment includes an electric drive mechanism different from that of the second embodiment. The other points are the same as the sheet cutting device of the first and the second embodiment.

Figure 52:
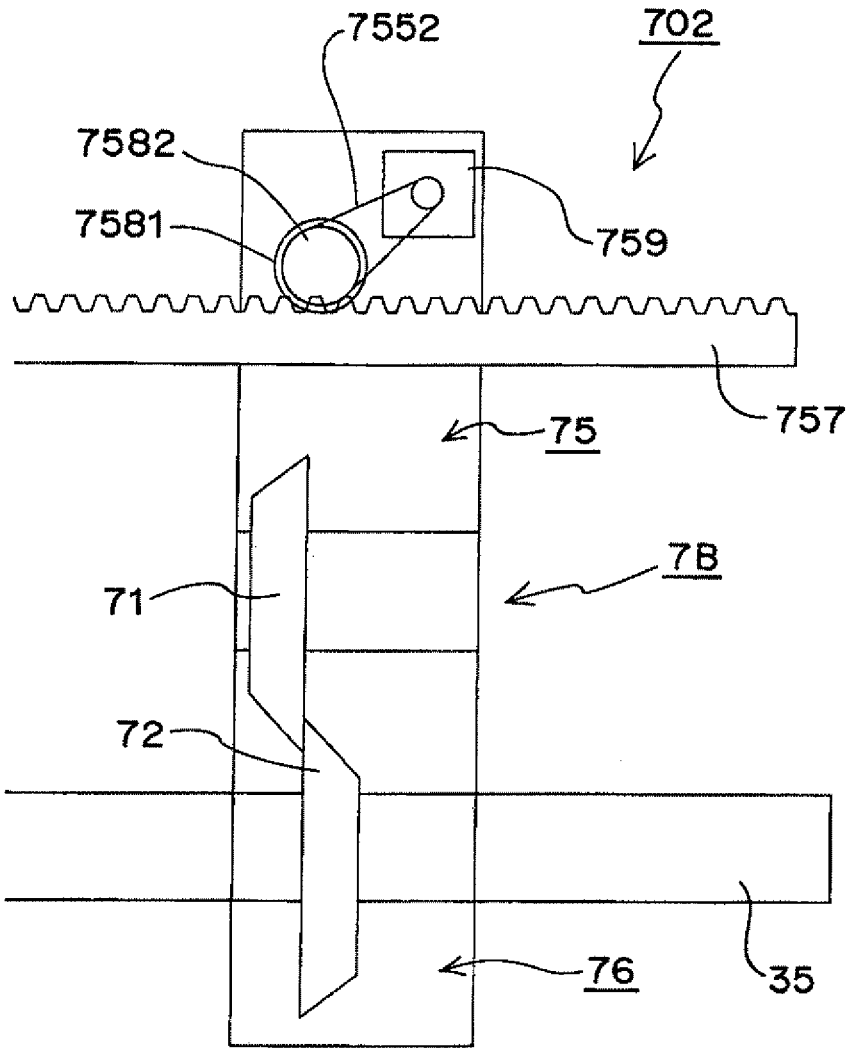
FIG. 52 is a diagram showing another example of an electric drive mechanism for a slitter of a sheet cutting device of a third embodiment.

FIG. 52 is a diagram showing an example of an electric drive mechanism 702 for the slitter of the present embodiment. This electric drive mechanism 702 includes: a rack 757 provided over the width direction in the upstream of the upper housing 75; a pinion 7581 engaging with the rack 757 and fixed to the upper housing 75 in a revolvable manner; a pulley 7582 provided coaxially on the pinion 7581 and provided integrally with the pinion 7581; and a motor 759 fixed to the upper housing 75 and causing, through an annular belt 7552, the pulley 7582 to revolve. However, the electric drive mechanism 702 does not include the slide shafts 33 and 34 of the first embodiment.

In the electric drive mechanism 702 having the above-mentioned configuration, when the motor 759 operates, the pulley 7582 and the pinion 7581 are revolved through the annular belt 7552 and moved along the rack 757. At that time, the electric drive mechanism 702 together with the entire slitter is moved along the rack 757. Then, when the operation of the motor 759 stops, the revolution of the pulley 7582 and the pinion 7581 stops and hence the slitter stops at the position of the rack 757 where the pinion 7581 has stopped.

Thus, according to the electric drive mechanism 702 having the above-mentioned configuration, the work of moving the slitters 7A and 7B in the width direction can automatically be performed.

[Other Embodiments]

As the slitters constituting the sheet cutting device 3, the slitters 7A and 7B of the first to the third embodiment or other embodiments may arbitrarily be selected and employed. Alternatively, the right type slitters 7A alone or the left type slitters 7B alone may be employed.

<Sheet Processing Apparatus>

[First Embodiment]

As shown in FIG. 1, the sheet processing apparatus 1 includes the sheet cutting device 3 and the sheet cutting device 3 includes the right type slitter 7A and the left type slitter 7B.

Figure 54:
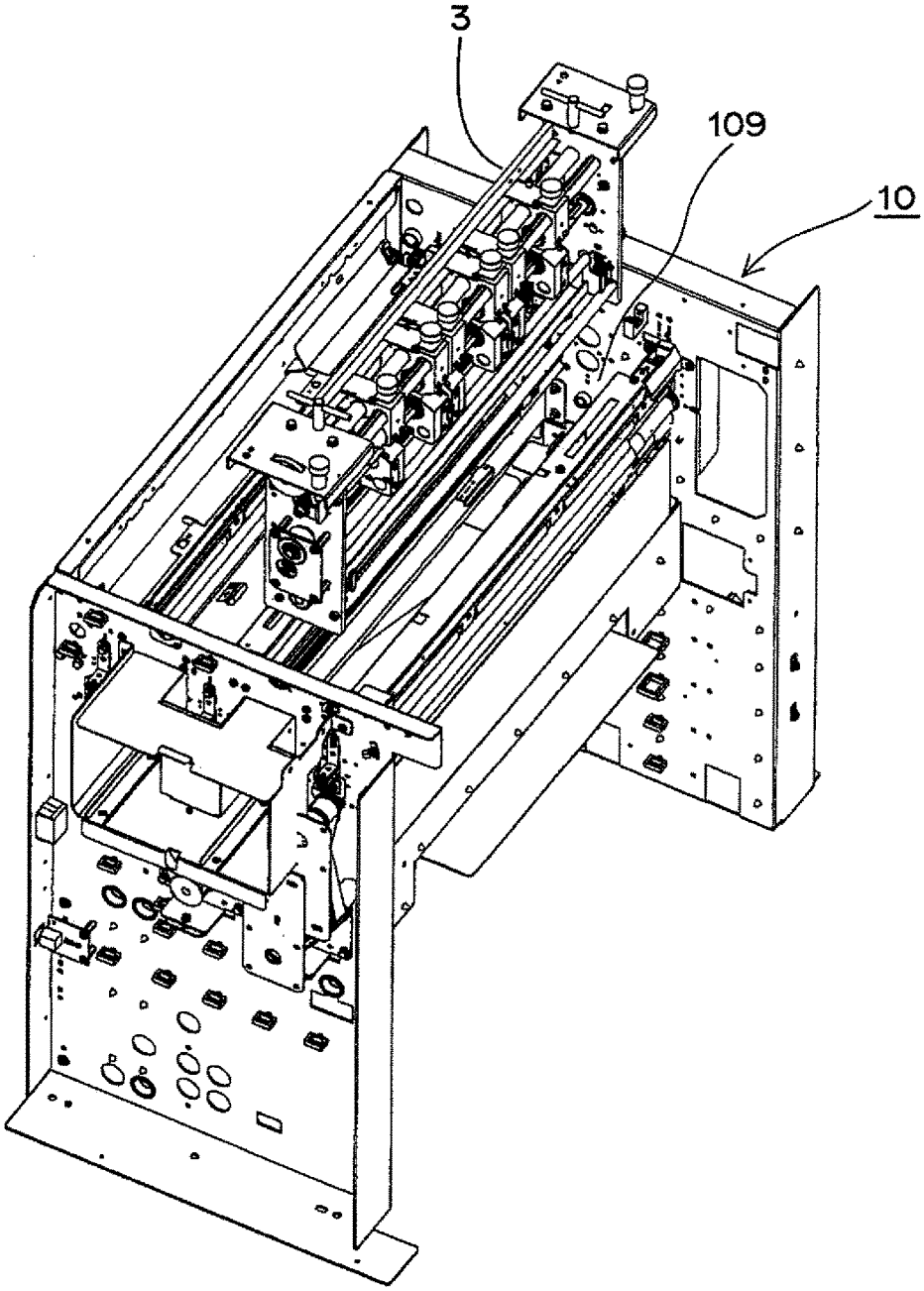
FIG. 54 is a perspective part view of a sheet processing apparatus of a first embodiment.

The sheet processing apparatus 1 of the present embodiment includes the sheet cutting device 3 of anyone of the first to the third embodiment and other embodiments. The sheet cutting device 3 is constructed in the form of a unit. Thus, as shown in FIG. 54, the sheet cutting device 3 is mounted on a receiving part 109 provided in the apparatus body 10 so that the sheet processing apparatus 1 of FIG. 1 is constructed. Specifically, when the sheet cutting device 3 is mounted on the receiving part 109, a gear wheel (not shown) in the end part of the drive shaft 35 engages with a drive gear wheel (not shown) provided on the receiving part 109 side so that operation can be achieved.

According to the sheet processing apparatus 1 having the above-mentioned configuration, cutting processing is performed by the sheet cutting device 3 and then the generated sheet piece is conveyed to the downstream and processed by the processing parts 4 and 5 in the next stage. Further, when the scrap exclusion member 73 or the scrap exclusion assisting member 735 is provided, the sheet pieces generated as scraps can be excluded and then the remaining sheet pieces are conveyed to the downstream toward the processing parts 4 and 5 in the next stage.

[Second Embodiment]

Figure 53:
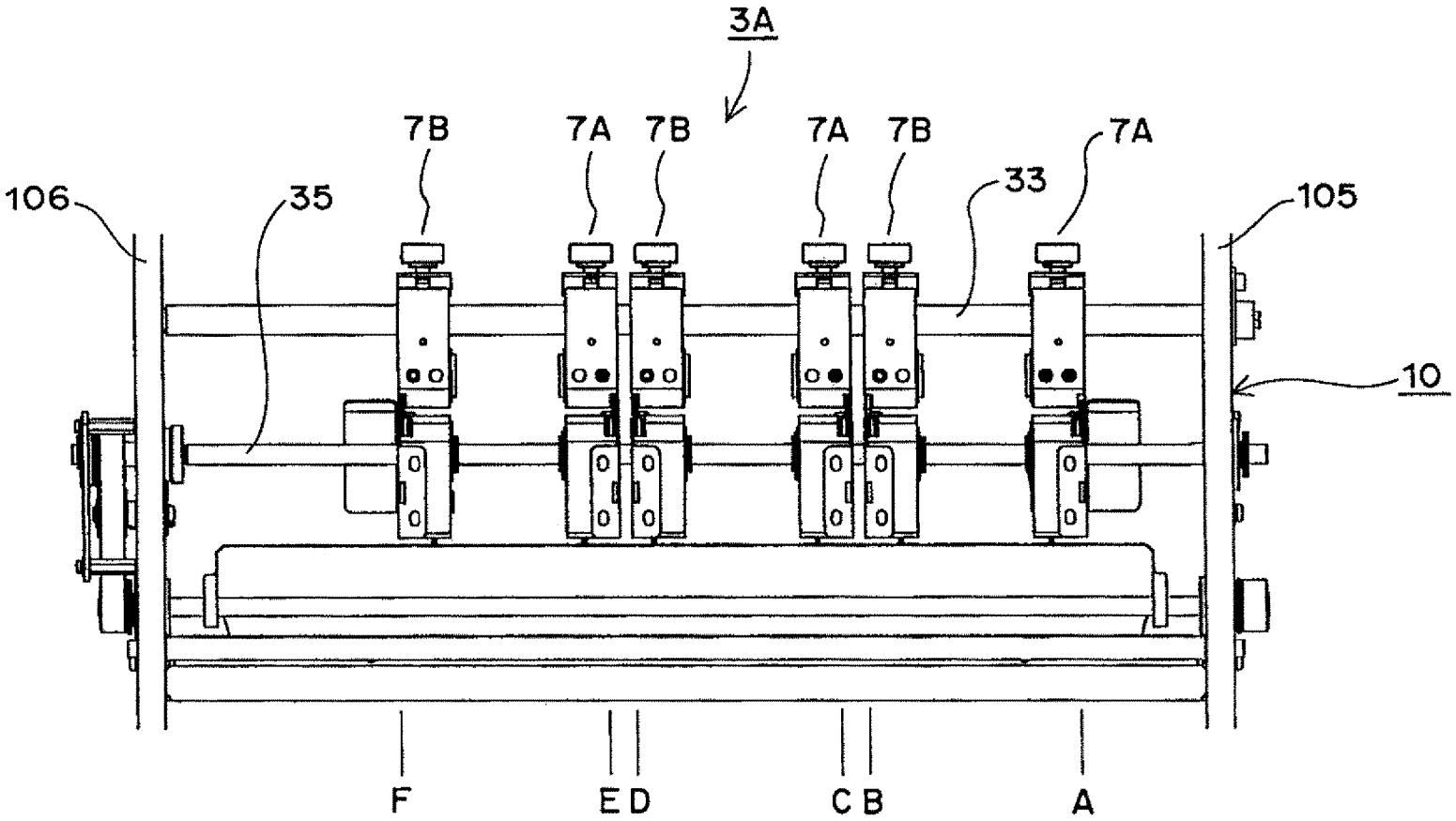
FIG. 53 is a diagram of a sheet cutting device of another embodiment viewed from the upstream.

In the first embodiment, the sheet cutting device 3 constructed in the form of a unit has been attached to the receiving part 109 of the apparatus body 10 so that the sheet processing apparatus 1 has been constructed. In contrast, in the present embodiment, as shown in FIG. 53, the sheet cutting device 3 constructed in the form of a unit is not employed and, instead, a configuration is employed that the processing part 3A including a plurality of the slitters 7A and 7B is provided in the apparatus body 10. In FIG. 53, the slitters 7A and 7B are mounted on the slide shafts 33 and 34 and the drive shaft 35 directly attached to both side walls 105 and 106 of the apparatus body 10 so that the sheet processing apparatus 1 is constructed.

[Other Embodiments]

Figure 55:
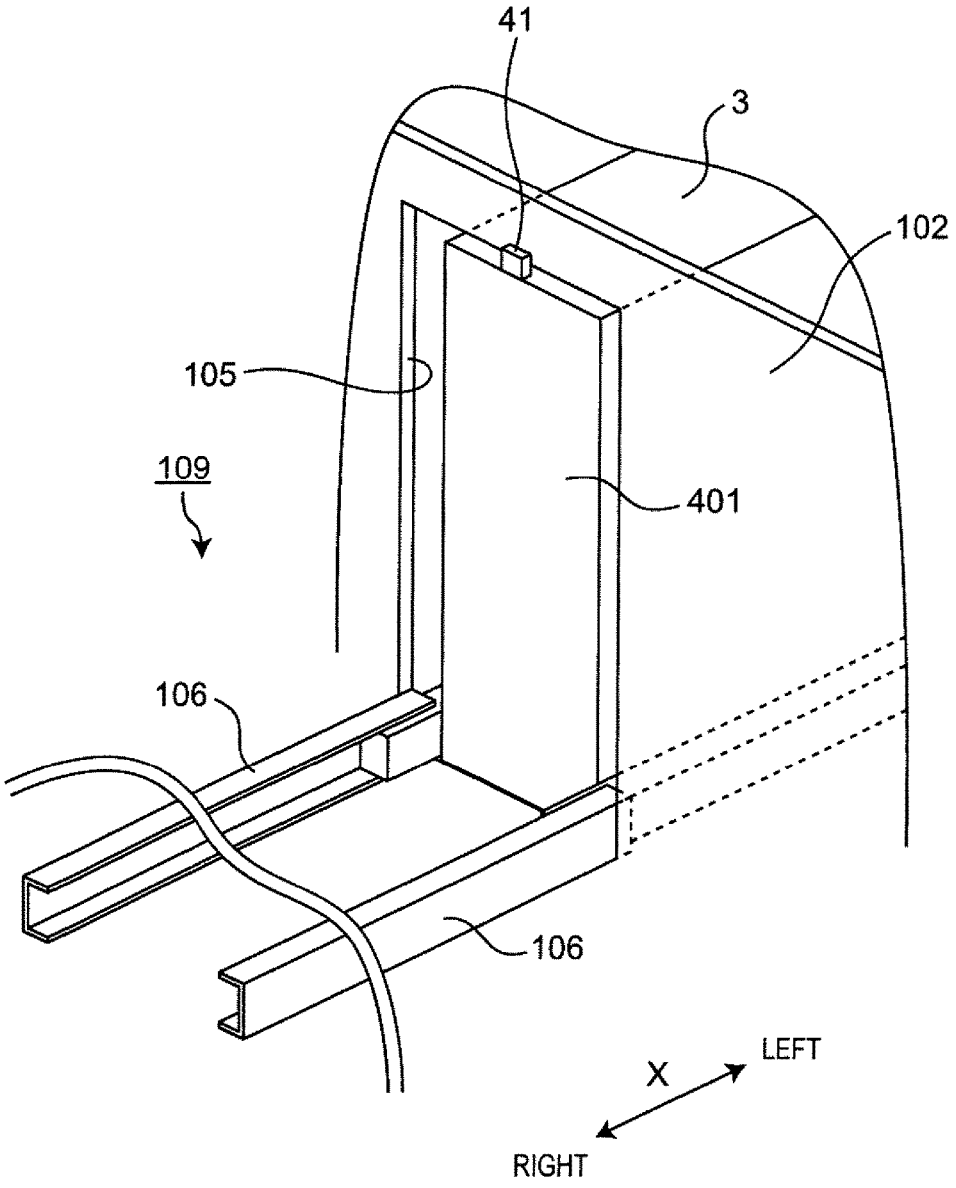
FIG. 55 is a perspective part view of a sheet processing apparatus of another embodiment.

(1) In FIG. 54, the sheet cutting device 3 constructed in the form of a unit is provided in a freely attachable and detachable manner to and from the receiving part 109 from the above of the apparatus body 10. Instead, as shown in FIG. 55, the sheet cutting device 3 may be provided in a freely attachable and detachable manner to and from the receiving part 109 in a horizontal direction through an opening 105 formed in one side wall 102 (or a side wall 101) selected from the side walls 101 and 102 of the apparatus body 10. For example, in FIG. 55, a pair of rail members 106 are provided that extend through the opening 105. Then, the sheet cutting device 3 is slid along the rail members 106 and then pulled out through the opening 105.

(2) In FIG. 54, the sheet cutting device 3 is provided in such a manner that the sheet cutting device 3 can completely be removed from the apparatus body 10. Instead, the sheet cutting device 3 may be provided in such a manner that the sheet cutting device 3 cannot completely be removed from the apparatus body 10. For example, in the example of FIG. 55, a protrusion (a locking member) 41 is provided at an upper end of a right side plate 401 of the sheet cutting device 3. Then, when the sheet cutting device 3 is to be pulled out through the opening 105, the protrusion 41 interferes with the side wall 102. Thus, the sheet cutting device 3 is not completely pulled out through the opening 105 and is held on the rail members 106 in a half pulled out state.

(3) In the example of FIG. 55, the protrusion 41 may be provided in a freely attachable and detachable manner or, alternatively, may be provided in a freely movable manner between a position where the protrusion 41 interferes with the side wall 102 and a position where the interference does not occur. According to this configuration, when necessary, the protrusion 41 may be removed or, alternatively, the protrusion 41 may be moved to a position where the interference does not occur so that the sheet cutting device 3 can completely be pulled out through the opening 105.

(4) A body scrap exclusion part (not shown) having a similar function to the scrap exclusion member 73 and/or the scrap exclusion assisting member 735 so as to exclude scraps may be provided directly in the apparatus body 10. In FIG. 1, when the sheet cutting device 3 can be provided in the processing part 3A or the processing part 4A, the body scrap exclusion part is preferably provided in the downstream relative to the processing part 4A and, in particular, preferably provided in the upstream relative to the processing part 5A. According to this configuration, regardless of whether the slitter of the sheet cutting device 3 includes or not the scrap exclusion member 73 and/or the scrap exclusion assisting member 735, the scraps generated by cutting by the sheet cutting device 3 can be excluded.

INDUSTRIAL APPLICABILITY

In the slitter of the present invention, the width dimension of the sheet piece generated by cutting can be made small and can be set up freely. Thus, a high value is obtained in industrial utilization.

DESCRIPTION OF REFERENCE NUMERALS

1 Sheet processing apparatus
100 Sheet
3 Sheet cutting device
3A, 4A, 5A Processing part
7A Right type slitter
7B Left type slitter
701, 702 Electric drive mechanism
71 Upper rotary blade
711 Cutting surface
712 Non-cutting surface
72 Lower rotary blade
721 Cutting surface
722 Non-cutting surface
73 Scrap exclusion member
731 Sheet guide
735 Scrap exclusion assisting member
741, 742 Revolving shaft
7411, 7421 Shaft center
75 Upper housing
751 First side surface
76 Lower housing
78, 79 Cantilevered supporting part
8 Sheet conveyance assisting member
81 Conveyance assisting guide

What is claimed is:

1. A slitter comprising: an upper rotary blade; a lower rotary blade; a box-shaped upper housing for holding the upper rotary blade; and a box-shaped lower housing for holding the lower rotary blade, the upper housing and the lower housing being linked, and the slitter being constructed such that the both rotary blades revolve in a manner that a tip on a cutting surface side of the upper rotary blade and a tip on a cutting surface side of the lower rotary blade are rubbed together so that a sheet passing through between the both rotary blades is cut, wherein one rotary blade selected from the upper rotary blade and the lower rotary blade is cantilevered, within one housing selected from the upper housing and the lower housing, on the cutting surface side of the one rotary blade by a first cantilevered supporting part.

2. The slitter according to claim 1, wherein an other rotary blade selected from the upper rotary blade and the lower rotary blade is cantilevered, within an other housing selected from the upper housing and the lower housing, on a non-cutting surface side of the other rotary blade by a second cantilevered supporting part.

3. The slitter according to claim 2, wherein the second cantilevered supporting part holds a second revolving shaft for supporting the other rotary blade, in a manner not permitting swing relative to a shaft center.

4. The slitter according to claim 1, wherein the first cantilevered supporting part holds a first revolving shaft for supporting the one rotary blade, in a manner not permitting swing relative to a shaft center.

5. The slitter according to claim 1, wherein an other rotary blade selected from the upper rotary blade and the lower rotary blade is held by an at-both-ends supporting part, and wherein the at-both-ends supporting part includes an inclination adjustment part for adjusting an inclination of a shaft center of a second revolving shaft for supporting the other rotary blade.

6. The slitter according to claim 5, wherein the inclination adjustment part adjusts the inclination in the frontward and rearward directions of the shaft center of the second revolving shaft.

7. The slitter according to claim 6, wherein the inclination adjustment part adjusts the inclination in the up and down directions of the shaft center of the second revolving shaft.

8. The slitter according to claim 5, wherein the inclination adjustment part adjusts the inclination in the up and down directions of the shaft center of the second revolving shaft.

9. The slitter according to claim 1, wherein a first side surface of a first housing for holding the one rotary blade which faces a direction of a non-cutting surface side of the one rotary blade does not protrude beyond the non-cutting surface of the one rotary blade in the direction of the non-cutting surface side.

10. The slitter according to claim 9, wherein the first side surface of the first housing is located on the non-cutting surface side relative to the cutting surface of the one rotary blade.

11. A sheet cutting device for performing a plurality of cutting processes at once onto a sheet under conveyance, wherein a plurality of slitters according to claim 1 are provided in a width direction, and wherein all slitters are provided such as to cut the sheet along a direction of conveyance of the sheet.

12. The sheet cutting device according to claim 11, including as the slitters at least:

a right type slitter constructed such that the non-cutting surface of the one rotary blade cantilevered on the cutting surface side is located on a right side of the cutting surface in a direction of conveyance of the sheet; and a left type slitter constructed such that the non-cutting surface of the one rotary blade cantilevered on the cutting surface side is located on a left side of the cutting surface in a direction of conveyance of the sheet.

13. The sheet cutting device according to claim 12, wherein the right type slitter and the left type slitter are arranged such that the non-cutting surface of the one rotary blade of the right type slitter faces that of the left type slitter.

14. The sheet cutting device according to claim 11, wherein the slitters are provided in a freely movable manner in the width direction.

15. A sheet processing apparatus for processing a sheet in the course of conveyance of the sheet, including at least a sheet cutting device according to claim 11.

16. The sheet processing apparatus according to claim 15, further including a receiving part to which the sheet cutting device is attached, wherein the sheet cutting device is provided in the form of a unit freely attachable to and detachable from the receiving part.

17. A sheet processing apparatus for processing a sheet in the course of conveyance of the sheet, wherein a plurality of slitters according to claim 1 are aligned in a width direction, and wherein all slitters are provided such as to cut the sheet along a direction of conveyance of the sheet.

18. The sheet processing apparatus according to claim 17, including as the slitters at least:

a right type slitter constructed such that the non-cutting surface of the one rotary blade cantilevered on the cutting surface side is located on a right side of the cutting surface in a direction of conveyance of the sheet; and a left type slitter constructed such that the non-cutting surface of the one rotary blade cantilevered on the cutting surface side is located on a left side of the cutting surface in a direction of conveyance of the sheet.

19. The sheet processing apparatus according to claim 18, wherein the right type slitter and the left type slitter are arranged such that the non-cutting surface of the one rotary blade of the right type slitter faces that of the left type slitter.

20. The sheet processing apparatus according to claim 17, wherein the slitters are provided in a freely movable manner in the width direction.

* * * * *